US011725494B2

(12) United States Patent
Boone et al.

(10) Patent No.: US 11,725,494 B2
(45) Date of Patent: Aug. 15, 2023

(54) METHOD AND APPARATUS FOR AUTOMATICALLY MODIFYING A DRILLING PATH IN RESPONSE TO A REVERSAL OF A PREDICTED TREND

(71) Applicant: Nabors Drilling Technologies USA, Inc., Houston, TX (US)

(72) Inventors: Scott Gilbert Boone, Houston, TX (US); Brian Ellis, Spring, TX (US); Colin Gillan, Houston, TX (US); Beat Küttel, Spring, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 17/878,475

(22) Filed: Aug. 1, 2022

(65) Prior Publication Data

US 2022/0372862 A1 Nov. 24, 2022

Related U.S. Application Data

(63) Continuation of application No. 17/360,799, filed on Jun. 28, 2021, now Pat. No. 11,434,743, which is a (Continued)

(51) Int. Cl.
*E21B 44/00* (2006.01)
*E21B 7/10* (2006.01)
(Continued)

(52) U.S. Cl.
CPC ..... *E21B 44/02* (2013.01); *E21B 7/04* (2013.01)

(58) Field of Classification Search
CPC ... E21B 7/04; E21B 7/06; E21B 7/068; E21B 7/10; E21B 7/067; E21B 7/065;
(Continued)

(56) References Cited

U.S. PATENT DOCUMENTS 1,891,329 A 12/1932 Le Compte et al.
2,005,889 A 6/1935 Dillon et al.
(Continued)

FOREIGN PATENT DOCUMENTS

EP 0774563 B1 7/2002
RU 2208153 C2 7/2003
(Continued)

OTHER PUBLICATIONS

"40223705-Series Wildcat Services Pneumatic Automated Drilling System," *available at* http://www.nov.com/Drilling/Control_and_Advisiory_Systems/Drawworks_Control_Auto_Drilling/Auto_Drillers.aspx (last visited Oct. 8, 2009).
(Continued)

*Primary Examiner* — Kipp C Wallace
(74) *Attorney, Agent, or Firm* — Haynes and Boone, LLP

(57) ABSTRACT

A system and method of directionally steering a bottom hole assembly ("BHA") by receiving data indicative of a directional trend of the BHA and a projection to bit depth; determining a location of the BHA based on the received data; comparing the location of the BHA to a planned drilling path to identify an amount of deviation; automatically creating a modified drilling path based on the amount of deviation and a predicted trend of a downhole parameter; detecting a trend of the downhole parameter while drilling along the modified drilling path; and automatically creating a further modified drilling path when the trend of the downhole parameter is a reversal of the predicted trend of the downhole parameter. The predicted trend of the downhole parameter is an increase of a d-exponent factor or a d-exponent-corrected factor with an increase in depth.

16 Claims, 21 Drawing Sheets

Related U.S. Application Data continuation of application No. 15/705,393, filed on Sep. 15, 2017, now abandoned, which is a continuation of application No. 14/174,522, filed on Feb. 6, 2014, now Pat. No. 9,784,089, which is a continuation of application No. 12/234,584, filed on Sep. 19, 2008, now Pat. No. 8,672,055, which is a continuation-in-part of application No. 11/952,511, filed on Dec. 7, 2007, now Pat. No. 7,938,197, which is a continuation-in-part of application No. 11/859,378, filed on Sep. 21, 2007, now Pat. No. 7,823,655, and a continuation-in-part of application No. 11/859,378, filed on Sep. 21, 2007, now Pat. No. 7,823,655, and a continuation-in-part of application No. 11/847,048, filed on Aug. 29, 2007, now Pat. No. 9,410,418, and a continuation-in-part of application No. 11/747,110, filed on May 10, 2007, now Pat. No. 7,860,593, and a continuation-in-part of application No. 11/668,388, filed on Jan. 29, 2007, now Pat. No. 8,215,417.

(60) Provisional application No. 61/026,323, filed on Feb. 5, 2008, provisional application No. 61/016,093, filed on Dec. 21, 2007, provisional application No. 60/985,869, filed on Nov. 6, 2007, provisional application No. 60/886,259, filed on Jan. 23, 2007, provisional application No. 60/869,047, filed on Dec. 7, 2006.

(51) Int. Cl.
*E21B 44/02* (2006.01)
*E21B 7/04* (2006.01)

(58) Field of Classification Search
CPC ..... E21B 7/064; E21B 7/062; E21B 7/061; E21B 44/00; E21B 44/005
See application file for complete search history.

(56) References Cited

U.S. PATENT DOCUMENTS 2,724,574 A 11/1955 Ledgerwood, Jr.
3,223,183 A 12/1965 Varney
3,265,359 A 8/1966 Bowden
3,407,886 A 10/1968 Bennett
3,550,697 A 12/1970 Hobhouse
4,492,276 A 1/1985 Kamp
4,535,972 A 8/1985 Millheim et al.
4,662,608 A 5/1987 Ball
4,760,735 A 8/1988 Sheppard et al.
4,839,853 A 6/1989 Deerwester et al.
4,848,144 A 7/1989 Ho
4,854,397 A 8/1989 Warren et al.
4,958,125 A 9/1990 Jardine et al.
5,103,920 A 4/1992 Patton
5,205,163 A 4/1993 Sananikone
5,301,109 A 4/1994 Landauer et al.
5,305,836 A 4/1994 Holbrook et al.
5,358,059 A 10/1994 Ho
5,390,748 A 2/1995 Goldman
5,467,832 A 11/1995 Orban et al.
5,474,142 A 12/1995 Bowden
5,551,286 A 9/1996 Booer
5,713,422 A 2/1998 Dhindsa
5,730,234 A 3/1998 Putot
5,738,178 A 4/1998 Williams et al.
5,842,149 A 11/1998 Harrell et al.
6,026,912 A 2/2000 King et al.
6,029,951 A 2/2000 Guggari
6,050,348 A 4/2000 Richarson et al.
6,065,332 A 5/2000 Dominick
6,092,610 A 7/2000 Kosmala et al.
6,152,246 A 11/2000 King et al.
6,155,357 A 12/2000 King et al.
6,192,998 B1 2/2001 Pinckard
6,233,498 B1 5/2001 King et al.
6,293,356 B1 9/2001 King et al.
6,382,331 B1 5/2002 Pinckard
6,405,808 B1 6/2002 Edwards et al.
6,438,495 B1 8/2002 Chau et al.
6,523,623 B1 2/2003 Schuh
6,757,613 B2 6/2004 Chapman et al.
6,802,378 B2 10/2004 Haci et al.
6,820,702 B2 11/2004 Niedermayr et al.
6,892,812 B2 5/2005 Niedermayr et al.
6,918,453 B2 7/2005 Haci et al.
7,000,710 B1 2/2006 Umbach
7,032,689 B2 4/2006 Goldman et al.
7,044,239 B2 5/2006 Pinckard et al.
7,059,427 B2 6/2006 Power et al.
7,085,696 B2 8/2006 King
7,096,979 B2 8/2006 Haci et al.
7,140,452 B2 11/2006 Hutchinson
7,152,696 B2 12/2006 Jones
7,243,735 B2 7/2007 Koederitz et al.
7,357,196 B2 4/2008 Goldman et al.
7,419,012 B2 9/2008 Lynch
7,546,209 B2 6/2009 Williams
7,584,788 B2 9/2009 Baron et al.
7,588,100 B2 9/2009 Hamilton
7,665,533 B2 2/2010 Hopwood et al.
7,775,297 B2 8/2010 Hopwood et al.
7,823,655 B2 11/2010 Boone et al.
7,860,593 B2 12/2010 Boone
7,938,197 B2 5/2011 Boone et al.
8,210,283 B1 7/2012 Benson et al.
8,360,171 B2 1/2013 Boone et al.
8,510,081 B2 8/2013 Boone
8,528,663 B2 9/2013 Boone
10,672,154 B2 6/2020 Gillen et al.
11,598,198 B2 * 3/2023 Brune ..... E21B 47/024
2002/0026456 A1 2/2002 Bradford
2002/0103799 A1 8/2002 Bradford et al.
2002/0104685 A1 8/2002 Pinckard et al.
2003/0024738 A1 2/2003 Schuh
2004/0028476 A1 2/2004 Payne et al.
2004/0168827 A1 9/2004 Jeffryes
2004/0205461 A1 10/2004 Kaufman et al.
2004/0222023 A1 11/2004 Haci et al.
2004/0238222 A1 12/2004 Harrison
2005/0061549 A1 3/2005 Evans et al.
2005/0096846 A1 5/2005 Koithan et al.
2006/0041828 A1 2/2006 King et al.
2006/0081399 A1 4/2006 Jones
2006/0181742 A1 8/2006 Lech et al.
2006/0185899 A1 8/2006 Alft et al.
2007/0016067 A1 1/2007 Webster et al.
2007/0181343 A1 8/2007 Russell et al.
2007/0203651 A1 8/2007 Blanz et al.
2007/0256861 A1 11/2007 Hulick
2007/0256863 A1 11/2007 Hulick
2008/0058674 A1 3/2008 Jansen et al.
2008/0156531 A1 7/2008 Boone et al.
2008/0173480 A1 7/2008 Pradeep et al.
2008/0275648 A1 11/2008 Illfelder
2008/0281525 A1 11/2008 Boone
2009/0078462 A1 3/2009 Boone
2009/0090555 A1 4/2009 Boone et al.
2009/0157367 A1 6/2009 Meyer et al.
2009/0159336 A1 6/2009 Boone
2009/0250264 A1 10/2009 Dupriest
2009/0288881 A1 11/2009 Mullins
2010/0271232 A1 * 10/2010 Clark ..... E21B 47/0228 340/853.2
2011/0088890 A1 4/2011 Clark
2013/0048383 A1 2/2013 Panchal et al.
2014/0151121 A1 6/2014 Boone et al.
2015/0317585 A1 11/2015 Panchal et al.
2018/0003026 A1 1/2018 Boone et al.

(56) References Cited

U.S. PATENT DOCUMENTS

| | | | | |
|---|---|---|---|---|
| 2019/0383962 | A1* | 12/2019 | Zhou | G01V 5/104 |
| 2021/0324724 | A1 | 10/2021 | Boone et al. | |
| 2021/0404313 | A1* | 12/2021 | Saidutta | E21B 41/00 |

FOREIGN PATENT DOCUMENTS

| | | |
|---|---|---|
| SU | 1668652 A1 | 8/1991 |
| WO | WO 1993/012318 | 6/1993 |
| WO | WO 2004/055325 | 7/2004 |
| WO | WO 2006/079847 | 8/2006 |
| WO | WO 2007/073430 | 6/2007 |
| WO | WO 2008/070829 | 12/2008 |
| WO | WO 2009/039448 | 3/2009 |
| WO | WO 2009/039453 | 3/2009 |

OTHER PUBLICATIONS

"Wildcat ADS Automated Drilling System," Product Brochure, National Qilwell Varco, Inc. (2006).

A. Boresi, Advanced Mechanics of Materials, (4th edition, 1985).

Adam T. Bourgoyne Jr., et al., Applied Drilling Engineering, vol. 2 (1986) (excerpts) (Part 1).

Adam T. Bourgoyne Jr., et al., Applied Drilling Engineering, vol. 2 (1986) (excerpts) (Part 2).

Adam T. Bourgoyne Jr., et al., Applied Drilling Engineering, vol. 2 (1986) (excerpts) (Part 3).

Answer to Plaintiff's Complaint; Case 6:09-cv-00414-LED; Doc 25; Nov. 6, 2009.

Bonner, et al., "Measurements at the Bit: A New Generation of MWD Tools," *Oilfield Review*, pp. 44-54, Apr./Jul. 1993.

Brett, et al., "Field Experiences with Computer-Controlled Drilling," *Society of Petroleum Engineers 20107*, presented at *Permian Basin Oil and Gas Recovery Conference*, Midland, TX (Mar. 8-9, 1990).

Brown, et al., "In-Time Data Delivery," *Oilfield Review*, 11(4): 34-55, http://www.slb.com/media/services/resources/oilfieldreview/ors99/win99/pages34_55.pdf (Winter 1999/2000).

C.A. Johancsik et al. SPE 11380 Torque and Drag in Directional Wells—Prediction and Measurement, Journal of Petroleum Technology (Jun. 1984).

Canrig Drilling Technology Ltd.'s Objections and Responses to Helmerick & Payne's First Set of Interrogatories, Civil Action No. 6:09-cv-00414, Aug. 23, 2010.

Canrig's Answers to Omron Oilfield and Marine, Inc.'s First Set of Interrogatories, Civil Action No. 6:09-cv-00414, May 7, 2010.

Charles C. Tappert, et al., "The State of the Art in On-Line Handwriting Recognition," IEEE Transactions on Pattern Analysis and Machine Intelligence, vol. 12, No. 8, pp. 787-808 (1990).

Defendant Helmerich & Payne's Invalidity Contentions; Case 6:09-cv-00414-LED; Mar. 25, 2010.

Defendant Omron Oilfield and Marine, Inc's Patent Rule 3-3 Disclosures; Case 6:09-cv-00414-LED; Mar. 25, 2010.

Defendant Omron Oilfield and Marine, Inc's Patent Rule 3-4 Disclosures; Case 6:09-cv-00414-LED; Mar. 25, 2010.

Defendant's Joint Preliminary Claim Construction and Extrinsic Evidence, Civil Action No. 6:09-cv-00414LED, Sep. 24, 2010.

Defendants' Answer and Counterclaims; Case NDTX-3-20-cv-03126; Document 19; Nov. 9, 2020.

Defendants' Answer to Plaintiffs First Amended Complaint and Defendants' First Amended Counterclaims; Case NDTX-3-20-cv-03126; Document 48; Dec. 14, 2020.

Defendants' Answer to Plaintiffs First Amended Complaint and Defendants' Second Amended Counterclaims; Case NDTX-3-20-cv-03126; Document 54; Jan. 8, 2021.

Defendants' Invalidity Contentions, *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix A1 (Haci), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix I (Obviousness References), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix A2 (Richarson), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix 0 (Obviousness References), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix C1 (Holbrook), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix C2 (King), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix G1 (Haci), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Chart Appendix G2 (Richarson), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Invalidity Contentions Claim Appendix Chart K (Obviousness References), *Nabors Drilling Techs. USA, Inc.* v. *Helmerich & Payne Int'l Drilling Co. et al.*, No. 3:20-cv-03126-M (served Mar. 24, 2021) (Lynn).

Defendants' Preliminary Election of Asserted Prior Art, *Nabors Drilling Techs. USA, Inc.* v. *Helmerich & Payne Int'l Drilling Co. et al.*, No. 3:20-cv-03126-M (served Jul. 8, 2021) (Lynn).

H&P's Responsive Claim Construction Brief, *Nabors Drilling Techs. USA, Inc.* v. *Helmerich & Payne Int'l Drilling Co. et al.*, No. 3:20-cv-03126-M, ECF No. 92 (Aug. 19, 2021) (Lynn).

Plaintiff Nabors Drilling Technologies USA, Inc.'s Reply Claim Construction Brief, *Nabors Drilling Techs. USA, Inc.* v. *Helmerich & Payne Int'l Drilling Co. et al.*, No. 3:20-cv-03126-M, ECF No. 92 (Aug. 19, 2021) (Lynn).

Patent Rule 4-5(d) Joint Claim Construction Chart, *Nabors Drilling Techs. USA, Inc.* v. *Helmerich & Payne Int'l Drilling Co. et al.*, No. 3:20-cv-03126-M, ECF No. 97 (Sep. 9, 2021) (Lynn).

Plaintiff Nabors Drilling Technologies USA, Inc.'s Patent Local Rule 4-1 Exchange of Proposed Terms and Claim Elements for Construction, *Nabors Drilling Techs. USA, Inc.* v. *Helmerich & Payne Int'l Drilling Co. et al.*, No. 3:20-CV-03126-M (N.D. Tex. Apr. 8, 2021) (Lynn).

Dupriest, et al., "Maximizing Drill Rates with Real-Time Surveillance of Mechanical Specific Energy," SPE/IADC Drilling Conference 92194, Amsterdam, The Netherlands, p. 1-10 (Feb. 23-25, 2005).

Dupriest, F., "Comprehensive Drill-Rate Management Process to Maximize Rate of Penetration," SPE Annual Technology Conference and Exhibition, San Antonio, Texas, SPE 102210, p. 1-9 (Sep. 24-27, 2006).

Dupriest, F., "Maximizing ROP with Real-Time Analysis of Digital Data and MSE," International Petroleum Technology Conference, Doha, Qatar, p. 1-8 (Nov. 21-23, 2005).

Excerpts from the Expert Declaration of Dr. John P. Rodgers on Patent Infringement After Defendants' Production of Source Code and Supplemental Preliminary Infringement Contentions, *Nabors Drilling Techs. USA, Inc.* v. *Helmerich & Payne Int'l Drilling Co.*, No. 3:20-CV-03126-M (N.D. Tex. Nov. 30, 2020).

Exhibits Filed with Plaintiffs Original Complaint; Case NDTX-3-20-cv-03126; Oct. 14, 2020.

(56) References Cited

OTHER PUBLICATIONS

Goldman, "Artificial Intelligence Applications Enhance Directional Control," *Petroleum Engineer International*, pp. 15-22, Feb. 1993.
Gurari, E., "CIS 680: Data Structures: Chapter 19: Backtracking Algorithms;" http://www.cse.ohio-state.edu/%7Egurari/course/cis680/cis680Ch19.html (1999).
H&P's Patent Rule 4-2 Disclosure, *Nabors Drilling Techs. USA, Inc.* v. *Helmerich & Payne Int'l Drilling Co. et al.*, No. 3:20-cv-03126-M, ECF. No. 73 (May 6, 2021) (Lynn).
Hartley, et al., "New Drilling Process Increases Rate of Penetration, Footage per Day," *Offshore*, 66(1): 1-5 (2006).
Helmerich & Payne, Inc.'s First Amended Answer and Counterclaims to Plaintiff's Original Complaint; Case 6:09-cv-00414-LED; Doc 55; Mar. 25, 2010.
Jackson, et al., "Portable Top Drive Cuts Horizontal Drilling Costs," *World Oil Magazine*, vol. 214 Issue 11, pp. 81-89, Nov. 1993.
Joint Claim Construction Statement, Civil Action No. 6:09-cv-00414LED, Oct. 25, 2010.
Leine, et al., "Stick-Slip Whirl Interaction in Drillstring Dynamics," *J. of Vibration and Acoustics*, 124: 209-220 (2002).
Luc Vincent, "Announcing Tesseract OCR", The official Google Code blog, Aug. 30, 2006, http://googlecode.blogspot.com/2006/08/announcing-tesseractocr. html, last accessed Mar. 29, 2021.
Maidla, et al., "Understanding Torque: The Key to Slide-Drilling Directional Wells," IADC/SPE Drilling Conference, IADC/SPE 87162 (2004).
Murch, "Application of Top Drive Drilling to Horizontal Wells," Society of Petroleum Engineers—SPE 37100, 1996.
Original Complaint, *Nabors Drilling Techs. USA, Inc.* v. *Helmerich & Payne Int'l Drilling Co.*, No. 3:20-CV-03126-M, (N.D. Tex. Oct. 14, 2020), ECF No. 1.
Patent Rule 4-3 Joint Claim Construction and Prehearing Statement, *Nabors Drilling Techs. USA, Inc.* v. *Helmerich & Payne Int'l Drilling Co. et al.*, No. 3:20-cv-03126-M, ECF. No. 78 (filed May 13, 2021) (Lynn).
Claim Construction Memorandum and Order, *Nabors Drilling Techs. USA, Inc.* v. *Helmerich & Payne Int'l Drilling Co. et al.*, No. 3:20-cv-03126-M, ECF. No. 126 (filed May 26, 2022) (Lynn).
Petition for Inter Partes Review of U.S. Pat. No. 7,823,655, IPR2021-00621.
Declaration of Vinod Sharma, P.E. in IPR2021-00621, U.S. Pat. No. 7,823,655.
Patent Owner's Preliminary Response to Petition, IPR2021-00621, U.S. Pat. No. 7,823,655.
Decision Denying Institution of Inter Partes Review, IPR2021-00621, U.S. Pat. No. 7,823,655.
Petition for Inter Partes Review of U.S. Pat. No. 8,360,171, IPR2021-00897.
Declaration of Vinod Sharma, P.E. in IPR2021-00897, U.S. Pat. No. 8,360,171.
Patent Owner's Preliminary Response to Petition, IPR2021-00897, U.S. Pat. No. 8,360,171.
Decision Denying Institution of Inter Partes Review, IPR2021-00897, U.S. Pat. No. 8,360,171.
Petition for Inter Partes Review of U.S. Pat. No. 7,860,593, IPR2021-00672.
Declaration of Vinod Sharma, P.E. in IPR2021-00672, U.S. Pat. No. 7,860,593.
Patent Owner's Preliminary Response to Petition, IPR2021-00672, U.S. Pat. No. 7,860,593.
Decision Granting Institution of Inter Partes Review, IPR2021-00672, U.S. Pat. No. 7,860,593.
Patent Owner's Response, IPR2021-00672, U.S. Pat. No. 7,860,593.
Declaration of Eduardo Gildin, Ph.D. Under 37 C.F.R. § 1.68 in Support of Patent Owner's Response, IPR2021-00672, U.S. Pat. No. 7,860,593.
Petitioners' Reply to Patent Owner's Response, IPR2021-00672, U.S. Pat. No. 7,860,593.
Richard C. Dorf et al., "Modem Control Systems," Prentice Hall, 2005.
Petroleum Extension Service, "Controlled Directional Drilling," N. Janicek (ed.), Third Edition, pp. 18-33 and 44-45, 1984.
Plaintiff Nabors Drilling Technologies USA, Inc.'s Local Patent Rule 3-1(a)(3) Preliminary Infringement Contentions Claim Chart for U.S. Pat. No. 7,823,655, *Nabors Drilling Techs. USA, Inc.* v. *Helmerich & Payne Int'l Drilling Co.*, No. 3:20-CV-03126-M (N.D. Tex. Nov. 30, 2020), ECF No. 37, Ex. 2.
Plaintiff Nabors Drilling Technologies USA, Inc.'s Local Patent Rule 3-1(a)(3) Preliminary Infringement Contentions Claim Chart for U.S. Pat. No. 8,510,081, *Nabors Drilling Techs. USA, Inc.* v. *Helmerich & Payne Int'l Drilling Co.*, No. 3:20-CV-03126-M (N.D. Tex. Nov. 30, 2020), ECF No. 37, Ex. 3.
Plaintiff Nabors Drilling Technologies USA, Inc.'s Local Patent Rule 3-1(a)(3) Preliminary Infringement Contentions Claim Chart for U.S. Pat. No. 8,360,171 B2, *Nabors Drilling Techs. USA, Inc.* v. *Helmerich & Payne Int'l Drilling Co.*, No. 3:20-CV-03126-M (N.D. Tex. Nov. 30, 2020), ECF No. 37, Ex. 5.
Plaintiff Nabors Drilling Technologies USA, Inc.'s Opening Claim Construction Brief, *Nabors Drilling Techs. USA, Inc.* v. *Helmerich & Payne Int'l Drilling Co. et al.*, No. 3:20-cv-03126-M, ECF No. 88 (Jul. 22, 2021) (Lynn).
Plaintiff Nabors Drilling Technologies USA, Inc.'s Preliminary Election of Asserted Claims, *Nabors Drilling Techs. USA, Inc.* v. *Helmerich & Payne Int'l Drilling Co. et al.*, No. 3:20-cv-03126-M (served Jun. 24, 2021) (Lynn).
Plaintiff's First Amended Complaint, *Nabors Drilling Techs. USA, Inc.* v. *Helmerich & Payne Int'l Drilling Co.*, No. 3:20-CV-03126-M (N.D. Tex. Nov. 30, 2020), ECF No. 37.
Plaintiff's Original Complaint; Case 6:09-cv-00414; Doc. 1; Sep. 16, 2009.
Plaintiffs Answer to Defendants' Counterclaims; Case NDTX-3-20-CV-03126; Document 38; Nov. 30, 2020.
Plaintiffs Answer to Defendants' Counterclaims; Case NDTX-3-20-cv-03126; Document 59; Jan. 29, 2021.
Plaintiffs Original Complaint; Case NDTX-3-20-cv-03126; Document 1; Oct. 14, 2020.
Remson, D., "Planning Technique—Key to Drilling Efficiency," Journal of Petroleum Technology, 37 (09); 1613-1621 (Sep. 1985).
Robert F. Mitchell, Larry W. Lake, Petroleum Engineering Handbook, vol. 2 (2006) (excerpts) (Part 1).
Robert F. Mitchell, Larry W. Lake, Petroleum Engineering Handbook, vol. 2 (2006) (excerpts) (Part 2).
Russel A. Kirsch, "*SEAC and the Start of Image Processing at the National Bureau of Standards:. Earliest Image Processing*," https://web.archive.org/web/20070209144457/http://museum.nist.gov/panels/seac/EARLIEST.HTM, archived Feb. 9, 2007, last accessed Mar. 29, 2021.
S. Menand et al. SPE 98965 Advancements in 3D Drillstring Mechanics: From the Bit to the Topdrive, IADC/SPE Drilling Conference, Feb. 21-23, 2006.
Schlumberger Oilfield Glossary, "Topdrive" https://web.archive.org/web/20061023231411/http://www.glossary.oilfield.slb.com/Display.cfm?Term=topdrive (Last Accessed Feb. 7, 2021).
Second Amended Patent Scheduling Order, *Nabors Drilling Techs. USA, Inc.* v. *Helmerich & Payne Int'l Drilling Co. et al.*, No. 3:20-cv-03126-M, ECF. No. 73 (Apr. 23, 2021) (Lynn).
Stephen V. Rice et al., Optical Character Recognition: An Illustrated Guide to the Frontier (1999) (excerpts).
T.A. Inglis, Directional Drilling, Petroleum Engineering and Development Studies, vol. 2 (1987).
Tesseract OCR Download, p. 2, https://sourceforge.net/projects/tesseract-ocr/, archived from Feb. 8, 2006, last accessed Mar. 29, 2021.
The International Searching Authority, "Written Opinion of the International Searching Authority," PCT/US2007/86768, dated Jun. 11, 2008.
The International Searching Authority, "Written Opinion of the International Searching Authority," PCT/US2010/024105, dated Sep. 14, 2010.
Yann LeCun et al., "Gradient-Based Learning Applied to Document Recognition", Proc. of the IEEE (1998).
Young, Jr., "Computerized Drilling Control," *Journal of Petroleum Technology*, 21(4): 483-96 (1969).

(56) References Cited

OTHER PUBLICATIONS

U.S. Pat. No. 7,823,655 to Boone et al. (the "'655 Patent").
Prosecution File History for the '655 Patent.
Declaration of Vinod Sharma, P.E.
Proof of Service of Complaint, *Nabors Drilling Techs. USA, Inc*. v. *Helmerich & Payne Int'l. Drilling Co*., No. 3:20-CV-03126-M (N.D. Tex. Oct. 20, 2020), ECF Nos. 11-13.
U.S. Pat. No. 7,096,979 to Haci et al. ("Haci").
U.S. Pat. No. 6,050,348 to Richarson et al. ("Richarson").
U.S. Patent Publication No. 2004/0168827 by Jeffryes ("Jeffiyes").
Claim Listing.
Transcript of Rule 16 Conference, *Nabors Drilling Techs. USA, Inc*. v. *Helmerich & Payne Int'l. Drilling Co*., No. 3:20-CV-03126-M (N.D. Tex. Dec. 2, 2020).
Amended Patent Scheduling Order, *Nabors Drilling Techs. USA, Inc*. v. *Helmerich & Payne Int'l. Drilling Co*., No. 3:20-CV-03126-M (N.D. Tex, Feb. 15, 2021), ECF No. 62.

* cited by examiner

METHOD AND APPARATUS FOR AUTOMATICALLY MODIFYING A DRILLING PATH IN RESPONSE TO A REVERSAL OF A PREDICTED TREND

CROSS-REFERENCE TO RELATED APPLICATIONS

This application is a continuation of U.S. patent application Ser. No. 17/360,799, filed Jun. 28, 2021, now U.S. Patent Publication No. 2021/0324724, published Oct. 21, 2021, which is a continuation of U.S. patent application Ser. No. 15/705,393, filed Sep. 15, 2017, now U.S. Patent Publication No. 2018/0003026, published Jan. 4, 2018, which is a continuation of U.S. patent application Ser. No. 14/174,522, filed Feb. 6, 2014, now U.S. Pat. No. 9,784,089, issued Sep. 10, 2017, which is a continuation of U.S. patent application Ser. No. 12/234,584, filed Sep. 19, 2008, now U.S. Pat. No. 8,672,055, which is a (1) a continuation-in-part of U.S. patent application Ser. No. 11/859,378, filed Sep. 21, 2007, now U.S. Pat. No. 7,823,655, issued Nov. 2, 2010; (2) a continuation-in-part of U.S. patent application Ser. No. 11/952,511, filed Dec. 7, 2007, now U.S. Pat. No. 7,938,197, issued May 10, 2011, which is a continuation-in-part of Ser. No. 11/859,378, filed Sep. 21, 2007, now U.S. Pat. No. 7,823,655, issued Nov. 2, 2010 and which claims the benefit of (i) U.S. Provisional Patent Application No. 60/869,047, filed Dec. 7, 2006, and (ii) U.S. Provisional Application No. 60/985,869, filed Nov. 6, 2007, (3) a continuation-in-part of U.S. patent application Ser. No. 11/847,048, filed Aug. 29, 2007, now U.S. Pat. No. 9,410,418; (4) a continuation-in-part of U.S. patent application Ser. No. 11/668,388, filed Jan. 29, 2007, now U.S. Pat. No. 8,215,417, issued Jul. 10, 2012, which claims the benefit of U.S. Provisional Application No. 60/886,259, filed Jan. 23, 2007, and (5) a continuation-in-part of U.S. patent application Ser. No. 11/747,110, filed May 10, 2007, now U.S. Pat. No. 7,860,593, issued Dec. 28, 2010; and (6) which claims the benefit of: U.S. Provisional Patent Application No. 60/985,869, filed Nov. 6, 2007, U.S. Provisional Patent Application No. 61/016,093, filed Dec. 21, 2007, and U.S. Provisional Patent Application No. 61/026,323, filed Feb. 5, 2008. The disclosure of each of the foregoing patent applications is hereby incorporated herein in its entirety by express reference thereto.

BACKGROUND

At the outset of a drilling operation, drillers typically establish a drilling plan that includes a target location and a drilling path to the target location. Once drilling commences, the bottom hole assembly is directed or "steered" from a vertical drilling path in any number of directions, to follow the proposed drilling plan. For example, to recover an underground hydrocarbon deposit, a drilling plan might include a vertical well to a point above the reservoir, then a directional or horizontal well that penetrates the deposit. The operator may then steer the drill through both the vertical and horizontal aspects in accordance with the plan.

In some embodiments, such directional drilling requires accurate orientation of a bent segment of the downhole motor that drives the bit. In such embodiments, rotating the drill string changes the orientation of the bent segment and the toolface. To effectively steer the assembly, the operator must first determine the current toolface orientation, such as via a measurement-while-drilling (MWD) apparatus. Thereafter, if the drilling direction needs adjustment, the operator must rotate the drill string to change the toolface orientation.

In other embodiments, such as rotary steerable systems, the operator still must determine the current toolface orientation.

During drilling, a "survey" identifying locational and directional data of a BHA in a well is obtained at various intervals or other times. Each survey yields a measurement of the inclination and azimuth (or compass heading) of a location in a well (typically the total depth at the time of measurement). In directional wellbores, particularly, the position of the wellbore must be known with reasonable accuracy to ensure the correct wellbore path. The measurements themselves include inclination from vertical and the azimuth of the wellbore. In addition to the toolface data, and inclination, and azimuth, the data obtained during each survey may also include hole depth data, pipe rotational data, hook load data, delta pressure data (across the downhole drilling motor), and modeled dogleg data, for example.

These measurements may be made at discrete points in the well, and the approximate path of the wellbore may be computed from these discrete points. Conventionally, a standard survey is conducted at each drill pipe connection to obtain an accurate measurement of inclination and azimuth for the new survey position. However, if directional drilling operations call for one or more transitions between sliding and rotating within the span of a single drill pipe joint or connection, the driller cannot rely on the most recent survey to accurately assess the progress or effectiveness of the operation. For example, the driller cannot utilize the most recent survey data to assess the effectiveness or accuracy of a "slide" that is initiated after the survey was obtained. The conventional use of surveys does not provide the directional driller with any feedback on the progress or effectiveness of operations that are performed after the most recent survey measurements are obtained.

When deviation from the planned drilling path occurs, drillers must consider the factors available to them to try to direct the drill back to the original path. This typically requires the operator to manipulate the drawworks brake, and rotate the rotary table or top drive quill to find the precise combinations of hook load, mud motor differential pressure, and drill string torque, to properly position the toolface. This can be difficult, time consuming, and complex. Each adjustment has different effects on the toolface orientation, and each must be considered in combination with other drilling requirements to drill the hole. Thus, reorienting the toolface in a bore is very complex, labor intensive, and often inaccurate. A more efficient, reliable method for steering a BHA is needed.

SUMMARY OF THE INVENTION

In one exemplary aspect, the present disclosure is directed to a method of drilling to a target location. The method includes receiving an input comprising a planned drilling path to a target location and determining a projected location of a bottom hole assembly of a drilling system. The projected location of the bottom hole assembly is compared to the planned drilling path, and a modified drilling path to the target location is created. Drilling rig control signals, typically at the surface of the well, are generated that steer the bottom hole assembly of the drilling system to the target location along the modified drilling path.

In one aspect, creating a modified drilling path to the target location includes calculating curves from the projected location of the bottom hole assembly that intersect the planned drilling path. In another aspect, creating a modified drilling path to the target location includes calculating a new planned drilling path that does not intersect the planned drilling path and that is directed from the projected location of the bottom hole assembly to the target location, the method further including again determining a projected location of a bottom hole assembly of the drilling system. The projected location of the bottom hole assembly is compared to the new modified drilling path and a second modified drilling path to the target location is created. One or more drilling rig control signals are automatically and electronically generated at the well surface that steer the bottom hole assembly of the drilling system along the second modified drilling path to the target location.

In one aspect, determining a projected location of the bottom hole assembly includes determining a projected location of a bit of the bottom hole assembly, and determining a projected location of the bit includes considering data from one or more survey results.

In one aspect, creating a modified drilling path based upon whether the amount of deviation from the planned path exceeds a threshold includes creating a modified drilling path that intersects the planned drilling path if the amount of deviation from the planned path exceeds a first threshold amount of deviation, and creating a modified drilling path that does not intersect the planned drilling path if the amount of deviation from the planned path exceeds a second threshold amount of deviation. The method may include receiving a user-initiated input indicating whether to create a new planned path to the target that does not intersect the planned drilling path when the bottom hole assembly exceeds the second threshold amount of deviation from the planned path.

In one aspect, the planned drilling path includes a tolerance zone and creating the modified drilling path occurs when the projected location of the bottom hole assembly intersects the tolerance zone boundary and does not occur when the projected location of the bottom hole assembly is within the tolerance zone. In another aspect, the method includes calculating a toolface inclination value and a measured depth required to steer the bottom hole assembly to the target location.

In one aspect, creating a modified drilling path to the target location includes calculating a first 3D curve, calculating a hold section, and optionally calculating a second 3D curve. The first and optional second 3D curves may be a portion of the modified drilling path. The optional second 3D curve may merge the modified path with the original planned drilling path at a location prior to the target location. In a preferred embodiment herein, all curve calculations are achieved electronically, such as with a computer or other suitable logic device as described herein.

In one aspect, the method includes defining a tolerance zone, an intervention zone, and a correction zone about the planned drilling path. Comparing the projected location of the bottom hole assembly to the planned drilling path includes determining which zone contains the determined projection of the bottom hole assembly. After creating a modified drilling path to the target location, defining a new tolerance zone, a new intervention zone, and a new correction zone about the modified drilling path.

In one aspect, determining a projected location of a bottom hole assembly includes using a real-time survey projection as a directional trend. The real-time projection is performed using a method comprising at least one of: a minimum curvature arc, direction trends, and a straight line. The real-time projection may include a toolface orientation input.

In one aspect, the method includes creating a modified drilling path to the target location includes calculating a first 3D curve, a hold section, and an optional second 3D curve that directs the bottom hole assembly along the planned drilling path. The first and optional second 3D curves may be calculated, preferably electronically, by calculating any curves required to intersect the planned drilling path at the target location, calculating any curves required to intersect the planned drilling path at a first location before the target location. Each curve may have an acceptable rate of curvature for the BHA. The curves may be further calculated, preferably electronically, by calculating any curves required to intersect the planned drilling path at a second location before the first location, the curves each having an acceptable rate of curvature, the first and second location being separated by a selected measurement distance, and selecting the calculated curves to intersect the planned path at the first location before reaching the target location.

In another exemplary aspect, the present disclosure is directed to a system for drilling to a target location. The system includes a receiving device adapted to receive an input comprising a planned drilling path to a target location, a sensory device adapted to determine a projected location of a bottom hole assembly of a drilling system, and a logic device adapted to compare the projected location of the bottom hole assembly to the planned drilling path to determine a deviation amount from the planned path. The second logic device is adapted to create a modified drilling path to the target location as selected based on the amount of deviation from the planned drilling path. A drilling rig control signal generator is adapted to automatically and electronically generate one or more drilling rig control signals at the surface of the well that steer the bottom hole assembly of the drilling system to the target location along the modified drilling path.

In one aspect, the system includes a drawworks drive, a top drive, and a mudpump. The control signal generator transmits the one or more signals to control the drawworks, the top drive, and the mudpump to change a direction of the bottom hole assembly as drilling proceeds. In one aspect, the second logic device creates a modified drilling path based upon whether the amount of deviation from the planned path exceeds a threshold. It includes means for creating a modified drilling path that intersects the planned drilling path if the amount of deviation from the planned path exceeds a first threshold amount of deviation from the planned path and means for creating a modified drilling path that does not intersect the planned drilling path if the amount of deviation from the planned path exceeds a second threshold amount of deviation from the planned path.

In another exemplary aspect, the present disclosure is directed to a method of directionally steering a bottom hole assembly during a drilling operation from a drilling rig to an underground target location. The method includes the steps of: generating a drilling plan having a drilling path and an acceptable margin of error as a tolerance zone; receiving data indicative of one or more directional trends and a projection to bit depth; determining the actual location of the bottom hole assembly based on the one or more directional trends and the projection to bit depth; and determining whether the bit is within the tolerance zone. The method also includes comparing the actual location of the bottom hole assembly to the planned drilling path to identify an amount of deviation from the planned path of the bottom hole assembly from the actual drilling path and creating a modified drilling path based on the amount of deviation from the planned path. This includes creating a modified drilling path that intersects the planned drilling path if the amount of deviation from the planned path exceeds a first threshold amount of deviation from the planned path, and creating a modified drilling path to the target location that does not intersect the planned drilling path if the amount of deviation from the planned path exceeds a second threshold amount of deviation from the planned path. The method further includes determining a desired tool face orientation to steer the bottom hole assembly along the modified drilling path; automatically and electronically generating one or more drilling rig control signals at the well surface at a directional steering controller; and outputting the one or more drilling rig control signals to a drawworks and a top drive to steer the bottom hole assembly along the modified drilling path.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
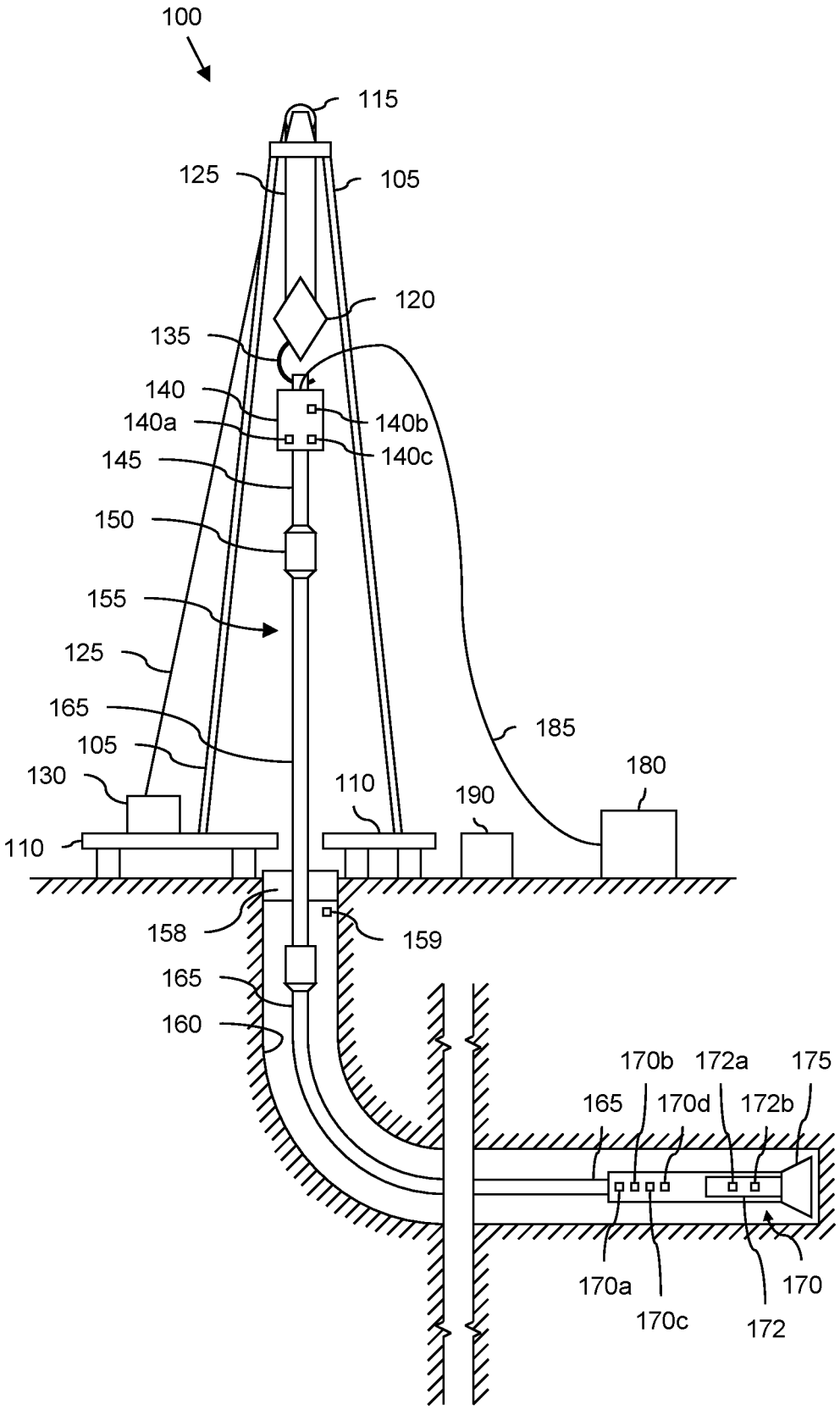
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems and methods disclosed herein provide increased control of BHAs, resulting in increased BHA responsiveness and faster BHA operations compared to conventional systems that require significantly more manual input or pauses to provide for input. The invention can advantageously achieve this through the use of data feedback and location detection, processing received data, and optimizing a drilling path based on the projected actual bit location. Prior to drilling, a target location is typically identified and an optimal wellbore profile or planned path is established. Such proposed drilling paths are generally based upon the most efficient or effective path to the target location or locations. As drilling proceeds, the BHA might begin to deviate from the optimal pre-planned drilling path for one or more of a variety of factors. The systems and methods disclosed herein are adapted to detect the deviation from the planned path and generate corrections to return the BHA to the drilling path or if more effective, generate an alternative drilling path to the target location, each preferably in the most efficient manner possible while preferably avoiding over-correction.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary embodiment, the controller 190 includes one or more systems located in a control room proximate the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission means which, for the sake of clarity, are not depicted in FIG. 1.

The controller 190 is also configured to receive electronic signals via wired or wireless transmission means (also not shown in FIG. 1) from a variety of sensors included in the apparatus 100, where each sensor is configured to detect an operational characteristic or parameter. One such sensor is the surface casing annular pressure sensor 159 described above. The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure. These measurements may include both static annular pressure (pumps off) and active annular pressure (pumps on).

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured for detecting shock and/or vibration in the BHA 170. The apparatus 100 may additionally or alternatively include a mud motor delta pressure ($\Delta P$) sensor 172*a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the controller 190 that is indicative of the torque applied to the bit 175 by the one or more motors 172**.

The apparatus 100 may additionally or alternatively include a toolface sensor **170*c* configured to detect the current toolface orientation. The toolface sensor 170*c* may be or include a conventional or future-developed magnetic toolface sensor which detects toolface orientation relative to magnetic north or true north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170**.

The apparatus 100 may additionally or alternatively include a torque sensor **140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145**.

The top drive 140, draw works 130, crown or traveling block, drilling line or dead line anchor may additionally or alternatively include or otherwise be associated with a WOB sensor 140*c* (WOB calculated from a hook load sensor that can be based on active and static hook load) (e.g., one or more sensors installed somewhere in the load path mechanisms to detect and calculate WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Figure 2A:
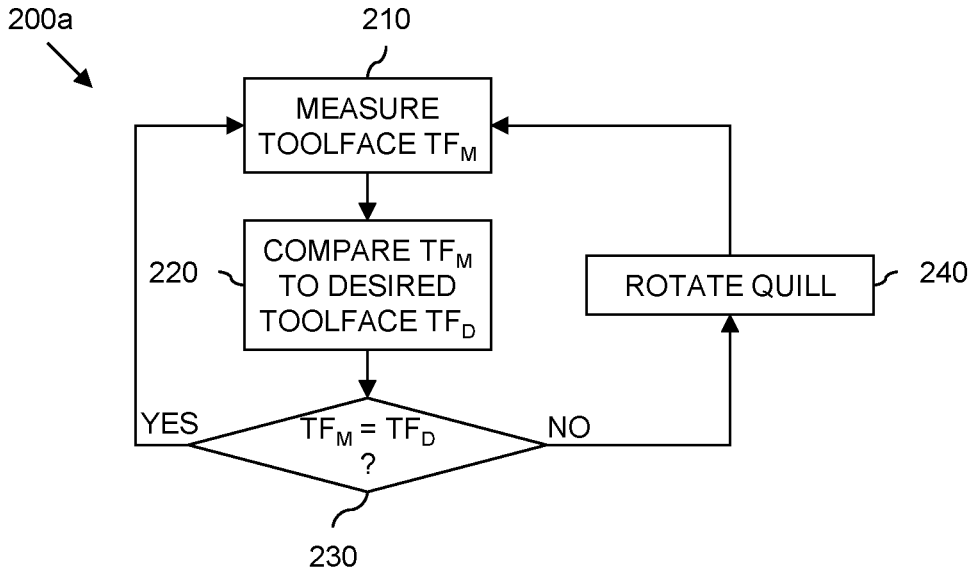
FIGS. 2A and 2B are flow-chart diagrams of methods according to one or more aspects of the present disclosure.

Referring to FIG. 2A, illustrated is a flow-chart diagram of a method 200*a* of manipulating a toolface orientation to a desired orientation according to one or more aspects of the present disclosure. The method 200*a* may be performed in association with one or more components of the apparatus 100 shown in FIG. 1 during operation of the apparatus 100. For example, the method 200*a* may be performed for toolface orientation during drilling operations performed via the apparatus 100.

The method 200*a* includes a step 210 during which the current toolface orientation $TF_M$ is measured. The $TF_M$ may be measured using a conventional or future-developed magnetic toolface sensor which detects toolface orientation relative to magnetic north or true north. Alternatively, or additionally, the $TF_M$ may be measured using a conventional or future-developed gravity toolface sensor which detects toolface orientation relative to the Earth's gravitational field. In an exemplary embodiment, the $TF_M$ may be measured using a magnetic toolface sensor when the end of the wellbore is less than about 7° from vertical, and subsequently measured using a gravity toolface sensor when the end of the wellbore is greater than about 7° from vertical. However, gyros and/or other means for determining the $TF_M$ are also within the scope of the present disclosure.

In a subsequent step 220, the $TF_M$ is compared to a desired toolface orientation $TF_D$. If the $TF_M$ is sufficiently equal to the $TF_D$, as determined during decisional step 230, the method 200*a* is iterated and the step 210 is repeated. "Sufficiently equal" may mean substantially equal, such as varying by no more than a few percentage points, or may alternatively mean varying by no more than a predetermined angle, such as about 5°. Moreover, the iteration of the method 200*a* may be substantially immediate, or there may be a delay period before the method 200*a* is iterated and the step 210 is repeated.

If the $TF_M$ is not sufficiently equal to the $TF_D$, as determined during decisional step 230, the method 200*a* continues to a step 240 during which the quill is rotated by the drive system by, for example, an amount about equal to the difference between the $TF_M$ and the $TF_D$. However, other amounts of rotational adjustment performed during the step 240 are also within the scope of the present disclosure. After step 240 is performed, the method 200*a* is iterated and the step 210 is repeated. Such iteration may be substantially immediate, or there may be a delay period before the method 200*a* is iterated and the step 210 is repeated.

Figure 2B:
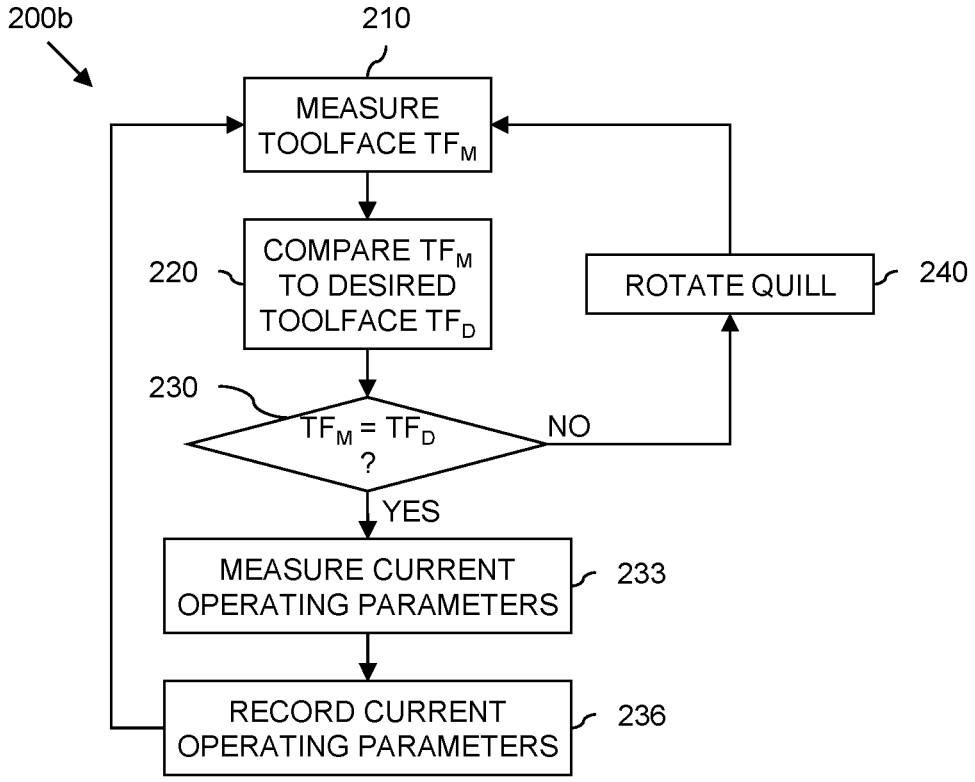

Referring to FIG. 2B, illustrated is a flow-chart diagram of another embodiment of the method 200*a* shown in FIG. 2A, herein designated by reference numeral 200*b*. The method 200*b* includes an information gathering step when the toolface orientation is in the desired orientation and may be performed in association with one or more components of the apparatus 100 shown in FIG. 1 during operation of the apparatus 100. For example, the method 200*b* may be performed for toolface orientation during drilling operations performed via the apparatus 100.

The method 200*b* includes steps 210, 220, 230 and 240 described above with respect to method 200*a* and shown in FIG. 2A. However, the method 200*b* also includes a step 233 during which current operating parameters are measured if the $TF_M$ is sufficiently equal to the $TF_D$, as determined during decisional step 230. Alternatively, or additionally, the current operating parameters may be measured at periodic or scheduled time intervals, or upon the occurrence of other events. The method 200*b* also includes a step 236 during which the operating parameters measured in the step 233 are recorded. The operating parameters recorded during the step 236 may be employed in future calculations of the amount of quill rotation performed during the step 240, such as may be determined by one or more intelligent adaptive controllers, programmable logic controllers, artificial neural networks, and/or other adaptive and/or "learning" controllers or processing apparatus.

Each of the steps of the methods 200*a* and 200*b* may be performed automatically. For example, the controller 190 of FIG. 1 may be configured to automatically perform the toolface comparison of step 230, whether periodically, at random intervals, or otherwise. The controller 190 may also be configured to automatically generate and transmit control signals directing the quill rotation of step 240, such as in response to the toolface comparison performed during steps 220 and 230.

Figure 3:
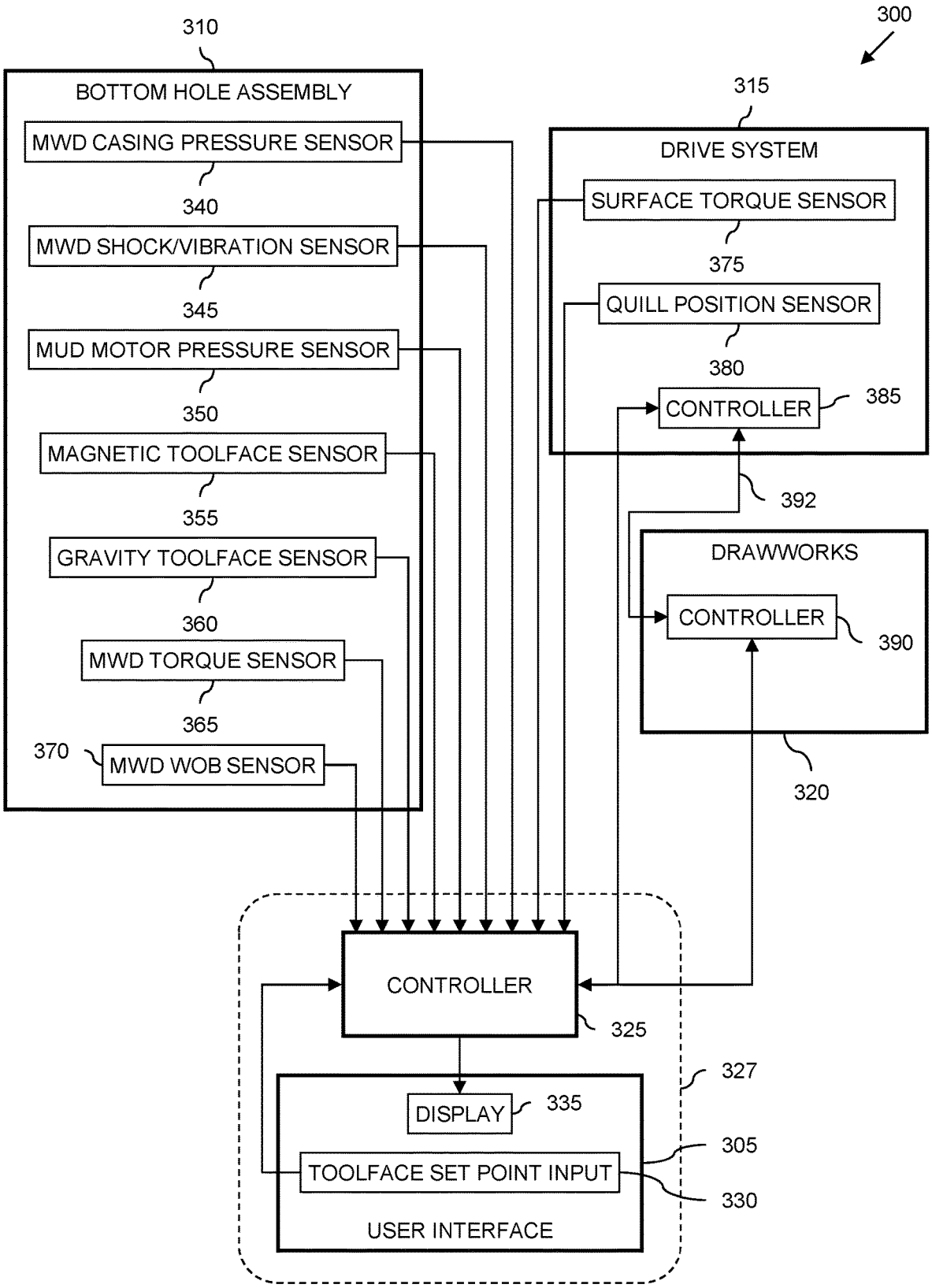
FIG. 3 is a schematic diagram of an apparatus according to one or more aspects of the present disclosure.

Referring to FIG. 3, illustrated is a block diagram of an apparatus 300 according to one or more aspects of the present disclosure. The apparatus 300 includes a user interface 305, a BHA 310, a drive system 315, a drawworks 320, and a controller 325. The apparatus 300 may be implemented within the environment and/or apparatus shown in FIG. 1. For example, the BHA 310 may be substantially similar to the BHA 170 shown in FIG. 1, the drive system 315 may be substantially similar to the top drive 140 shown in FIG. 1, the drawworks 320 may be substantially similar to the drawworks 130 shown in FIG. 1, and/or the controller 325 may be substantially similar to the controller 190 shown in FIG. 1. The apparatus 300 may also be utilized in performing the method 200*a* shown in FIG. 2A and/or the method 200*b* shown in FIG. 2B, among other methods described herein or otherwise within the scope of the present disclosure.

The user-interface 305 and the controller 325 may be discrete components that are interconnected via wired or wireless means. Alternatively, the user-interface 305 and the controller 325 may be integral components of a single system or controller 327, as indicated by the dashed lines in FIG. 3.

The user-interface 305 includes means 330 for user-input of one or more toolface set points, and may also include means for user-input of other set points, limits, and other input data. The data input means 330 may include a keypad, voice-recognition apparatus, dial, button, switch, slide selector, toggle, joystick, mouse, data base and/or other conventional or future-developed data input device. Such data input means may support data input from local and/or remote locations. Alternatively, or additionally, the data input means 330 may include means for user-selection of predetermined toolface set point values or ranges, such as via one or more drop-down menus. The toolface set point data may also or alternatively be selected by the controller 325 via the execution of one or more database look-up procedures. In general, the data input means 330 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 305 may also include a display 335 for visually presenting information to the user in textual, graphic, or video form. The display 335 may also be utilized by the user to input the toolface set point data in conjunction with the data input means 330. For example, the toolface set point data input means 330 may be integral to or otherwise communicably coupled with the display 335.

The BHA 310 may include an MWD casing pressure sensor 340 that is configured to detect an annular pressure value or range at or near the MWD portion of the BHA 310, and that may be substantially similar to the pressure sensor 170*a* shown in FIG. 1. The casing pressure data detected via the MWD casing pressure sensor 340 may be sent via electronic signal to the controller 325 via wired or wireless transmission.

The BHA 310 may also include an MWD shock/vibration sensor 345 that is configured to detect shock and/or vibration in the MWD portion of the BHA 310, and that may be substantially similar to the shock/vibration sensor 170*b* shown in FIG. 1. The shock/vibration data detected via the MWD shock/vibration sensor 345 may be sent via electronic signal to the controller 325 via wired or wireless transmission.

The BHA 310 may also include a mud motor ΔP sensor 350 that is configured to detect a pressure differential value or range across the mud motor of the BHA 310, and that may be substantially similar to the mud motor ΔP sensor 172*a* shown in FIG. 1. The pressure differential data detected via the mud motor ΔP sensor 350 may be sent via electronic signal to the controller 325 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 310 may also include a magnetic toolface sensor 355 and a gravity toolface sensor 360 that are cooperatively configured to detect the current toolface, and that collectively may be substantially similar to the toolface sensor 170*c* shown in FIG. 1. The magnetic toolface sensor 355 may be or include a conventional or future-developed magnetic toolface sensor which detects toolface orientation relative to magnetic north or true north. The gravity toolface sensor 360 may be or include a conventional or future-developed gravity toolface sensor which detects toolface orientation relative to the Earth's gravitational field. In an exemplary embodiment, the magnetic toolface sensor 355 may detect the current toolface when the end of the wellbore is less than about 7° from vertical, and the gravity toolface sensor 360 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., sensors 355 and/or 360) may be sent via electronic signal to the controller 325 via wired or wireless transmission.

The BHA 310 may also include an MWD torque sensor 365 that is configured to detect a value or range of values for torque applied to the bit by the motor(s) of the BHA 310, and that may be substantially similar to the torque sensor 172*b* shown in FIG. 1. The torque data detected via the MWD torque sensor 365 may be sent via electronic signal to the controller 325 via wired or wireless transmission.

The BHA 310 may also include an MWD WOB sensor 370 that is configured to detect a value or range of values for WOB at or near the BHA 310, and that may be substantially similar to the WOB sensor 170*d* shown in FIG. 1. The WOB data detected via the MWD WOB sensor 370 may be sent via electronic signal to the controller 325 via wired or wireless transmission.

The drawworks 320 includes a controller 390 and/or other means for controlling feed-out and/or feed-in of a drilling line (such as the drilling line 125 shown in FIG. 1). Such control may include rotational control of the drawworks (in v. out) to control the height or position of the hook, and may also include control of the rate the hook ascends or descends. However, exemplary embodiments within the scope of the present disclosure include those in which the drawworks drill string feed off system may alternatively be a hydraulic ram or rack and pinion type hoisting system rig, where the movement of the drill string up and down is via something other than a drawworks. The drill string may also take the form of coiled tubing, in which case the movement of the drill string in and out of the hole is controlled by an injector head which grips and pushes/pulls the tubing in/out of the hole. Nonetheless, such embodiments may still include a version of the controller 390, and the controller 390 may still be configured to control feed-out and/or feed-in of the drill string.

The drive system 315 includes a surface torque sensor 375 that is configured to detect a value or range of the reactive torsion of the quill or drill string, much the same as the torque sensor 140*a* shown in FIG. 1. The drive system 315 also includes a quill position sensor 380 that is configured to detect a value or range of the rotational position of the quill, such as relative to true north or another stationary reference. The surface torsion and quill position data detected via sensors 375 and 380, respectively, may be sent via electronic signal to the controller 325 via wired or wireless transmission. The drive system 315 also includes a controller 385 and/or other means for controlling the rotational position, speed and direction of the quill or other drill string component coupled to the drive system 315 (such as the quill 145 shown in FIG. 1).

In an exemplary embodiment, the drive system 315, controller 385, and/or other component of the apparatus 300 may include means for accounting for friction between the drill string and the wellbore. For example, such friction accounting means may be configured to detect the occurrence and/or severity of the friction, which may then be subtracted from the actual "reactive" torque, perhaps by the controller 385 and/or another control component of the apparatus 300.

The controller 325 is configured to receive one or more of the above-described parameters from the user interface 305, the BHA 310, and/or the drive system 315, and utilize such parameters to continuously, periodically, or otherwise determine the current toolface orientation. The controller 325 may be further configured to generate a control signal, such as via intelligent adaptive control, and provide the control signal to the drive system 315 and/or the drawworks 320 to adjust and/or maintain the toolface orientation. For example, the controller 325 may execute the method 202 shown in FIG. 2B to provide one or more signals to the drive system 315 and/or the drawworks 320 to increase or decrease WOB and/or quill position, such as may be required to accurately "steer" the drilling operation.

Moreover, as in the exemplary embodiment depicted in FIG. 3, the controller 385 of the drive system 315 and/or the controller 390 of the drawworks 320 may be configured to generate and transmit a signal to the controller 325. Consequently, the controller 385 of the drive system 315 may be configured to influence the control of the BHA 310 and/or the drawworks 320 to assist in obtaining and/or maintaining a desired toolface orientation. Similarly, the controller 390 of the drawworks 320 may be configured to influence the control of the BHA 310 and/or the drive system 315 to assist in obtaining and/or maintaining a desired toolface orientation. Alternatively, or additionally, the controller 385 of the drive system 315 and the controller 390 of the drawworks 320 may be configured to communicate directly, such as indicated by the dual-directional arrow 392 depicted in FIG. 3. Consequently, the controller 385 of the drive system 315 and the controller 390 of the drawworks 320 may be configured to cooperate in obtaining and/or maintaining a desired toolface orientation. Such cooperation may be independent of control provided to or from the controller 325 and/or the BHA 310.

Figure 4A:
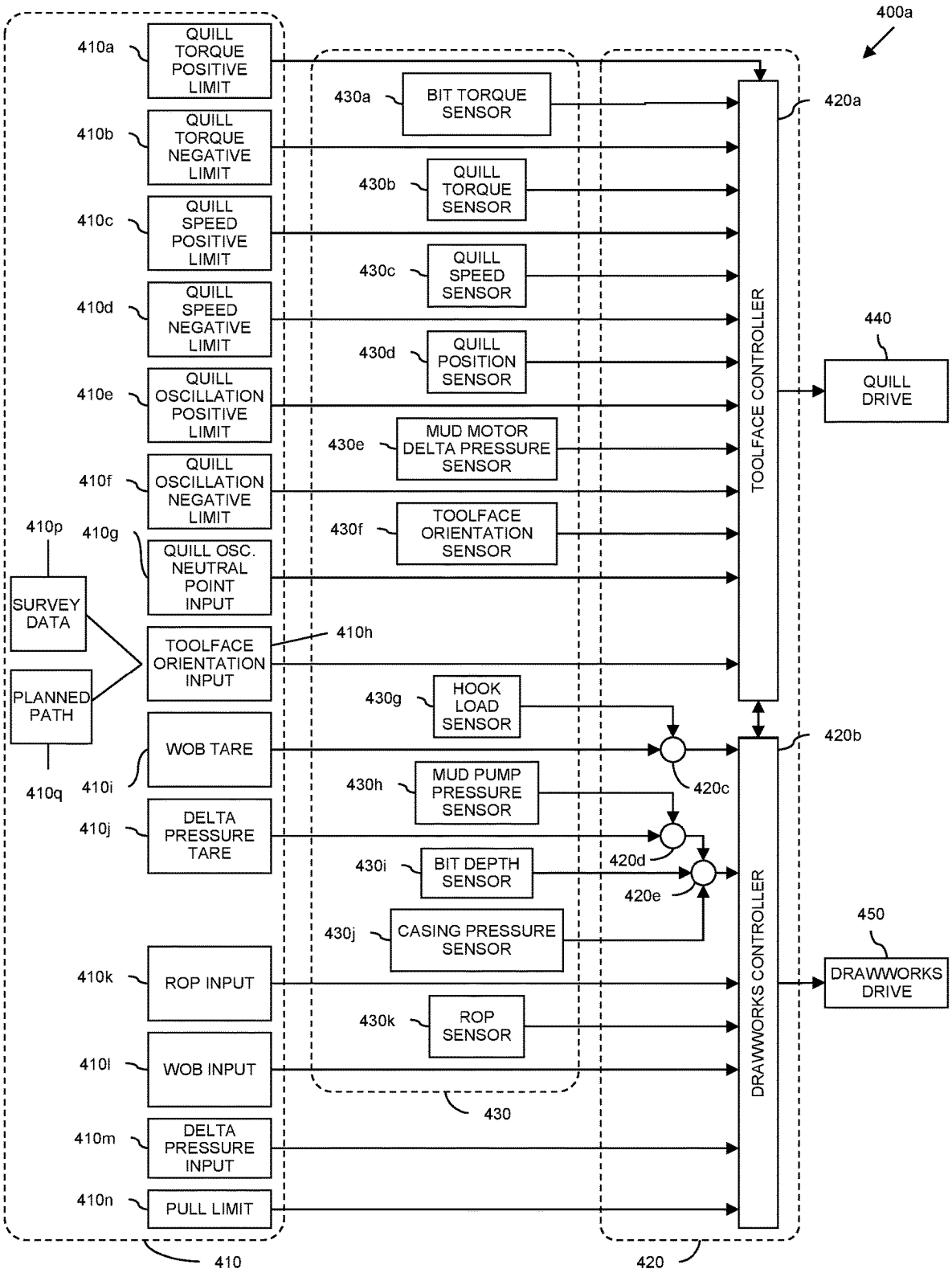
FIGS. 4A-4C are schematic diagrams of apparatuses accordingly to one or more aspects of the present disclosure.

Referring to FIG. 4A, illustrated is a schematic view of at least a portion of an apparatus 400*a* according to one or more aspects of the present disclosure. The apparatus 400*a* is an exemplary implementation of the apparatus 100 shown in FIG. 1 and/or the apparatus 300 shown in FIG. 3, and is an exemplary environment in which the method 200*a* shown in FIG. 2A and/or the method 200*b* shown in FIG. 2B may be performed. The apparatus 400*a* includes a plurality of user inputs 410 and at least one main steering module 420, which may include one or more processors. The user inputs 410 include a quill torque positive limit 410*a*, a quill torque negative limit 410*b*, a quill speed positive limit 410*c*, a quill speed negative limit 410*d*, a quill oscillation positive limit 410*e*, a quill oscillation negative limit 410*f*, a quill oscillation neutral point input 410*g*, and a toolface orientation input 410*h*. Some embodiments include a survey data input from prior surveys 410*p*, a planned drilling path 410*q*, or preferably both. These inputs may be used to derive the toolface orientation input 410*h* intended to maintain the BHA on the planned drilling path. However, in other embodiments, the toolface orientation is directly entered. Other embodiments within the scope of the present disclosure may utilize additional or alternative user inputs 410. The user inputs 410 may be substantially similar to the user input 330 or other components of the user interface 305 shown in FIG. 3. The at least one steering module 420 may form at least a portion of, or be formed by at least a portion of, the controller 325 shown in FIG. 3 and/or the controller 385 of the drive system 315 shown in FIG. 3. In the exemplary embodiment depicted in FIG. 4A, the at least one steering module 420 includes a toolface controller 420*a* and a drawworks controller 420*b*. In some embodiments, it also includes a mud pump controller.

The apparatus 400*a* also includes or is otherwise associated with a plurality of sensors 430. The plurality of sensors 430 includes a bit torque sensor 430*a*, a quill torque sensor 430*b*, a quill speed sensor 430*c*, a quill position sensor 430*d*, a mud motor ΔP sensor 430*e*, and a toolface orientation sensor 430*f*. Other embodiments within the scope of the present disclosure, however, may utilize additional or alternative sensors 430. In an exemplary embodiment, each of the plurality of sensors 430 may be located at the surface of the wellbore, and not located downhole proximate the bit, the bottom hole assembly, and/or any measurement-while-drilling tools. In other embodiments, however, one or more of the sensors 430 may not be surface sensors. For example, in an exemplary embodiment, the quill torque sensor 430*b*, the quill speed sensor 430*c*, and the quill position sensor 430*d* may be surface sensors, whereas the bit torque sensor 430*a*, the mud motor ΔP sensor 430*e*, and the toolface orientation sensor 430*f* may be downhole sensors (e.g., MWD sensors). Moreover, individual ones of the sensors 430 may be substantially similar to corresponding sensors shown in FIG. 1 or FIG. 3.

The apparatus 400*a* also includes or is associated with a quill drive 440. The quill drive 440 may form at least a portion of a top drive or another rotary drive system, such as the top drive 140 shown in FIG. 1 and/or the drive system 315 shown in FIG. 3. The quill drive 440 is configured to receive a quill drive control signal from the at least one steering module 420, if not also from other components of the apparatus 400*a*. The quill drive control signal directs the position (e.g., azimuth), spin direction, spin rate, and/or oscillation of the quill. The toolface controller 420*a* is configured to generate the quill drive control signal, utilizing data received from the user inputs 410 and the sensors 430.

The toolface controller 420*a* may compare the actual torque of the quill to the quill torque positive limit received from the corresponding user input 410*a*. The actual torque of the quill may be determined utilizing data received from the quill torque sensor 430*b*. For example, if the actual torque of the quill exceeds the quill torque positive limit, then the quill drive control signal may direct the quill drive 440 to reduce the torque being applied to the quill. In an exemplary embodiment, the toolface controller 420*a* may be configured to optimize drilling operation parameters related to the actual torque of the quill, such as by maximizing the actual torque of the quill without exceeding the quill torque positive limit.

The toolface controller 420*a* may alternatively or additionally compare the actual torque of the quill to the quill torque negative limit received from the corresponding user input 410*b*. For example, if the actual torque of the quill is less than the quill torque negative limit, then the quill drive control signal may direct the quill drive 440 to increase the torque being applied to the quill. In an exemplary embodiment, the toolface controller 420*a* may be configured to optimize drilling operation parameters related to the actual torque of the quill, such as by minimizing the actual torque of the quill while still exceeding the quill torque negative limit.

The toolface controller 420*a* may alternatively or additionally compare the actual speed of the quill to the quill speed positive limit received from the corresponding user input 410*c*. The actual speed of the quill may be determined utilizing data received from the quill speed sensor 430*c*. For example, if the actual speed of the quill exceeds the quill speed positive limit, then the quill drive control signal may direct the quill drive 440 to reduce the speed at which the quill is being driven. In an exemplary embodiment, the toolface controller 420*a* may be configured to optimize drilling operation parameters related to the actual speed of the quill, such as by maximizing the actual speed of the quill without exceeding the quill speed positive limit.

The toolface controller 420*a* may alternatively or additionally compare the actual speed of the quill to the quill speed negative limit received from the corresponding user input 410*d*. For example, if the actual speed of the quill is less than the quill speed negative limit, then the quill drive control signal may direct the quill drive 440 to increase the speed at which the quill is being driven. In an exemplary embodiment, the toolface controller 420*a* may be configured to optimize drilling operation parameters related to the actual speed of the quill, such as by minimizing the actual speed of the quill while still exceeding the quill speed negative limit.

The toolface controller 420*a* may alternatively or additionally compare the actual orientation (azimuth) of the quill to the quill oscillation positive limit received from the corresponding user input 410*e*. The actual orientation of the quill may be determined utilizing data received from the quill position sensor 430*d*. For example, if the actual orientation of the quill exceeds the quill oscillation positive limit, then the quill drive control signal may direct the quill drive 440 to rotate the quill to within the quill oscillation positive limit, or to modify quill oscillation parameters such that the actual quill oscillation in the positive direction (e.g., clockwise) does not exceed the quill oscillation positive limit. In an exemplary embodiment, the toolface controller 420*a* may be configured to optimize drilling operation parameters related to the actual oscillation of the quill, such as by maximizing the amount of actual oscillation of the quill in the positive direction without exceeding the quill oscillation positive limit.

The toolface controller 420*a* may alternatively or additionally compare the actual orientation of the quill to the quill oscillation negative limit received from the corresponding user input 410*f*. For example, if the actual orientation of the quill is less than the quill oscillation negative limit, then the quill drive control signal may direct the quill drive 440 to rotate the quill to within the quill oscillation negative limit, or to modify quill oscillation parameters such that the actual quill oscillation in the negative direction (e.g., counter-clockwise) does not exceed the quill oscillation negative limit. In an exemplary embodiment, the toolface controller 420*a* may be configured to optimize drilling operation parameters related to the actual oscillation of the quill, such as by maximizing the actual amount of oscillation of the quill in the negative direction without exceeding the quill oscillation negative limit.

The toolface controller 420*a* may alternatively or additionally compare the actual neutral point of quill oscillation to the desired quill oscillation neutral point input received from the corresponding user input 410*g*. The actual neutral point of the quill oscillation may be determined utilizing data received from the quill position sensor 430*d*. For example, if the actual quill oscillation neutral point varies from the desired quill oscillation neutral point by a predetermined amount, or falls outside a desired range of the oscillation neutral point, then the quill drive control signal may direct the quill drive 440 to modify quill oscillation parameters to make the appropriate correction.

The toolface controller 420*a* may alternatively or additionally compare the actual orientation of the toolface to the toolface orientation input received from the corresponding user input 410*h*. The toolface orientation input received from the user input 410*h* may be a single value indicative of the desired toolface orientation. This may be directly input or derived from the survey data files 410*p* and the planned drilling path 410*q* using, for example, the process described in FIGS. 4C, 5A, and 5B. If the actual toolface orientation differs from the toolface orientation input value by a predetermined amount, then the quill drive control signal may direct the quill drive 440 to rotate the quill an amount corresponding to the necessary correction of the toolface orientation. However, the toolface orientation input received from the user input 410*h* may alternatively be a range within which it is desired that the toolface orientation remain. For example, if the actual toolface orientation is outside the toolface orientation input range, then the quill drive control signal may direct the quill drive 440 to rotate the quill an amount necessary to restore the actual toolface orientation to within the toolface orientation input range. In an exemplary embodiment, the actual toolface orientation is compared to a toolface orientation input that is directly input or derived from the survey data files 410*p* and the planned drilling path 410*q* using an automated process. In some embodiments, this is based on a predetermined and/or constantly updating well plan (e.g., a "well-prog"), possibly taking into account drilling progress path error.

In each of the above-mentioned comparisons and/or calculations performed by the toolface controller, the actual mud motor ΔP, and/or the actual bit torque may also be utilized in the generation of the quill drive signal. The actual mud motor ΔP may be determined utilizing data received from the mud motor ΔP sensor 430*e*, and/or by measurement of pump pressure before the bit is on bottom and tare of this value, and the actual bit torque may be determined utilizing data received from the bit torque sensor 430*a*. Alternatively, the actual bit torque may be calculated utilizing data received from the mud motor ΔP sensor 430*e*, because actual bit torque and actual mud motor ΔP are proportional.

One example in which the actual mud motor ΔP and/or the actual bit torque may be utilized is when the actual toolface orientation cannot be relied upon to provide accurate or fast enough data. For example, such may be the case during "blind" drilling, or other instances in which the driller is no longer receiving data from the toolface orientation sensor 430*f*. In such occasions, the actual bit torque and/or the actual mud motor ΔP can be utilized to determine the actual toolface orientation. For example, if all other drilling parameters remain the same, a change in the actual bit torque and/or the actual mud motor ΔP can indicate a proportional rotation of the toolface orientation in the same or opposite direction of drilling. For example, an increasing torque or ΔP may indicate that the toolface is changing in the opposite direction of drilling, whereas a decreasing torque or ΔP may indicate that the toolface is moving in the same direction as drilling. Thus, in this manner, the data received from the bit torque sensor 430*a* and/or the mud motor ΔP sensor 430*e* can be utilized by the toolface controller 420 in the generation of the quill drive signal, such that the quill can be driven in a manner which corrects for or otherwise takes into account any change of toolface, which is indicated by a change in the actual bit torque and/or actual mud motor ΔP.

Moreover, under some operating conditions, the data received by the toolface controller 420 from the toolface orientation sensor 430*f* can lag the actual toolface orientation. For example, the toolface orientation sensor 430*f* may only determine the actual toolface periodically, or a considerable time period may be required for the transmission of the data from the toolface to the surface. In fact, it is not uncommon for such delay to be 30 seconds or more in the systems of the prior art. Consequently, in some implementations within the scope of the present disclosure, it may be more accurate or otherwise advantageous for the toolface controller 420*a* to utilize the actual torque and pressure data received from the bit torque sensor 430*a* and the mud motor ΔP sensor 430*e* in addition to, if not in the alternative to, utilizing the actual toolface data received from the toolface orientation sensor 430*f*. However, in some embodiments of the present disclosure, real-time survey projections as disclosed in FIGS. 9A and 9B may be used to provide data regarding the BHA direction and toolface orientation.

As shown in FIG. 4A, the user inputs 410 of the apparatus 400*a* may also include a WOB tare 410*i*, a mud motor ΔP tare 410*j*, an ROP input 410*k*, a WOB input 410*l*, a mud motor ΔP input 410*m*, and a hook load limit 410*n*, and the at least one steering module 420 may also include a drawworks controller 420*b*. The plurality of sensors 430 of the apparatus 400*a* may also include a hook load sensor 430*g*, a mud pump pressure sensor 430*h*, a bit depth sensor 430*i*, a casing pressure sensor 430*j* and an ROP sensor 430*k*. Each of the plurality of sensors 430 may be located at the surface of the wellbore, downhole (e.g., MWD), or elsewhere.

As described above, the toolface controller 420*a* is configured to generate a quill drive control signal utilizing data received from ones of the user inputs 410 and the sensors 430, and subsequently provide the quill drive control signal to the quill drive 440, thereby controlling the toolface orientation by driving the quill orientation and speed. Thus, the quill drive control signal is configured to control (at least partially) the quill orientation (e.g., azimuth) as well as the speed and direction of rotation of the quill (if any).

The drawworks controller 420*b* is configured to generate a drawworks drum (or brake) drive control signal also utilizing data received from ones of the user inputs 410 and the sensors 430. Thereafter, the drawworks controller 420*b* provides the drawworks drive control signal to the drawworks drive 450, thereby controlling the feed direction and rate of the drawworks. The drawworks drive 450 may form at least a portion of, or may be formed by at least a portion of, the drawworks 130 shown in FIG. 1 and/or the drawworks 320 shown in FIG. 3. The scope of the present disclosure is also applicable or readily adaptable to other means for adjusting the vertical positioning of the drill string. For example, the drawworks controller 420*b* may be a hoist controller, and the drawworks drive 450 may be or include means for hoisting the drill string other than or in addition to a drawworks apparatus (e.g., a rack and pinion apparatus).

The apparatus 400*a* also includes a comparator 420*c* which compares current hook load data with the WOB tare to generate the current WOB. The current hook load data is received from the hook load sensor 430*g*, and the WOB tare is received from the corresponding user input 410*i*.

The drawworks controller 420*b* compares the current WOB with WOB input data. The current WOB is received from the comparator 420*c*, and the WOB input data is received from the corresponding user input 410*l*. The WOB input data received from the user input 410*l* may be a single value indicative of the desired WOB. For example, if the actual WOB differs from the WOB input by a predetermined amount, then the drawworks drive control signal may direct the drawworks drive 450 to feed cable in or out an amount corresponding to the necessary correction of the WOB. However, the WOB input data received from the user input 410*l* may alternatively be a range within which it is desired that the WOB be maintained. For example, if the actual WOB is outside the WOB input range, then the drawworks drive control signal may direct the drawworks drive 450 to feed cable in or out an amount necessary to restore the actual WOB to within the WOB input range. In an exemplary embodiment, the drawworks controller 420*b* may be configured to optimize drilling operation parameters related to the WOB, such as by maximizing the actual WOB without exceeding the WOB input value or range.

The apparatus 400*a* also includes a comparator 420*d* which compares mud pump pressure data with the mud motor ΔP tare to generate an "uncorrected" mud motor ΔP. The mud pump pressure data is received from the mud pump pressure sensor 430*h*, and the mud motor ΔP tare is received from the corresponding user input 410*j*.

The apparatus 400*a* also includes a comparator 420*e* which utilizes the uncorrected mud motor ΔP along with bit depth data and casing pressure data to generate a "corrected" or current mud motor ΔP. The bit depth data is received from the bit depth sensor 430*i*, and the casing pressure data is received from the casing pressure sensor 430*j*. The casing pressure sensor 430*j* may be a surface casing pressure sensor, such as the sensor 159 shown in FIG. 1, and/or a downhole casing pressure sensor, such as the sensor 170*a* shown in FIG. 1, and in either case may detect the pressure in the annulus defined between the casing or wellbore diameter and a component of the drill string.

The drawworks controller 420*b* compares the current mud motor ΔP with mud motor ΔP input data. The current mud motor ΔP is received from the comparator 420*e*, and the mud motor ΔP input data is received from the corresponding user input 410*m*. The mud motor ΔP input data received from the user input 410*m* may be a single value indicative of the desired mud motor ΔP. For example, if the current mud motor ΔP differs from the mud motor ΔP input by a predetermined amount, then the drawworks drive control signal may direct the drawworks drive 450 to feed cable in or out an amount corresponding to the necessary correction of the mud motor ΔP. However, the mud motor ΔP input data received from the user input 410*m* may alternatively be a range within which it is desired that the mud motor ΔP be maintained. For example, if the current mud motor ΔP is outside this range, then the drawworks drive control signal may direct the drawworks drive 450 to feed cable in or out an amount necessary to restore the current mud motor ΔP to within the input range. In an exemplary embodiment, the drawworks controller 420*b* may be configured to optimize drilling operation parameters related to the mud motor ΔP, such as by maximizing the mud motor ΔP without exceeding the input value or range.

The drawworks controller 420*b* may also or alternatively compare actual ROP data with ROP input data. The actual ROP data is received from the ROP sensor 430*k*, and the ROP input data is received from the corresponding user input 410*k*. The ROP input data received from the user input 410*k* may be a single value indicative of the desired ROP. For example, if the actual ROP differs from the ROP input by a predetermined amount, then the drawworks drive control signal may direct the drawworks drive 450 to feed cable in or out an amount corresponding to the necessary correction of the ROP. However, the ROP input data received from the user input 410*k* may alternatively be a range within which it is desired that the ROP be maintained. For example, if the actual ROP is outside the ROP input range, then the drawworks drive control signal may direct the drawworks drive 450 to feed cable in or out an amount necessary to restore the actual ROP to within the ROP input range. In an exemplary embodiment, the drawworks controller 420*b* may be configured to optimize drilling operation parameters related to the ROP, such as by maximizing the actual ROP without exceeding the ROP input value or range.

The drawworks controller 420*b* may also utilize data received from the toolface controller 420*a* when generating the drawworks drive control signal. Changes in the actual WOB can cause changes in the actual bit torque, the actual mud motor ΔP, and the actual toolface orientation. For example, as weight is increasingly applied to the bit, the actual toolface orientation can rotate opposite the direction of bit rotation (due to reactive torque), and the actual bit torque and mud motor pressure can proportionally increase. Consequently, the toolface controller 420*a* may provide data to the drawworks controller 420*b* indicating whether the drawworks cable should be fed in or out, and perhaps a corresponding feed rate, as necessary to bring the actual toolface orientation into compliance with the toolface orientation input value or range provided by the corresponding user input 410*h*. In an exemplary embodiment, the drawworks controller 420*b* may also provide data to the toolface controller 420*a* to rotate the quill clockwise or counterclockwise by an amount and/or rate sufficient to compensate for increased or decreased WOB, bit depth, or casing pressure.

As shown in FIG. 4A, the user inputs 410 may also include a pull limit input 410*n*. When generating the drawworks drive control signal, the drawworks controller 420*b* may be configured to ensure that the drawworks does not pull past the pull limit received from the user input 410*n*. The pull limit is also known as a hook load limit, and may be dependent upon the particular configuration of the drilling rig, among other parameters.

In an exemplary embodiment, the drawworks controller 420*b* may also provide data to the toolface controller 420*a* to cause the toolface controller 420*a* to rotate the quill, such as by an amount, direction, and/or rate sufficient to compensate for the pull limit being reached or exceeded. The toolface controller 420*a* may also provide data to the drawworks controller 420*b* to cause the drawworks controller 420*b* to increase or decrease the WOB, or to adjust the drill string feed, such as by an amount, direction, and/or rate sufficient to adequately adjust the toolface orientation.

Figure 4B:
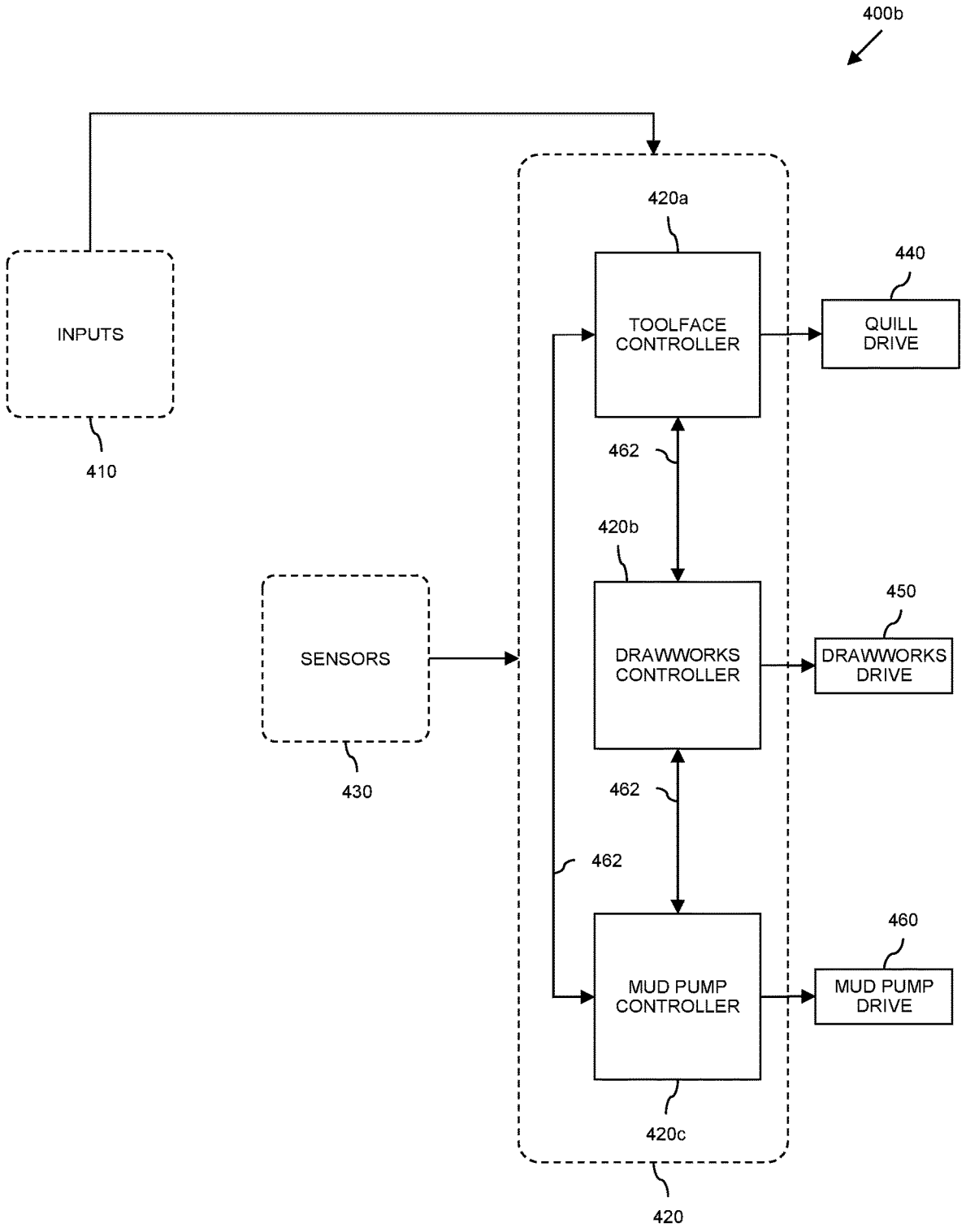

Referring to FIG. 4B, illustrated is a high level schematic view of at least a portion of another embodiment of the apparatus 400*a*, herein designated by the reference numeral 400*b*. Like the apparatus 400*a*, the apparatus 400*b* is an exemplary implementation of the apparatus 100 shown in FIG. 1 and/or the apparatus 300 shown in FIG. 3, and is an exemplary environment in which the method 200*a* shown in FIG. 2A and/or the method 200*b* shown in FIG. 2B may be performed.

Like the apparatus 400*a*, the apparatus 400*b* includes the plurality of user inputs 410 and the at least one steering module 420. The at least one steering module 420 includes the toolface controller 420*a* and the drawworks controller 420*b*, described above, and also a mud pump controller 420*c*. The apparatus 400*b* also includes or is otherwise associated with the plurality of sensors 430, the quill drive 440, and the drawworks drive 450, like the apparatus 400*a*. The apparatus 400*b* also includes or is otherwise associated with a mud pump drive 460, which is configured to control operation of a mud pump, such as the mud pump 180 shown in FIG. 1. In the exemplary embodiment of the apparatus 400*b* shown in FIG. 4B, each of the plurality of sensors 430 may be located at the surface of the wellbore, downhole (e.g., MWD), or elsewhere.

The mud pump controller 420*c* is configured to generate a mud pump drive control signal utilizing data received from ones of the user inputs 410 and the sensors 430. Thereafter, the mud pump controller 420*c* provides the mud pump drive control signal to the mud pump drive 460, thereby controlling the speed, flow rate, and/or pressure of the mud pump. The mud pump controller 420*c* may form at least a portion of, or may be formed by at least a portion of, the controller 190 shown in FIG. 1 and/or the controller 325 shown in FIG. 3.

As described above, the mud motor ΔP may be proportional or otherwise related to toolface orientation, WOB, and/or bit torque. Consequently, the mud pump controller 420*c* may be utilized to influence the actual mud motor ΔP to assist in bringing the actual toolface orientation into compliance with the toolface orientation input value or range provided by the corresponding user input. Such operation of the mud pump controller 420*c* may be independent of the operation of the toolface controller 420*a* and the drawworks controller 420*b*. Alternatively, as depicted by the dual-direction arrows 462 shown in FIG. 4B, the operation of the mud pump controller 420*c* to obtain or maintain a desired toolface orientation may be in conjunction or cooperation with the toolface controller 420*a* and the drawworks controller 420*b*.

The controllers 420*a*, 420*b*, and 420*c* shown in FIGS. 4A and 4B may each be or include intelligent or model-free adaptive controllers, such as those commercially available from CyberSoft, General Cybernation Group, Inc. The controllers 420*a*, 420*b*, and 420*c* may also be collectively or independently implemented on any conventional or future-developed computing device, such as one or more personal computers or servers, hand-held devices, PLC systems, and/or mainframes, among others.

Figure 4C:
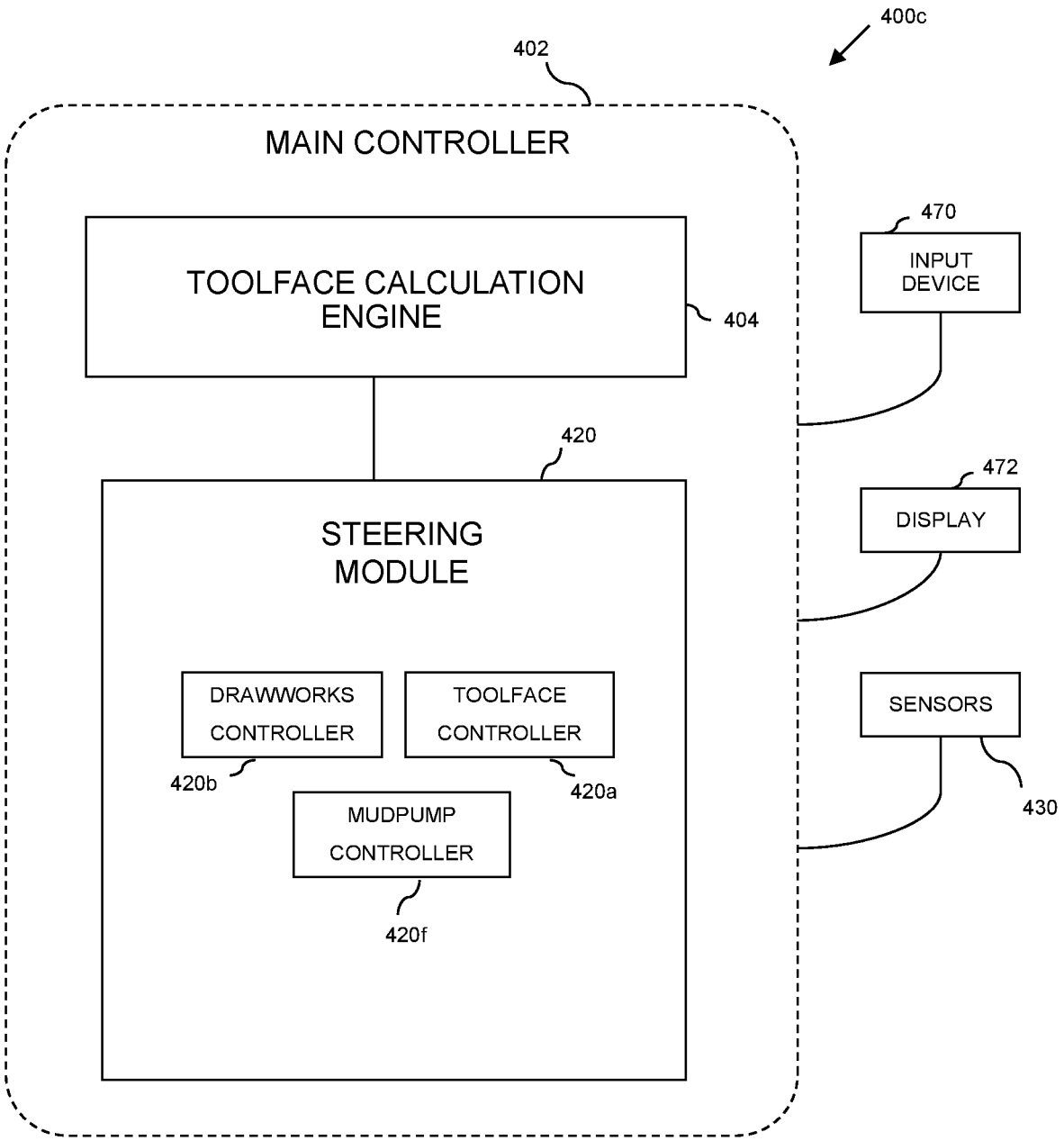

FIG. 4C is another high-level block diagram identifying exemplary components of another alternative rigsite drilling control system 400*c* of the apparatus 100 in FIG. 1. In this exemplary embodiment, the block diagram includes a main controller 402 including a toolface calculation engine 404, a steering module 420 including a toolface controller 420*a*, a drawworks controller 420*b*, and a mudpump controller 420*f*. In addition, the control system includes a user input device 470 that may receive inputs 410 in FIG. 4A, an output display 472, and sensors 430 in communication with the main controller 402. In the embodiment shown, the toolface calculation engine 404 and the steering module 420 are applications that may share the same processor or operate using separate processors to perform different, but cooperative functions. Accordingly, the main controller 402 is shown encompassing drawworks, toolface, and mudpump controllers as well as the toolface calculation engine 404. In other embodiments, however, the toolface calculation engine 404 operates using a separate processor for its calculations and path determinations. The user input device 470 and the display 472 may include at least a portion of a user interface, such as the user interface 305 shown in FIG. 3. The user-interface and the controller may be discrete components that are interconnected via wired or wireless means. However, they may alternatively be integral components of a single system, for example.

As indicated above, a drilling plan includes a wellbore profile or planned drilling path. This is the pre-selected pathway for the wellbore to be drilled, typically until conditions require a change in the drilling plan. It typically specifies key points of inflection along the wellbore and optimum rates of curvature to be used to arrive at the wellbore positional objective or objectives, referred to as target locations. To the extent possible, the main controller 402 controls the drilling rig to steer the BHA toward the target location along the planned drilling path within a specified tolerance zone.

The calculation engine 404 is a controller or a part of a controller configured to calculate a control drilling path for the BHA. This path adheres to the planned wellbore drilling path within an acceptable margin of error known as a tolerance zone, (also referred to herein as a "tolerance cylinder" merely for exemplary purposes). Based upon locational and other feedback, and based upon the original planned drilling path, the toolface calculation engine 404 will either produce a recommended toolface angular setting between 0 and 360 degrees and a distance to drill in feet or meters on this toolface setting, or produce a recommendation to continue to drill ahead in rotary drilling mode. Preferably, the angular setting is as minimally different from the drilled section as possible to minimize drastic curvatures that can complicate insertion of casing. These recommendations ensure that the BHA travels in the desired direction to arrive at the target location in an efficient and effective manner.

The toolface calculation engine 404 makes its recommendations based on a number of factors. For example, the toolface calculation engine 404 considers the original control drilling path, it considers directional trends, and it considers real time projection to bit depth. In some embodiments, this engine 404 considers additional information that helps identify the location and direction of the BHA. In others, the engine 404 considers only the directional trends and the original drilling path.

The original control drilling path may have been directly entered by a user or may have been calculated by the toolface calculation engine 404 based upon parameters entered by the user. The directional trends may be determined based upon historical or existing locational data from the periodic or real-time survey results to predict bit location. This may include, for example, the rates of curvature, or dogleg severity, generated over user specified drilling intervals of measured depths. These rates can be used as starting points for the next control curve to be drilled, and can be provided from an analysis of the current drilling behavior from the historical drilling parameters. The calculation of normal plane distance to the planned target location can be carried out from a real-time projection to the bit position. This real-time projection to bit depth may be calculated by the toolface calculation engine 404 or the steering module 420 based upon static and/or dynamic information obtained from the sensors 430. If calculated by the steering module 420, the values may be fed to the toolface calculation engine 404 for additional processing. These projection to bit depth values may be calculated using any number of methods, including, for example, the minimum curvature arc method, the directional trend method, and the straight line method. Once the position is calculated, it is used as the start point for the normal plane clearance calculation and any subsequent control path or correction path calculations.

Using these inputs, the toolface calculation engine 404 makes a determination of where the actual drilling path lies relative to the planned or control drilling path. Based on its findings, the toolface calculation engine 404 creates steering instructions to help keep the actual drilling path aligned with the planned drilling path, i.e., within the tolerance zone. These instructions may be output as toolface orientation instructions, which may be used in input **410*h* in FIG. 4A. In some embodiments, the created steering instructions are based on the extent of deviation of the actual drilling path relative the planned drilling path, as discussed further below. An exemplary method 500 performed by the toolface calculation engine 404 for determining the amount of deviation from the desired path and for determining a corrective path is shown in FIG. 5**A.

Figure 5A:
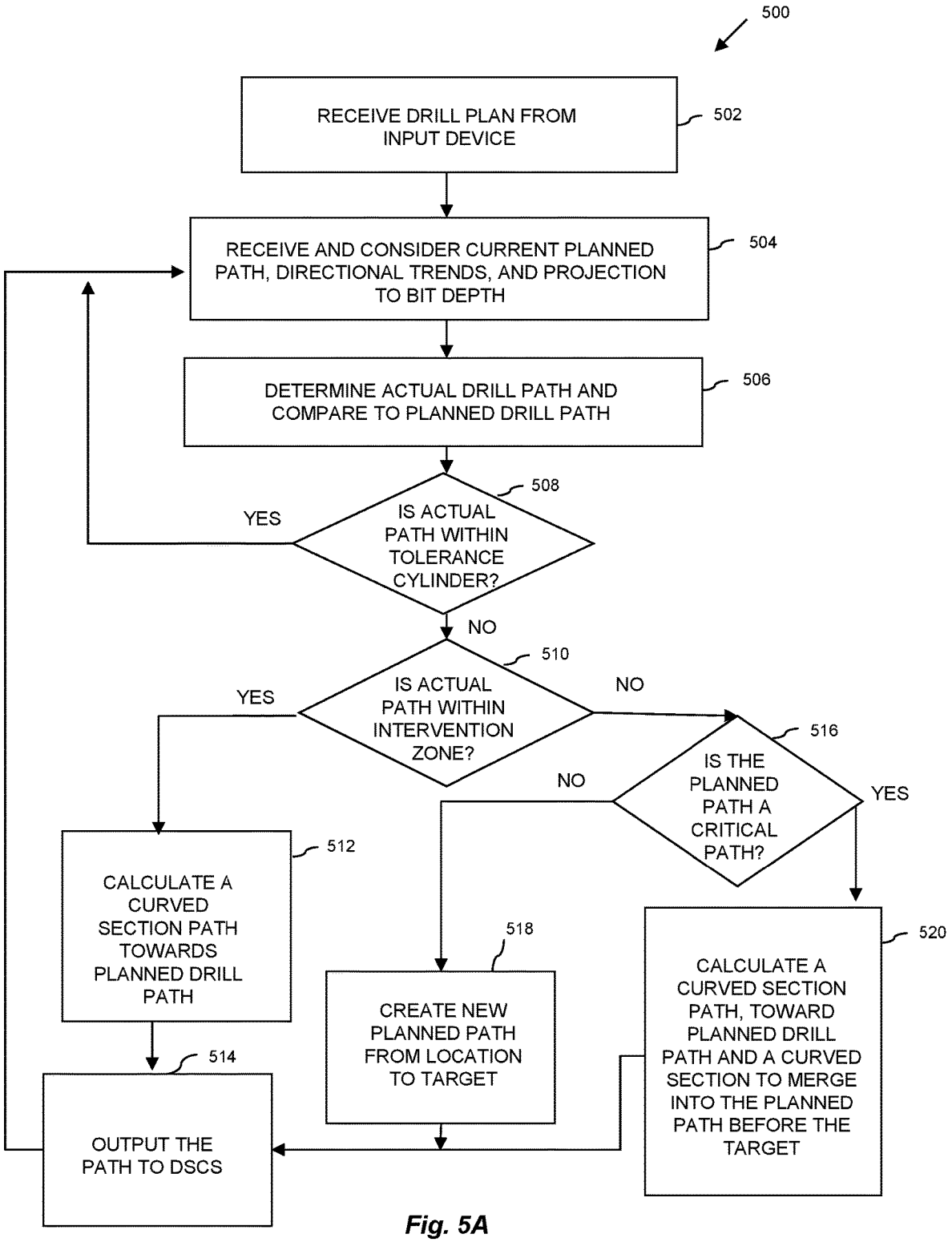
FIG. 5A is a flow-chart diagram of a method according to one or more aspects of the present disclosure.

In FIG. 5A, the method 500 can begin at step 502, with the toolface calculation engine 404 receiving a user-input control or planned drilling path. The control or planned drilling path is the desired path that may be based on multiple factors, but frequently is intended to provide a most efficient or effective path from the drilling rig to the target location.

At step 504, the toolface calculation engine 404 considers the current desired drilling path, directional trends, and projection to bit depth. As discussed above, the directional trends are based on prior survey readings and the projection to bit depth or bit position is determined by the toolface calculation engine 404, the steering module 420, or other controller or module in the main controller 402. This information is conveyed from the calculating component to the toolface calculation engine 404 and includes a dogleg severity value that is used to calculate corrective curves when needed, as discussed below. Here, as a first iteration, the current desired drilling path may correspond to the control or planned drilling path defined in the drill plan received in step 502.

At step 506, the toolface calculation engine 404 determines the actual drilling path based upon the directional trends and the projection to bit depth. As indicated above, additional data may be used to determine the actual drilling path and in some embodiments, the directional trends may be used to estimate the actual drilling path if the actual drilling path measurement is suspect or the needed sensory input for the calculation is limited. At step 508, the toolface calculation engine 404 determines whether the actual path is within a tolerance zone defined by the current desired drilling path. A tolerance zone or drill-ahead zone is shown and described with reference to FIG. 5B.

Figure 5B:
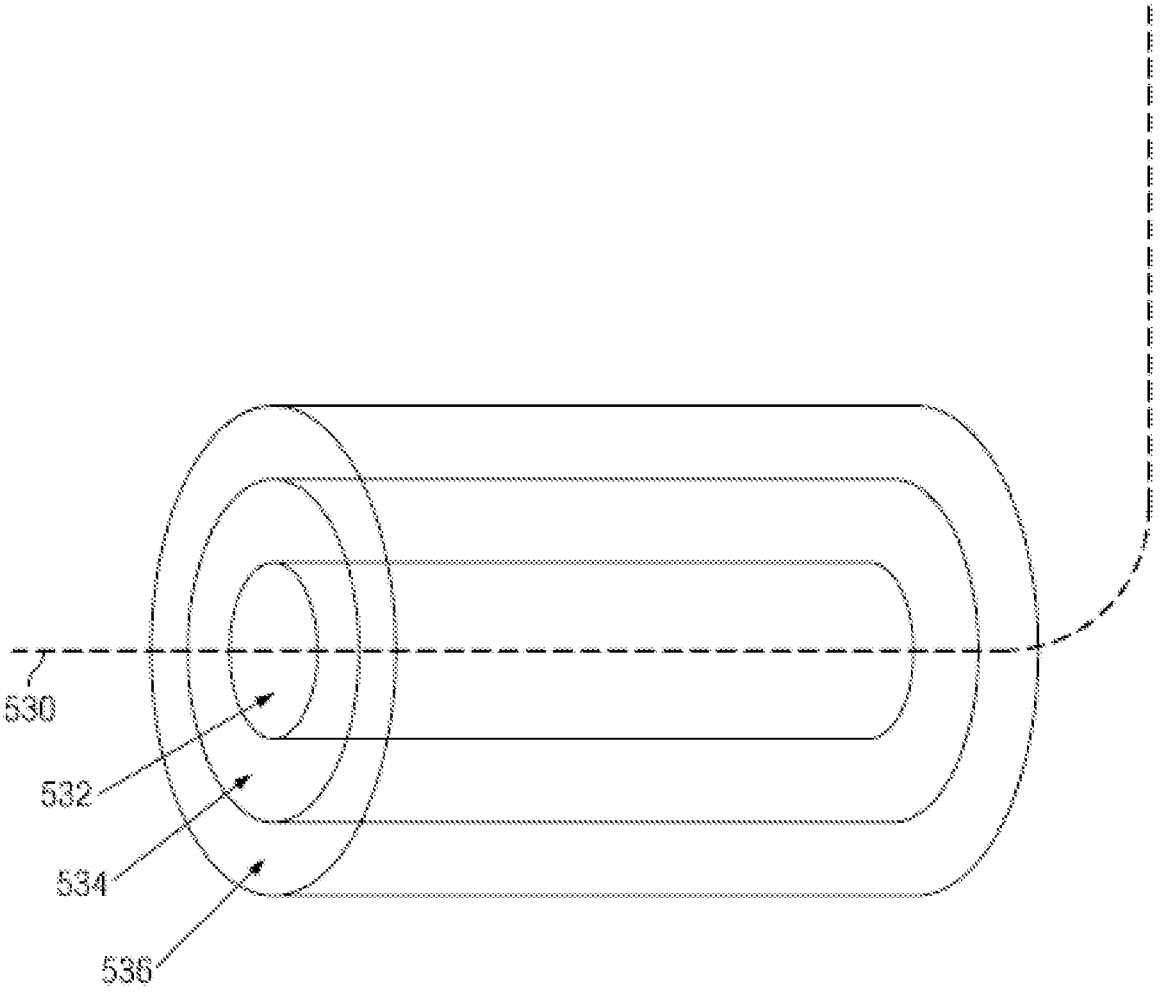
FIG. 5B is an illustration of a tolerance cylinder about drilling path.

FIG. 5B shows an exemplary planned well bore drilling path 530 as a dashed line. The planned well bore path 530 forms the axis of a hypothetical tolerance cylinder 532, an intervention zone 534, and a correction zone 536. So long as the actual drilling path is within the tolerance cylinder 532, the actual drilling path is within an acceptable range of deviation from the planned drilling path, and the drilling can continue without steering adjustments. The tolerance cylinder may be specified within certain percentages of distance from the desired path or from the borehole diameter, and can be dependent in part on considerations that are different for each proposed well. For example, the correction zone may alternatively be set at about 50% different, or about 20% different, from the planned path, while the intervention zone may be set at about 25%, or about 10%, different from the planned path. Accordingly, returning to FIG. 5A, if the toolface calculation engine 404 determines that the actual path is within the tolerance zone about the planned drilling path at step 508, then the process can simply return to step 504 to await receipt of the next directional trend and/or projection to bit depth.

If at step 508, the toolface calculation engine 404 determines that the actual drilling path is outside the tolerance cylinder 532 shown in FIG. 5B, then the toolface calculation engine 404 determines whether the actual path is within the intervention zone 534, where the steering module 420 may generate one or more control signals to intervene to keep the BHA heading in the desired direction. The intervention zone 534 in FIG. 5B extends concentrically about the tolerance cylinder 532. It includes an inner boundary defined by the tolerance cylinder 532 and an outer boundary defined by the correction zone 536. If the actual drilling path were in the intervention zone 534, the actual drilling path may be considered to be moderately deviating from the planned drilling path 530. In this embodiment, the correction zone 536 is concentric about the intervention zone 534 and defines the entire region outside the intervention zone 534. If the actual drilling path were in the correction zone 536, the actual drilling path may be considered to be significantly deviating from the planned drilling path 530.

Returning now to FIG. 5A, if the actual drilling path is within the intervention zone 534 at step 510, then the toolface calculation engine 404 can calculate a 3D curved section path from the projected bit position towards the planned drilling path 530 at step 512. As mentioned above, this calculation can be based on data obtained from current or prior survey files, and may include a projection of bit depth or bit position and a dogleg severity value. The calculated curved section path preferably includes the toolface orientation required to follow the curved section and the measured depth ("MD") to drill in feet or meters, for example, to bring the BHA back into the tolerance zone as efficiently as possible but while minimizing any overcorrection.

This corrected direction path, as one or more steering signals, is then output to the steering module 420 at step 514. Accordingly, one or more of the controllers 420*a, b, f* in FIG. 4C receives the desired tool face orientation data and other advisory information that enable the controllers to generate one or more command signals that steer the BHA. From the planned drilling path, the steering module 420 and/or other components of the rigsite drilling control system 400*c* can control the drawworks, the top drive, and the mud pump to directionally steer the BHA according to the corrected path.

From here, the process returns to step 504 where the toolface calculation engine 404 considers the current planned path, directional trends, and projection to bit depth. Here, the current planned path is now modified by the curved section path calculated at step 512. Accordingly during the next iteration, the drilling path considered the "planned" drilling path is now the corrective path.

If at step 510, the actual drilling path is not within the intervention zone 534, then the toolface calculation engine 404 determines that the actual drilling path must then be in the correction zone 536 and determines whether the planned path is a critical drilling path at step 516. A critical drilling path is typically one where reasons exist that limit the desirability of creating a new planned drilling path to the target location. For example, a critical drilling path may be one where a path is chosen to avoid underground rock formations and the region outside the intervention zone 534 includes the rock formation. Of course, designation of a planned drilling path as a critical path may be made for any reason.

If the planned drilling path is not a critical path at step 516, then the toolface calculation engine 404 generates a new planned path from the projected current location of the bit to the target location. This new planned path may be independent of, or might not intersect with, the original planned path and may be generated based on, for example, the most efficient or effective path to the target from the current location. For example, the new path may include the minimum amount of curvature required from the projected current bit location to the target. The new planned path might show measured depth ("MD"), inclination, azimuth, North-South and East-West, toolface, and dogleg severity ("DLS") or curvature, at regular station intervals of about 100 feet or 30 meters, for example. The path, toolface orientation data, and other data may be output to the steering module 420 so that the steering module 420 can steer the BHA to follow the new path as closely as possible. This output may include the calculated toolface advisory angle and distance to drill. Again the process returns to step 504 where the toolface calculation engine 404 considers the current planned path, directional trends, and projection to bit depth. Now the current planned path is the new planned path calculated at step 518.

If the planned path is determined to be a critical path at step 516, however, the toolface calculation engine 404 creates a path that steers the bit to intersect with the original planned path for continued drilling. To do this, as indicated at step 520, the toolface calculation engine 404 calculates at least a first 3D curved section path (an "intersection path") from the projected bit position toward the planned drilling path or toward the target. Optionally, the toolface calculation engine 404 can additionally calculate a second 3D curved section path to merge the BHA into the planned path from the intersection path before reaching the target. These curved section paths may be divided by a hold, or straight section, depending on how far into the correction zone the BHA has strayed. Of course, if the intersection path is planned without a second 3D curved section path, the revised plan will be a hold, or straight section, from the deviation to the new target, either the ultimate target or a location on the original planned path.

The toolface calculation engine 404 outputs the revised steering path including the newly generated curve(s) as one or more steering signals to the steering module 420 at step 514. As above, the revised planned path might include measured depth (MD), inclination, azimuth, North-South and East-West, toolface, and DLS at regular station intervals of about 100 feet or 30 meters, for example. During the next iteration, the toolface calculation engine 404 considers the current planned path, directional trends, and projection to bit depth with the current planned path being the corrected planned path at step 504.

The method 500 iterates during the drilling process to seek to maintain the actual drilling path with the planned path, and to adjust the planned path as circumstances require. In some embodiments, the process occurs continuously in real-time. This can advantageously permit expedited drilling without need for stopping to rely on human consultation of a well plan or to evaluate survey data. In other embodiments, the process iterates after a preset drilling period or interval, such as, for example, about 90 seconds, about five minutes, about ten minutes, about thirty minutes, or some other duration. Alternatively, the iteration may be a predetermined drilling progress depth. For example, the process may be iterated when the existing wellbore is extended about five feet, about ten feet, about fifty feet, or some other depth. The process interval may also include both a time and a depth component. For example, the process may include drilling for at least about thirty minutes or until the wellbore is extended about ten feet. In another example, the interval may include drilling until the wellbore is extended up to about twenty feet, but no longer than about ninety minutes. Of course, the above-described time and depth values for the interval are merely examples, and many other values are also within the scope of the present disclosure.

Once calculated by the toolface calculation engine 404, typically electronically, the correction path to the original drilling plan and the correction path to the target location are passed to the control components of the rigsite control system. After calculating a correction, the toolface calculation engine 404 or other rigsite control component, including the steering module 420, make tool face recommendations or commands that can be carried out on the rig.

In some embodiments, a user may selectively control whether the toolface calculation engine 404 creates a new planned path to target or creates a corrected planned path to the original plan when the actual drilling path is in the correction zone 536. For example, a user may select a default function that instructs the correction option to calculate a path to "target" or to "original plan." In some embodiments, the default may be active during only designated portions of the original drilling path.

Because directional control decisions are based on the amount of deviation of the drilling well from the planned path, after each survey, a normal plan proximity scan to the planned well can be carried out. If the drilling position is in the intervention zone, a nudge of the drilling well back towards the plan will typically be recommended. If the well continues to diverge from the plan and enters the correction zone, a re-planned path will typically be calculated as a correction to target or correction to original plan.

Figure 12:
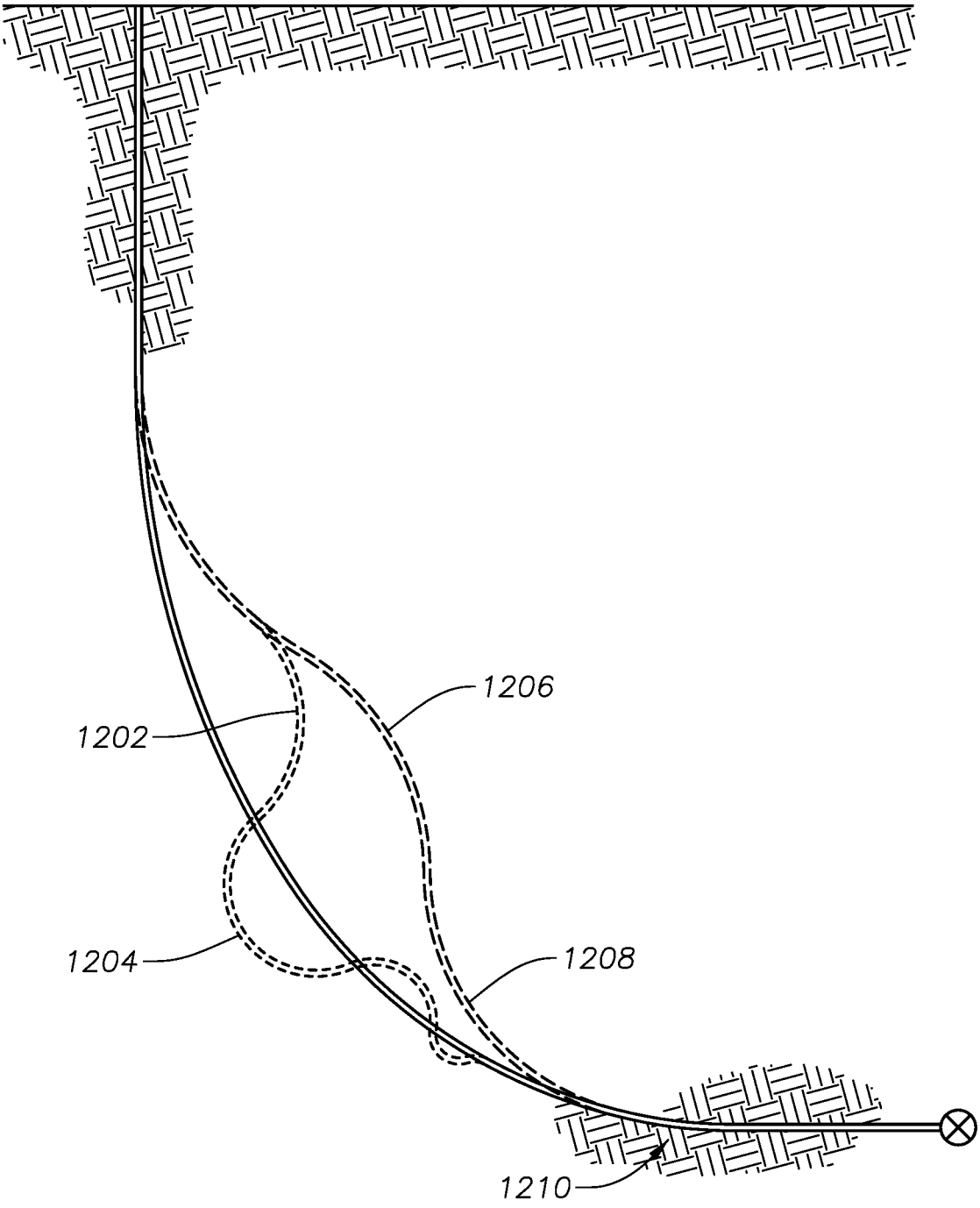
FIG. 12 is a schematic diagram of a modified drilling plan according to one or more aspects of the present disclosure.

Some embodiments consider one or more variables in addition to, or in place of, the real time projection to bit depth or directional trends. Input variables may vary for each calculation. In addition, the dogleg severity, or rate of curvature, may be used to calculate a suitable curve that limits the amount of oscillation and avoids drilling path overshoot. Referring to FIG. 12, curve 1202 is an example of a curve with an unacceptably high rate of curvature. Curve 1204 is an example of a curve with too much drilling path overshoot and a high amount of oscillation. The dogleg severity, or rate of curvature, may be derived by analysis using the current drilling behavior of the BHA, from the historical drilling parameters, or a combination thereof.

When creating a modified drill plan that returns the BHA to the original bit path, as when the projected bit location is within the intervention zone 534 or when the planned drilling path has deviated significantly and is a critical path, the goal is to return to the original planned drilling path prior to arriving at the target location. The curve profile is still a consideration, however, as the curve profile can influence friction, oscillation, and other factors. The dogleg severity value may be used to calculate one or both curve calculations as before—the first curve 1206 turning the bit toward the original planned path or to the target, and the optional second curve 1208 permitting the BHA to more rapidly align with and follow the planned path with a limited amount, or no amount of overshoot or overcorrection. One method of determining a curve profile includes calculating a curve-hold or a curve-hold-curve profile to the final point or target location 1210 in the original plan, and then re-running the calculation on the final target-minus-1 point, survey time period, or distance calculation, or other period. The calculating is preferably achieved electronically. This continues on, going to the final-minus-2 point and so on, until the calculation fails. The last successful calculation of the profile can be arranged to produce one or two arcs having the smallest acceptable rates of curvature with associated drilled lengths, such as seen in acceptable curves 1206 and 1208. These values determine the tool face advisory information for the first correction curve that is used to develop the new drilling path and that is used to steer the BHA. When the actual drilling path reaches the final curve to intersect the original drill plan, in the optional embodiment where a second, final curve back to the original drill plan is used, this final curve is drilled at the second calculated drilled length and rate of curvature.

It should be noted that, although the tolerance cylinder 532 and the intervention zone 534 are shown as cylinders without a circular cross-section, they may have other shapes, including without limitation, oval, conical, parabolic or others, for example, or may be non-concentric about the planned drilling path 530. Alternative shapes may, e.g., permits the bit to stray more in one direction than another from the planned path, such as depending on geological deposits on one side of the planned path. Furthermore, although the example described includes three zones (the tolerance zone, the intervention zone, and the correction zone), this is merely for sake of explanation. In other embodiments, additional zones may be included, and additional factors may be weighed when considering whether to create a path that intersects with the original planned path, whether to create a path that travels directly to the target location without intersecting the original planned drilling path, or how gentle the DLS can be on the corrective curve(s).

In some exemplary embodiments, a driller can increase or decrease the size of the tolerance on the fly while drilling by inputting data to the toolface calculation engine 404. This may help minimize or avoid overcorrection, or excessive oscillation, in the drilling path.

Once calculated, data output from the toolface calculation engine 404 may act as the input to the steering module 420 in FIG. 4C, or the steering module 420 in FIG. 4A. For example, the data output from the toolface calculation engine 404 may include, among others, a toolface orientation usable as the input 410*h* in FIG. 4A. In this figure, toolface orientation 410*h* is an input to the apparatus 400*a* and is used by the toolface controller 420*a* to control the quill drive 440. Additional data output from toolface calculation engine 404 may be used as inputs to the to the apparatus 400*a*. Using these inputs, the toolface controller 420*a*, the drawworks controller 420*b*, and the mudpump controller 420*f* can control drilling rig or the BHA itself to steer the BHA along the desired drilling path.

In some embodiments, an alerts module may be used to alert drillers and/or a well monitoring station of a deviation of the bit from the planned drilling path, of any potential problem with the drilling system, or of other information requiring attention. When drillers are not at the drilling rig, i.e., the driller(s) are remotely located from the rig, the alerts module may be associated with the toolface calculation engine 404 in a manner that when the toolface calculation engine 404 detects deviation of the bit from the planned drilling path, the alerts module signals the driller, and in some cases, can be arranged to await manual user intervention, such as an approval, before steering the bit along a new path. This alert may occur on the drilling rig through any suitable means, and may appear on the display 472 as a visual alert. Alternatively, it may be an audible alert or may trigger transmission of an alert signal via an RF signal to designated locations or individuals.

In addition to communicating the alert to the display 472 or other location about the drilling rig, the alert module may communicate the alert to an offsite location. This may permit offsite monitoring and may allow a driller to make remote adjustments. These alerts may be communicated via any suitable transmission link. For example, in some embodiments where the alert module sends the alert signal to a remote location, the alert may be through a satellite communication system. More particularly, one or more orbital (generally fixed position) satellites may be used to relay communication signals (potentially bi-directional) between a well monitoring station and the alerts module on the offshore platform. Alternatively, radio, cellular, optical, or hard wired signal transmission methods may be used for communication between the alerts module and the drillers or the well monitoring station. In situations where the oil drilling location is an offshore platform, a satellite communications system may be used, as cellular, hard wire, and ship to shore-type systems are in some situations impractical or unreliable. It should be noted that offsite monitoring and adjustments may be made without specific alerts, but through using the remote access systems described.

A centralized well monitoring station may generally be a computer or server configured to interface with a plurality of alerts modules each positioned at a different one of a plurality of well platforms. The well monitoring station may be configured to receive various types of signals (satellite, RF, cellular, hard wired, optical, ship to shore, and telephone, for example) from a plurality of well drilling locations having an alerts module thereon. The well monitoring station may also be configured to transmit selected information from the alerts module to a specific remote user terminal of a plurality of remote user terminals in communication with the alerts module. The well monitoring station may also receive information or instructions from the remote user terminal. The remote user terminal, via the well monitoring station and the alerts module, is configured to display drilling or production parameters for the well associated with the alerts module.

The well monitoring station may generally be positioned at a central data hub, and may be in communication with the alerts module at the drilling site via a satellite communications link, for example. The monitoring station may be configured to allow users to define alerts based on information and data that is gathered from the drilling site(s) by various data replication and synchronization techniques. As such, received data may not be truly real time in every embodiment of the invention, as the alerts depend upon data that has been transmitted from a drilling site to the central data hub over a radio or satellite communications medium (which inherently takes some time to accomplish).

In one embodiment, an exemplary alerts module monitors one, two, or more specific applications or properties. The operation section and the actual values that the alert is setup against are also generally database and metadata driven, and therefore, when the property is of a particular data type, then the appropriate operations may be made available for the user to select.

Figure 6A:
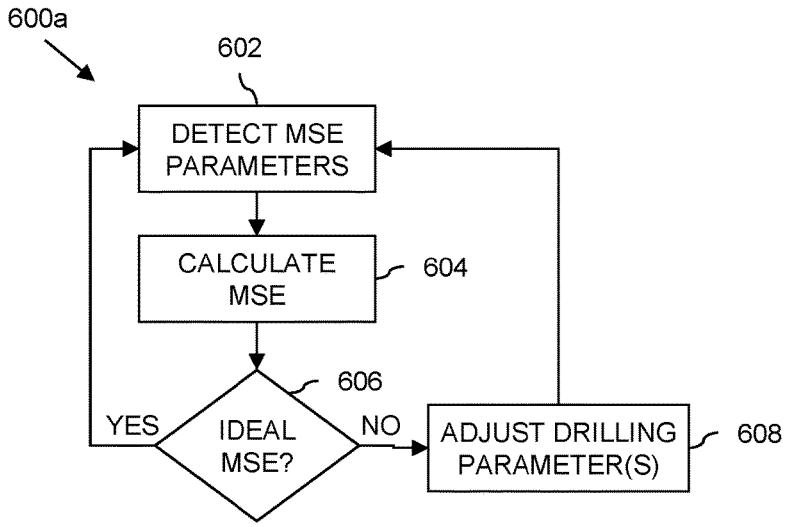
FIG. 6A is a flow-chart diagram of a method according to one or more aspects of the present disclosure.

Turning now to FIG. 6A, illustrated is a flow-chart diagram of a method 600*a* according to one or more aspects of the present disclosure. The method 600*a* may be performed in association with one or more components of the apparatus 100 shown in FIG. 1 during operation of the apparatus 100. For example, the method 600*a* may be performed to optimize drilling efficiency during drilling operations performed via the apparatus 100, may be carried out by any of the control systems disclosed in any of the figures herein, including FIGS. 3 and 4A-C, among others.

The method 600*a* includes a step 602 during which parameters for calculating mechanical specific energy (MSE) are detected, collected, or otherwise obtained. These parameters may be referred to herein as MSE parameters and may be used as input in FIGS. 4A-C and others. The MSE parameters include static and dynamic parameters. That is, some MSE parameters change on a substantially continual basis. These dynamic MSE parameters include the weight on bit (WOB), the drill bit rotational speed (RPM), the drill string rotational torque (TOR), and the rate of penetration (ROP) of the drill bit through the formation being drilled. Other MSE parameters change infrequently, such as after tripping out, reaching a new formation type, and changing bit types, among other events. These static MSE parameters include a mechanical efficiency ratio (MER) and the drill bit diameter (DIA).

The MSE parameters may be obtained substantially or entirely automatically, with little or no user input required. For example, during the first iteration through the steps of the method 600*a*, the static MSE parameters may be retrieved via automatic query of a database. Consequently, during subsequent iterations, the static MSE parameters may not require repeated retrieval, such as where the drill bit type or formation data has not changed from the previous iteration of the method 600*a*. Therefore, execution of the step 602 may, in many iterations, require only the detection of the dynamic MSE parameters. The detection of the dynamic MSE parameters may be performed by or otherwise in association with a variety of sensors, such as the sensors shown in FIGS. 1, 3, 4A and/or 4B.

A subsequent step 604 in the method 600*a* includes calculating MSE. In an exemplary embodiment, MSE is calculated according to the following formula:

$$MSE=MER\times[(4\times WOB)/(\pi\times DIA^2)+(480\times RPM\times TOR)/(ROP\times DIA^2)]$$

where: MSE=mechanical specific energy (pounds per square inch);

MER=mechanical efficiency (ratio);

WOB=weight on bit (pounds);

DIA=drill bit diameter (inches);

RPM=bit rotational speed (rpm);

TOR=drill string rotational torque (foot-pounds); and

ROP=rate of penetration (feet per hour).

MER may also be referred to as a drill bit efficiency factor. In an exemplary embodiment, MER equals 0.35. However, MER may change based on one or more various conditions, such as the bit type, formation type, and/or other factors.

The method 600*a* also includes a decisional step 606, during which the MSE calculated during the previous step 604 is compared to an ideal MSE. The ideal MSE used for comparison during the decisional step 606 may be a single value, such as 100%. Alternatively, the ideal MSE used for comparison during the decisional step 606 may be a target range of values, such as 90-100%. Alternatively, the ideal MSE may be a range of values derived from an advanced analysis of the area being drilled that accounts for the various formations that are being drilled in the current operation.

If it is determined during step 606 that the MSE calculated during step 604 equals the ideal MSE, or falls within the ideal MSE range, the method 600*a* may be iterated by proceeding once again to step 602. However, if it is determined during step 606 that the calculated MSE does not equal the ideal MSE, or does not fall within the ideal MSE range, an additional step 608 is performed. During step 608, one or more operating parameters are adjusted with the intent of bringing the MSE closer to the ideal MSE value or within the ideal MSE range. For example, referring to FIGS. 1 and 6A, collectively, execution of step 608 may include increasing or decreasing WOB, RPM, and/or TOR by transmitting a control signal from the controller 190 to the top drive 140 and/or the draw works 130 to change RPM, TOR, and/or WOB. After step 608 is performed, the method 600*a* may be iterated by proceeding once again to step 602.

Each of the steps of the method 600*a* may be performed automatically. For example, automated detection of dynamic MSE parameters and database look-up of static MSE parameters have already been described above with respect to step 602. The controller 190 of FIG. 1 (and others described herein) may be configured to automatically perform the MSE calculation of step 604, and may also be configured to automatically perform the MSE comparison of decisional step 606, where both the MSE calculation and comparison may be performed periodically, at random intervals, or otherwise. The controller may also be configured to automatically generate and transmit the control signals of step 608, such as in response to the MSE comparison of step 606.

Figure 6B:
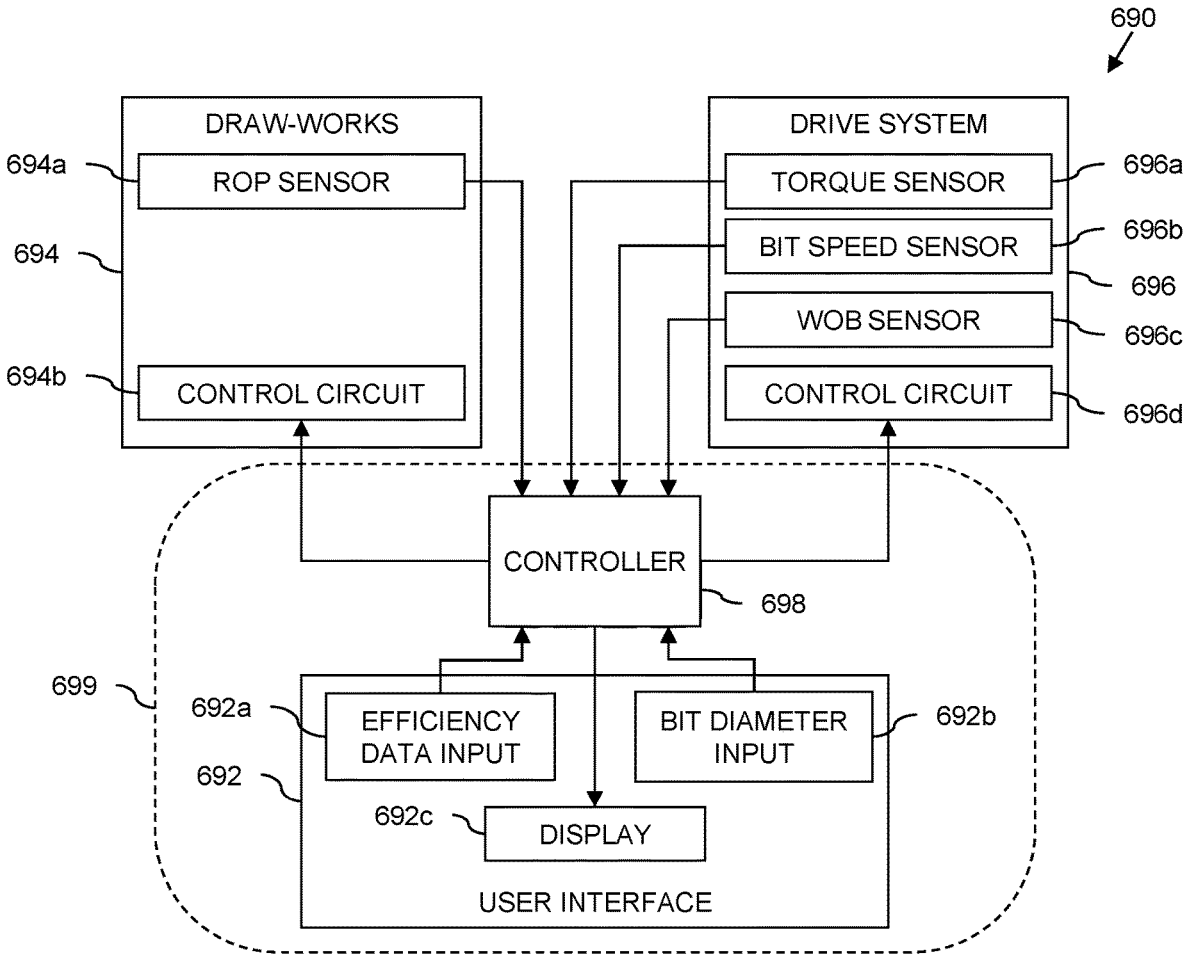
FIG. 6B is a schematic diagram of an apparatus according to one or more aspects of the present disclosure.

FIG. 6B illustrates a block diagram of apparatus 690 according to one or more aspects of the present disclosure. Apparatus 690 includes a user interface 692, a draw-works 694, a drive system 696, and a controller 698. Apparatus 690 may be implemented within the environment and/or apparatus shown in FIGS. 1, 3, and 4A-4C. For example, the draw-works 694 may be substantially similar to the draw-works 130 shown in FIG. 1, the drive system 696 may be substantially similar to the top drive 140 shown in FIG. 1, and/or the controller 698 may be substantially similar to the controller 190 shown in FIG. 1. Apparatus 690 may also be utilized in performing the method 200*a* shown in FIG. 2A, the method 200*b* shown in FIG. 2B, the method 500 in FIG. 5A, and/or the method 600*a* shown in FIG. 6A.

The user-interface 692 and the controller 698 may be discrete components that are interconnected via wired or wireless means. However, the user-interface 692 and the controller 698 may alternatively be integral components of a single system 699, as indicated by the dashed lines in FIG. 6B.

The user-interface 692 includes means 692*a* for user-input of one or more predetermined efficiency data (e.g., MER) values and/or ranges, and means 692*b* for user-input of one or more predetermined bit diameters (e.g., DIA) values and/or ranges. Each of the data input means 692*a* and 692*b* may include a keypad, voice-recognition apparatus, dial, button, switch, slide selector, toggle, joystick, mouse, data base (e.g., with offset information) and/or other conventional or future-developed data input device. Such data input means may support data input from local and/or remote locations. Alternatively, or additionally, the data input means 692*a* and/or 692*b* may include means for user-selection of predetermined MER and DIA values or ranges, such as via one or more drop-down menus. The MER and DIA data may also or alternatively be selected by the controller 698 via the execution of one or more database look-up procedures. In general, the data input means and/or other components within the scope of the present disclosure may support system operation and/or monitoring from stations on the rig site as well as one or more remote locations with a communications link to the system, network, local area network (LAN), wide area network (WAN), Internet, and/or radio, among other means.

The user-interface 692 may also include a display 692*c* for visually presenting information to the user in textual, graphical or video form. The display 692*c* may also be utilized by the user to input the MER and DIA data in conjunction with the data input means 692*a* and 692*b*. For example, the predetermined efficiency and bit diameter data input means 692*a* and 692*b* may be integral to or otherwise communicably coupled with the display 692*c*.

The draw-works 694 includes an ROP sensor 694*a* that is configured for detecting an ROP value or range, and may be substantially similar to the ROP sensor 130*a* shown in FIG. 1. The ROP data detected via the ROP sensor 694*a* may be sent via electronic signal to the controller 698 via wired or wireless transmission. The draw-works 694 also includes a control circuit 694*b* and/or other means for controlling feed-out and/or feed-in of a drilling line (such as the drilling line 125 shown in FIG. 1).

The drive system 696 includes a torque sensor 696*a* that is configured for detecting a value or range of the reactive torsion of the drill string (e.g., TOR), much the same as the torque sensor 140*a* and drill string 155 shown in FIG. 1. The drive system 696 also includes a bit speed sensor 696*b* that is configured for detecting a value or range of the rotational speed of the drill bit within the wellbore (e.g., RPM), much the same as the bit speed sensor 140*b*, drill bit 175 and wellbore 160 shown in FIG. 1. The drive system 696 also includes a WOB sensor 696*c* that is configured for detecting a WOB value or range, much the same as the WOB sensor 140*c* shown in FIG. 1. Alternatively, or additionally, the WOB sensor 696*c* may be located separate from the drive system 696, whether in another component shown in FIG. 6B or elsewhere. The drill string torsion, bit speed, and WOB data detected via sensors 696*a*, 696*b* and 696*c*, respectively, may be sent via electronic signal to the controller 698 via wired or wireless transmission. The drive system 696 also includes a control circuit 696*d* and/or other means for controlling the rotational position, speed and direction of the quill or other drill string component coupled to the drive system 696 (such as the quill 145 shown in FIG. 1). The control circuit 696*d* and/or other component of the drive system 696 may also include means for controlling downhole mud motor(s). Thus, RPM within the scope of the present disclosure may include mud pump flow data converted to downhole mud motor RPM, which may be added to the string RPM to determine total bit RPM.

The controller 698 is configured to receive the above-described MSE parameters from the user interface 692, the draw-works 694, and the drive system 696 and utilize the MSE parameters to continuously, periodically, or otherwise calculate MSE. The controller 698 is further configured to provide a signal to the draw-works 694 and/or the drive system 696 based on the calculated MSE. For example, the controller 6980 may execute the method 200*a* shown in FIG. 2A and/or the method 200*b* shown in FIG. 2B, and consequently provide one or more signals to the draw-works 694 and/or the drive system 696 to increase or decrease WOB and/or bit speed, such as may be required to optimize drilling efficiency (based on MSE).

Figure 6C:
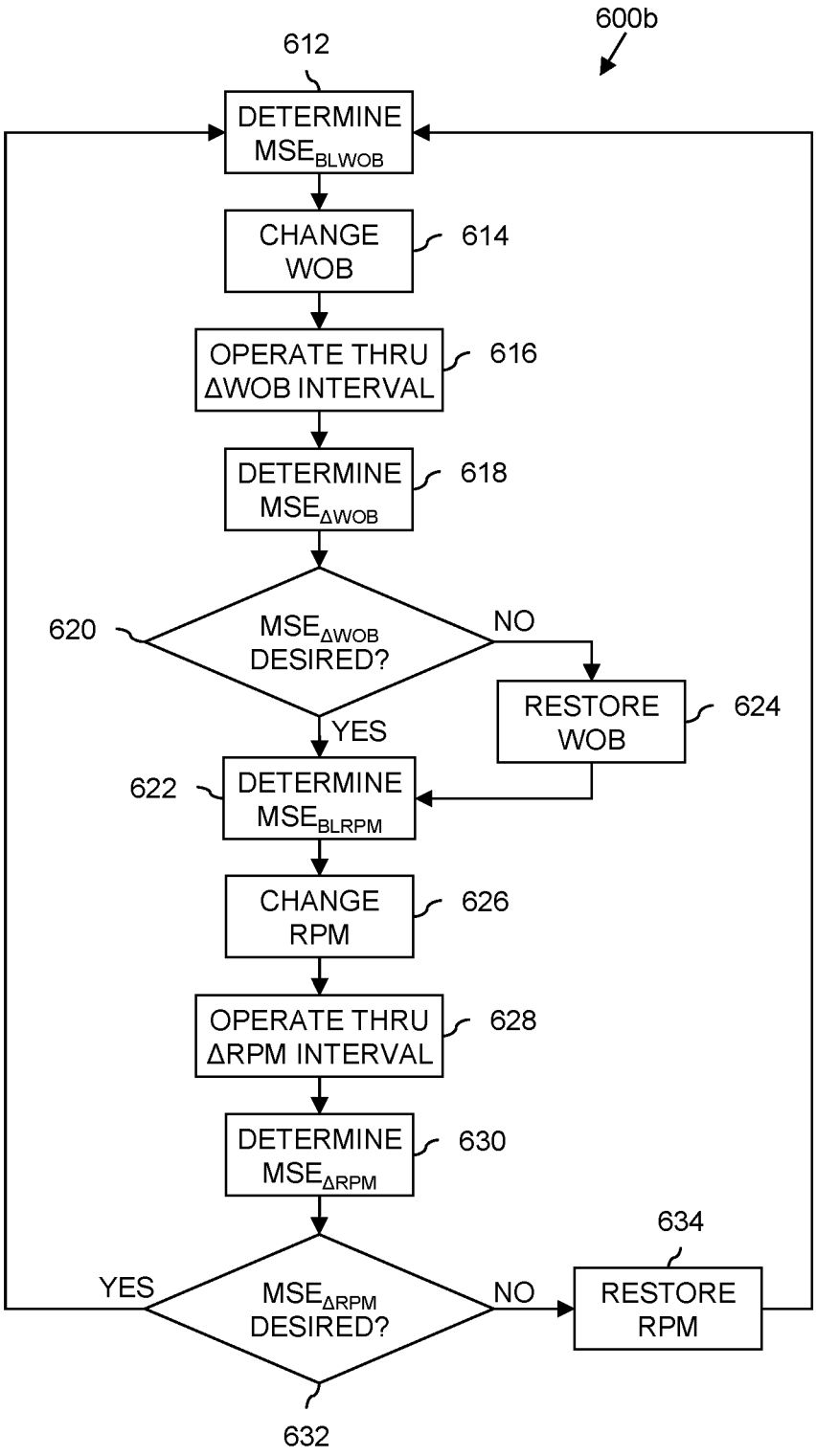
FIGS. 6C-6D are flow-chart diagrams of methods according to one or more aspects of the present disclosure.

Referring to FIG. 6C, illustrated is a flow-chart diagram of a method 600*b* for optimizing drilling operation based on real-time calculated MSE according to one or more aspects of the present disclosure. The data obtained may be used in cooperation with any of the systems disclosed herein. The method 600*b* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 690 shown in FIG. 6B. The method 600*b* may also be performed in conjunction with the performance of the method 200*a* shown in FIG. 2A, the method 200*b* shown in FIG. 2B, and/or the method 600*a* shown in FIG. 6A. The method 600*b* shown in FIG. 6C may include or form at least a portion of the method 600*a* shown in FIG. 6A.

During a step 612 of the method 600*b*, a baseline MSE is determined for optimization of drilling efficiency based on MSE by varying WOB. Because the baseline MSE determined in step 612 will be utilized for optimization by varying WOB, the convention $MSE_{BLWOB}$ will be used herein.

In a subsequent step 614, the WOB is changed. Such change can include either increasing or decreasing the WOB. The increase or decrease of WOB during step 614 may be within certain, predefined WOB limits. For example, the WOB change may be no greater than about 10%.

However, other percentages are also within the scope of the present disclosure, including where such percentages are within or beyond the predefined WOB limits. The WOB may be manually changed via operator input, or the WOB may be automatically changed via signals transmitted by a controller, control system, and/or other component of the drilling rig and associated apparatus. As above, such signals may be via remote control from another location.

Thereafter, during a step 616, drilling continues with the changed WOB during a predetermined drilling interval ΔWOB. The ΔWOB interval may be a predetermined time period, such as five minutes, ten minutes, thirty minutes, or some other duration. Alternatively, the ΔWOB interval may be a predetermined drilling progress depth. For example, step 616 may include continuing drilling operation with the changed WOB until the existing wellbore is extended five feet, ten feet, fifty feet, or some other depth. The ΔWOB interval may also include both a time and a depth component. For example, the ΔWOB interval may include drilling for at least thirty minutes or until the wellbore is extended ten feet. In another example, the ΔWOB interval may include drilling until the wellbore is extended twenty feet, but no longer than ninety minutes. Of course, the above-described time and depth values for the ΔWOB interval are merely examples, and many other values are also within the scope of the present disclosure.

After continuing drilling operation through the ΔWOB interval with the changed WOB, a step 618 is performed to determine the $MSE_{\Delta WOB}$ resulting from operating with the changed WOB during the ΔWOB interval. In a subsequent decisional step 620, the changed $MSE_{\Delta WOB}$ is compared to the baseline $MSE_{BLWOB}$. If the changed $MSE_{\Delta WOB}$ is desirable relative to the $MSE_{BLWOB}$, the method 600*b* continues to a step 622. However, if the changed $MSE_{\Delta WOB}$ is not desirable relative to the $MSE_{BLWOB}$, the method 600*b* continues to a step 624 where the WOB is restored to its value before step 614 was performed, and the method then continues to step 622.

The determination made during decisional step 620 may be performed manually or automatically by a controller, control system, and/or other component of the drilling rig and associated apparatus. The determination may include finding the $MSE_{\Delta WOB}$ to be desirable if it is substantially equal to and/or less than the $MSE_{BLWOB}$. However, additional or alternative factors may also play a role in the determination made during step 620.

During step 622 of the method 600*b*, a baseline MSE is determined for optimization of drilling efficiency based on MSE by varying the bit rotational speed, RPM. Because the baseline MSE determined in step 622 will be utilized for optimization by varying RPM, the convention $MSE_{BLRPM}$ will be used herein.

In a subsequent step 626, the RPM is changed. Such change can include either increasing or decreasing the RPM. The increase or decrease of RPM during step 626 may be within certain, predefined RPM limits. For example, the RPM change may be no greater than about 10%. However, other percentages are also within the scope of the present disclosure, including where such percentages are within or beyond the predefined RPM limits. The RPM may be manually changed via operator input, or the RPM may be automatically changed via signals transmitted by a controller, control system, and/or other component of the drilling rig and associated apparatus.

Thereafter, during a step 628, drilling continues with the changed RPM during a predetermined drilling interval ΔRPM. The ΔRPM interval may be a predetermined time period, such as five minutes, ten minutes, thirty minutes, or some other duration. Alternatively, the ΔRPM interval may be a predetermined drilling progress depth. For example, step 628 may include continuing drilling operation with the changed RPM until the existing wellbore is extended five feet, ten feet, fifty feet, or some other depth. The ΔRPM interval may also include both a time and a depth component. For example, the ΔRPM interval may include drilling for at least thirty minutes or until the wellbore is extended ten feet. In another example, the ΔRPM interval may include drilling until the wellbore is extended twenty feet, but no longer than ninety minutes. Of course, the above-described time and depth values for the ΔRPM interval are merely examples, and many other values are also within the scope of the present disclosure.

After continuing drilling operation through the ΔRPM interval with the changed RPM, a step 630 is performed to determine the $MSE_{\Delta RPM}$ resulting from operating with the changed RPM during the ΔRPM interval. In a subsequent decisional step 632, the changed $MSE_{\Delta RPM}$ is compared to the baseline $MSE_{BLRPM}$. If the changed $MSE_{\Delta RPM}$ is desirable relative to the $MSE_{BLRPM}$, the method 600*b* returns to step 612. However, if the changed $MSE_{\Delta RPM}$ is not desirable relative to the $MSE_{BLRPM}$, the method 600*b* continues to step 634 where the RPM is restored to its value before step 626 was performed, and the method then continues to step 612.

The determination made during decisional step 632 may be performed manually or automatically by a controller, control system, and/or other component of the drilling rig and associated apparatus. The determination may include finding the $MSE_{\Delta RPM}$ to be desirable if it is substantially equal to and/or less than the $MSE_{BLRPM}$. However, additional or alternative factors may also play a role in the determination made during step 632.

Moreover, after steps 632 and/or 634 are performed, the method 600*b* may not immediately return to step 612 for a subsequent iteration. For example, a subsequent iteration of the method 600*b* may be delayed for a predetermined time interval or drilling progress depth. Alternatively, the method 600*b* may end after the performance of steps 632 and/or 634.

Figure 6D:
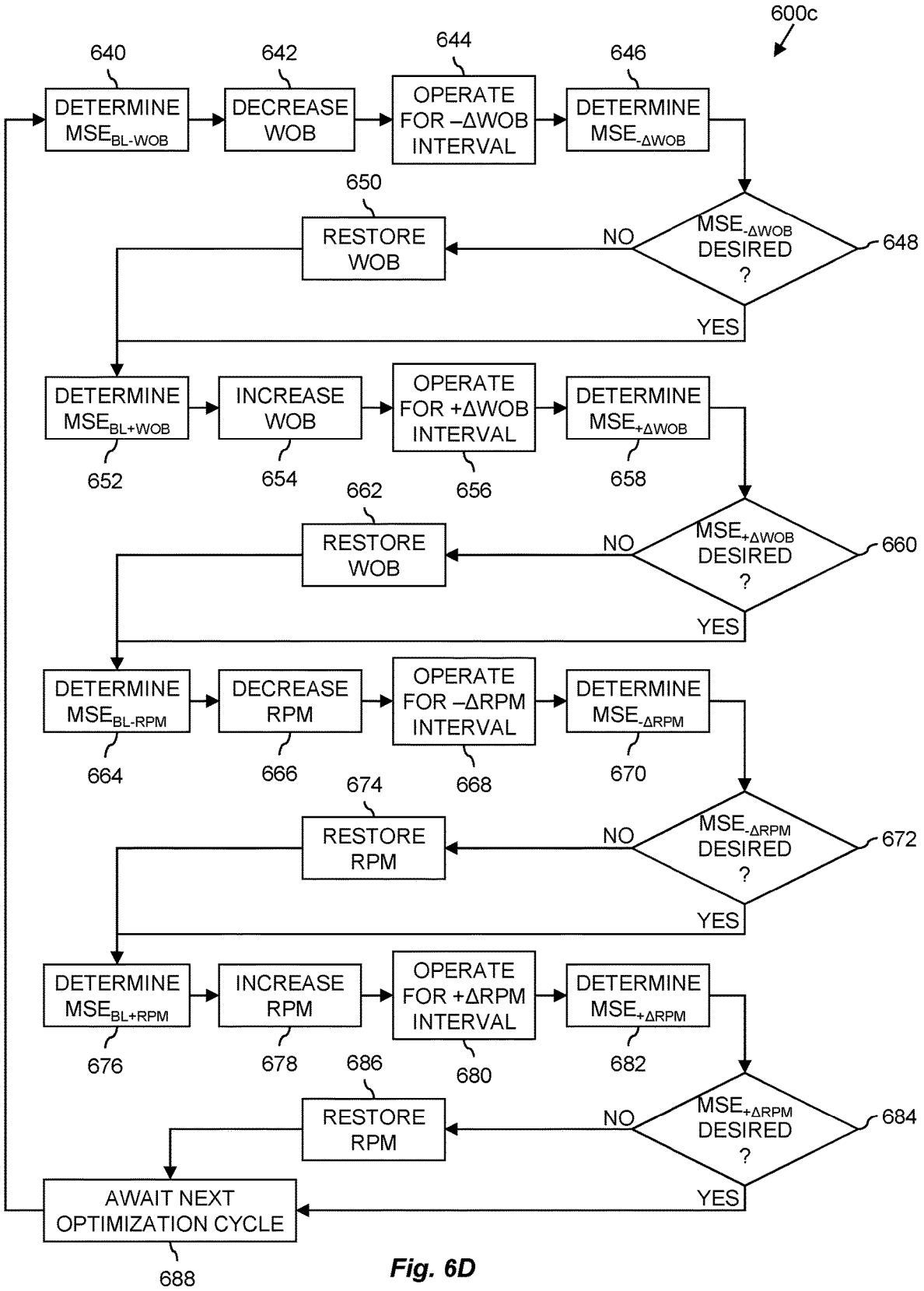

Referring to FIG. 6D, illustrated is a flow-chart diagram of a method 600*c* for optimizing drilling operation based on real-time calculated MSE according to one or more aspects of the present disclosure. The method 600*c* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 690 shown in FIG. 6B. The method 600*c* may also be performed in conjunction with the performance of the method 200*a* shown in FIG. 2A, the method 200*b* shown in FIG. 2B, the method 600*a* shown in FIG. 6A, and/or the method 600*b* shown in FIG. 6C. The method 600*c* shown in FIG. 6D may include or form at least a portion of the method 600*a* shown in FIG. 6A and/or the method 600*b* shown in FIG. 6C.

During a step 640 of the method 600*c*, a baseline MSE is determined for optimization of drilling efficiency based on MSE by decreasing WOB. Because the baseline MSE determined in step 640 will be utilized for optimization by decreasing WOB, the convention $MSE_{BL\text{-}WOB}$ will be used herein.

In a subsequent step 642, the WOB is decreased. The decrease of WOB during step 642 may be within certain, predefined WOB limits. For example, the WOB decrease may be no greater than about 10%. However, other percentages are also within the scope of the present disclosure, including where such percentages are within or beyond the predefined WOB limits. The WOB may be manually decreased via operator input, or the WOB may be automatically decreased via signals transmitted by a controller, control system, and/or other component of the drilling rig and associated apparatus.

Thereafter, during a step 644, drilling continues with the decreased WOB during a predetermined drilling interval −ΔWOB. The −ΔWOB interval may be a predetermined time period, such as five minutes, ten minutes, thirty minutes, or some other duration. Alternatively, the −ΔWOB interval may be a predetermined drilling progress depth. For example, step 644 may include continuing drilling operation with the decreased WOB until the existing wellbore is extended five feet, ten feet, fifty feet, or some other depth. The −ΔWOB interval may also include both a time and a depth component. For example, the −ΔWOB interval may include drilling for at least thirty minutes or until the wellbore is extended ten feet. In another example, the −ΔWOB interval may include drilling until the wellbore is extended twenty feet, but no longer than ninety minutes. Of course, the above-described time and depth values for the −ΔWOB interval are merely examples, and many other values are also within the scope of the present disclosure.

After continuing drilling operation through the −ΔWOB interval with the decreased WOB, a step 646 is performed to determine the $MSE_{-\Delta WOB}$ resulting from operating with the decreased WOB during the −ΔWOB interval. In a subsequent decisional step 648, the decreased $MSE_{-\Delta WOB}$ is compared to the baseline $MSE_{BL\text{-}WOB}$. If the decreased $MSE_{-\Delta WOB}$ is desirable relative to the $MSE_{BL\text{-}WOB}$, the method 600*c* continues to a step 652. However, if the decreased $MSE_{-\Delta WOB}$ is not desirable relative to the $MSE_{BL\text{-}WOB}$, the method 600*c* continues to a step 650 where the WOB is restored to its value before step 642 was performed, and the method then continues to step 652.

The determination made during decisional step 648 may be performed manually or automatically by a controller, control system, and/or other component of the drilling rig and associated apparatus. The determination may include finding the $MSE_{-\Delta WOB}$ to be desirable if it is substantially equal to and/or less than the $MSE_{BL\text{-}WOB}$. However, additional or alternative factors may also play a role in the determination made during step 648.

During step 652 of the method 600*c*, a baseline MSE is determined for optimization of drilling efficiency based on MSE by increasing the WOB. Because the baseline MSE determined in step 652 will be utilized for optimization by increasing WOB, the convention $MSE_{BL+WOB}$ will be used herein.

In a subsequent step 654, the WOB is increased. The increase of WOB during step 654 may be within certain, predefined WOB limits. For example, the WOB increase may be no greater than about 10%. However, other percentages are also within the scope of the present disclosure, including where such percentages are within or beyond the predefined WOB limits. The WOB may be manually increased via operator input, or the WOB may be automatically increased via signals transmitted by a controller, control system, and/or other component of the drilling rig and associated apparatus.

Thereafter, during a step 656, drilling continues with the increased WOB during a predetermined drilling interval +ΔWOB. The +ΔWOB interval may be a predetermined time period, such as five minutes, ten minutes, thirty minutes, or some other duration. Alternatively, the +ΔWOB interval may be a predetermined drilling progress depth. For example, step 656 may include continuing drilling operation with the increased WOB until the existing wellbore is extended five feet, ten feet, fifty feet, or some other depth. The +ΔWOB interval may also include both a time and a depth component. For example, the +ΔWOB interval may include drilling for at least thirty minutes or until the wellbore is extended ten feet. In another example, the +ΔWOB interval may include drilling until the wellbore is extended twenty feet, but no longer than ninety minutes.

After continuing drilling operation through the +ΔWOB interval with the increased WOB, a step 658 is performed to determine the $MSE_{+\Delta WOB}$ resulting from operating with the increased WOB during the +ΔWOB interval. In a subsequent decisional step 660, the changed $MSE_{+\Delta WOB}$ is compared to the baseline $MSE_{BL+WOB}$. If the changed $MSE_{+\Delta WOB}$ is desirable relative to the $MSE_{BL+WOB}$, the method 600*c* continues to a step 664. However, if the changed $MSE_{+\Delta WOB}$ is not desirable relative to the $MSE_{BL+WOB}$, the method 600*c* continues to a step 662 where the WOB is restored to its value before step 654 was performed, and the method then continues to step 664.

The determination made during decisional step 660 may be performed manually or automatically by a controller, control system, and/or other component of the drilling rig and associated apparatus. The determination may include finding the $MSE_{+\Delta WOB}$ to be desirable if it is substantially equal to and/or less than the $MSE_{BL+WOB}$. However, additional or alternative factors may also play a role in the determination made during step 660.

During step 664 of the method 600*c*, a baseline MSE is determined for optimization of drilling efficiency based on MSE by decreasing the bit rotational speed, RPM. Because the baseline MSE determined in step 664 will be utilized for optimization by decreasing RPM, the convention $MSE_{BL\text{-}RPM}$ will be used herein.

In a subsequent step 666, the RPM is decreased. The decrease of RPM during step 666 may be within certain, predefined RPM limits. For example, the RPM decrease may be no greater than about 10%. However, other percentages are also within the scope of the present disclosure, including where such percentages are within or beyond the predefined RPM limits. The RPM may be manually decreased via operator input, or the RPM may be automatically decreased via signals transmitted by a controller, control system, and/or other component of the drilling rig and associated apparatus.

Thereafter, during a step 668, drilling continues with the decreased RPM during a predetermined drilling interval −ΔRPM. The −ΔRPM interval may be a predetermined time period, such as five minutes, ten minutes, thirty minutes, or some other duration. Alternatively, the −ΔRPM interval may be a predetermined drilling progress depth. For example, step 668 may include continuing drilling operation with the decreased RPM until the existing wellbore is extended five feet, ten feet, fifty feet, or some other depth. The −ΔRPM interval may also include both a time and a depth component. For example, the −ΔRPM interval may include drilling for at least thirty minutes or until the wellbore is extended ten feet. In another example, the −ΔRPM interval may include drilling until the wellbore is extended twenty feet, but no longer than ninety minutes.

After continuing drilling operation through the −ΔRPM interval with the decreased RPM, a step 670 is performed to determine the $MSE_{-\Delta RPM}$ resulting from operating with the decreased RPM during the −ΔRPM interval. In a subsequent decisional step 672, the decreased $MSE_{-\Delta RPM}$ is compared to the baseline $MSE_{BL\text{-}RPM}$. If the changed $MSE_{-\Delta RPM}$ is desirable relative to the $MSE_{BL-RPM}$, the method 600*c* continues to a step 676. However, if the changed $MSE_{-\Delta RPM}$ is not desirable relative to the $MSE_{BL-RPM}$, the method 600*c* continues to a step 674 where the RPM is restored to its value before step 666 was performed, and the method then continues to step 676.

The determination made during decisional step 672 may be performed manually or automatically by a controller, control system, and/or other component of the drilling rig and associated apparatus. The determination may include finding the $MSE_{-\Delta RPM}$ to be desirable if it is substantially equal to and/or less than the $MSE_{BL-RPM}$. However, additional or alternative factors may also play a role in the determination made during step 672.

During step 676 of the method 600*c*, a baseline MSE is determined for optimization of drilling efficiency based on MSE by increasing the bit rotational speed, RPM. Because the baseline MSE determined in step 676 will be utilized for optimization by increasing RPM, the convention $MSE_{BL+RPM}$ will be used herein.

In a subsequent step 678, the RPM is increased. The increase of RPM during step 678 may be within certain, predefined RPM limits. For example, the RPM increase may be no greater than about 10%. However, other percentages are also within the scope of the present disclosure, including where such percentages are within or beyond the predefined RPM limits. The RPM may be manually increased via operator input, or the RPM may be automatically increased via signals transmitted by a controller, control system, and/or other component of the drilling rig and associated apparatus.

Thereafter, during a step 680, drilling continues with the increased RPM during a predetermined drilling interval +ΔRPM. The +ΔRPM interval may be a predetermined time period, such as five minutes, ten minutes, thirty minutes, or some other duration. Alternatively, the +ΔRPM interval may be a predetermined drilling progress depth. For example, step 680 may include continuing drilling operation with the increased RPM until the existing wellbore is extended five feet, ten feet, fifty feet, or some other depth. The +ΔRPM interval may also include both a time and a depth component. For example, the +ΔRPM interval may include drilling for at least thirty minutes or until the wellbore is extended ten feet. In another example, the +ΔRPM interval may include drilling until the wellbore is extended twenty feet, but no longer than ninety minutes.

After continuing drilling operation through the +ΔRPM interval with the increased RPM, a step 682 is performed to determine the $MSE_{+\Delta RPM}$ resulting from operating with the increased RPM during the +ΔRPM interval. In a subsequent decisional step 684, the increased $MSE_{+\Delta RPM}$ is compared to the baseline $MSE_{BL+RPM}$. If the changed $MSE_{+\Delta RPM}$ is desirable relative to the $MSE_{BL+RPM}$, the method 600*c* continues to a step 688. However, if the changed $MSE_{+\Delta RPM}$ is not desirable relative to the $MSE_{BL+RPM}$, the method 600*c* continues to a step 686 where the RPM is restored to its value before step 678 was performed, and the method then continues to step 688.

The determination made during decisional step 684 may be performed manually or automatically by a controller, control system, and/or other component of the drilling rig and associated apparatus. The determination may include finding the $MSE_{+\Delta RPM}$ to be desirable if it is substantially equal to and/or less than the $MSE_{BL+RPM}$. However, additional or alternative factors may also play a role in the determination made during step 684.

Step 688 includes awaiting a predetermined time period or drilling depth interval before reiterating the method 600*c* by returning to step 640. However, in an exemplary embodiment, the interval may be as small as 0 seconds or 0 feet, such that the method returns to step 640 substantially immediately after performing steps 684 and/or 686. Alternatively, the method 600*c* may not require iteration, such that the method 600*c* may substantially end after the performance of steps 684 and/or 686.

Moreover, the drilling intervals −ΔWOB, +ΔWOB, −ΔRPM and +ΔROM may each be substantially identical within a single iteration of the method 600*c*. Alternatively, one or more of the intervals may vary in duration or depth relative to the other intervals. Similarly, the amount that the WOB is decreased and increased in steps 642 and 654 may be substantially identical or may vary relative to each other within a single iteration of the method 600*c*. The amount that the RPM is decreased and increased in steps 666 and 678 may be substantially identical or may vary relative to each other within a single iteration of the method 600*c*. The WOB and RPM variances may also change or stay the same relative to subsequent iterations of the method 600*c*.

As described above, one or more aspects of the present disclosure may be utilized for drilling operation or control based on MSE. However, one or more aspects of the present disclosure may additionally or alternatively be utilized for drilling operation or control based on ΔT. That is, as described above, during drilling operation, torque is transmitted from the top drive or other rotary drive to the drill string. The torque required to drive the bit may be referred to as the Torque On Bit (TOB), and may be monitored utilizing a sensor such as the torque sensor 140*a* shown in FIG. 1, the torque sensor 355 shown in FIG. 3, one or more of the sensors 430 shown in FIGS. 4A and 4B, the torque sensor 696*a* shown in FIG. 6B, and/or one or more torque sensing devices of the BHA.

The drill string undergoes various types of vibration during drilling, including axial (longitudinal) vibrations, bending (lateral) vibrations, and torsional (rotational) vibrations. The torsional vibrations are caused by nonlinear interaction between the bit, the drill string, and the wellbore. As described above, this torsional vibration can include stick-slip vibration, characterized by alternating stops (during which the BHA "sticks" to the wellbore) and intervals of large angular velocity of the BHA (during which the BHA "slips" relative to the wellbore).

The stick-slip behavior of the BHA causes real-time variations of TOB, or ΔT. This ΔT may be utilized to support a Stick Slip Alarm (SSA) according to one or more aspects of the present disclosure. For example, a ΔT or SSA parameter may be displayed visually with a "Stop Light" indicator, where a green light may indicate an acceptable operating condition (e.g., SSA parameter of 0-15), an amber light may indicate that stick-slip behavior is imminent (e.g., SSA parameter of 16-25), and a red light may indicate that stick-slip behavior is likely occurring (e.g., SSA parameter above 25). However, these example thresholds may be adjustable during operation, as they may change with the drilling conditions. The ΔT or SSA parameter may alternatively or additionally be displayed graphically (e.g., showing current and historical data), audibly (e.g., via an annunciator), and/or via a meter or gauge display. Combinations of these display options are also within the scope of the present disclosure. For example, the above-described "Stop Light" indicator may continuously indicate the SSA parameter regardless of its value, and an audible alarm may be triggered if the SSA parameter exceeds a predetermined value (e.g., 25).

A drilling operation controller or other apparatus within the scope of the present disclosure may have integrated therein one or more aspects of drilling operation or control based on ΔT or the SSA parameter as described above. For example, a controller such as the controller 190 shown in FIG. 1, the controller 325 shown in FIG. 3, controller 420 shown in FIG. 4A or 4B, and/or the controller 698 shown in FIG. 6B may be configured to automatically adjust the drill string RPM with a short burst of increased or decreased RPM (e.g., +/−5 RPM) to disrupt the harmonic of stick-slip vibration, either prior to or when stick-slip is detected, and then return to normal RPM. The controller may be configured to automatically step RPM up or down by a predetermined or user-adjustable quantity or percentage for a predetermined or user-adjustable duration, in attempt to move drilling operation out of the harmonic state. Alternatively, the controller may be configured to automatically continue to adjust RPM up or down incrementally until the ΔT or SSA parameter indicates that the stick-slip operation has been halted.

In an exemplary embodiment, the ΔT or SSA-enabled controller may be further configured to automatically reduce WOB if stick slip is severe, such as may be due to an excessively high target WOB. Such automatic WOB reduction may include a single adjustment or incremental adjustments, whether temporary or long-term, and which may be sustained until the ΔT or SSA parameter indicates that the stick-slip operation has been halted.

The ΔT or SSA-enabled controller may be further configured to automatically increase WOB, such as to find the upper WOB stick-slip limit. For example, if all other possible drilling parameters are optimized or adjusted to within corresponding limits, the controller may automatically increase WOB incrementally until the ΔT or SSA parameter nears or equals its upper limit (e.g., 25).

In an exemplary embodiment, ΔT-based drilling operation or control according to one or more aspects of the present disclosure may function according to one or more aspects of the following pseudo-code:

```
IF (counter <= Process_Time)
IF (counter = = 1)
Minimum_Torque = Realtime_Torque
PRINT ("Minimum", Minimum_Torque)
Maximum_Torque = Realtime_Torque
PRINT ("Maximum", Maximum_Torque)
END
IF (Realtime_Torque < Minimum_Torque)
Minimum_Torque = Realtime_Torque
END
IF (Maximum_Torque < Realtime_Torque)
Maximum_Torque = Realtime_Torque
END
Torque_counter = (Torque_counter + Realtime_Torque)
Average_Torque = (Torque_counter / counter)
counter = counter + 1
PRINT ("Process_Time", Process_Time)
ELSE
SSA = ((Maximum_Torque − Minimum_Torque) / Average_Torque)
* 100
```

where Process_Time is the time elapsed since monitoring of the ΔT or SSA parameter commenced, Minimum_Torque is the minimum TOB which occurred during Process_Time, Maximum_Torque is the maximum TOB which occurred during Process_Time, Realtime_Torque is current TOB, Average_Torque is the average TOB during Process_Time, and SSA is the Stick-Slip Alarm parameter.

Figure 7A:
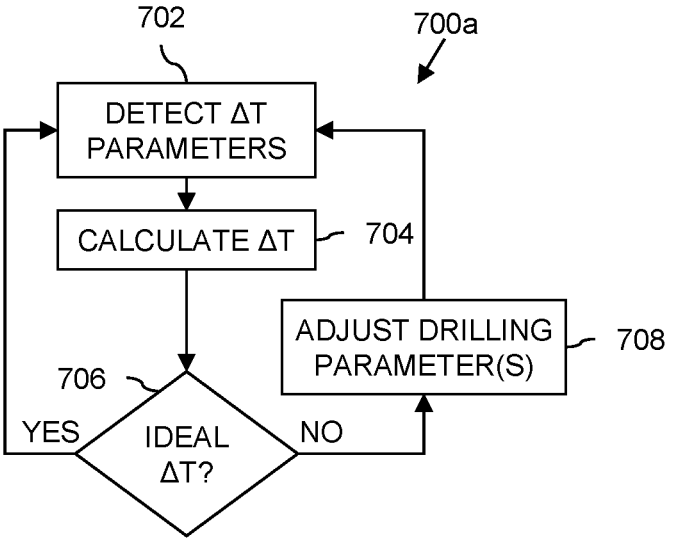
FIGS. 7A-7C are flow-chart diagrams of methods according to one or more aspects of the present disclosure.

As described above, the ΔT or SSA parameter may be utilized within or otherwise according to the method 200*a* shown in FIG. 2A, the method 200*b* shown in FIG. 2B, the method 600*a* shown in FIG. 6A, the method 600*b* shown in FIG. 6C, and/or the method 600*c* shown in FIG. 6D. For example, as shown in FIG. 7A, the ΔT or SSA parameter may be substituted for the MSE parameter described above with reference to FIG. 6A. Alternatively, the ΔT or SSA parameter may be monitored in addition to the MSE parameter described above with reference to FIG. 6A, such that drilling operation or control is based on both MSE and the ΔT or SSA parameter.

Referring to FIG. 7A, illustrated is a flow-chart diagram of a method 700*a* according to one or more aspects of the present disclosure. The method 700*a* may be performed in association with one or more components of the apparatus 100 shown in FIG. 1, the apparatus 300 shown in FIG. 3, the apparatus 400*a* shown in FIG. 4A, the apparatus 400*b* shown in FIG. 4B, and/or the apparatus 690 shown in FIG. 6B, during operation thereof.

The method 700*a* includes a step 702 during which current ΔT parameters are measured. In a subsequent step 704, the ΔT is calculated. If the ΔT is sufficiently equal to the desired ΔT or otherwise ideal, as determined during decisional step 706, the method 700*a* is iterated and the step 702 is repeated. "Ideal" may be as described above. The iteration of the method 700*a* may be substantially immediate, or there may be a delay period before the method 700*a* is iterated and the step 702 is repeated. If the ΔT is not ideal, as determined during decisional step 706, the method 700*a* continues to a step 708 during which one or more drilling parameters (e.g., WOB, RPM, etc.) are adjusted in attempt to improve the ΔT. After step 708 is performed, the method 700*a* is iterated and the step 702 is repeated. Such iteration may be substantially immediate, or there may be a delay period before the method 700*a* is iterated and the step 702 is repeated.

Figure 7B:
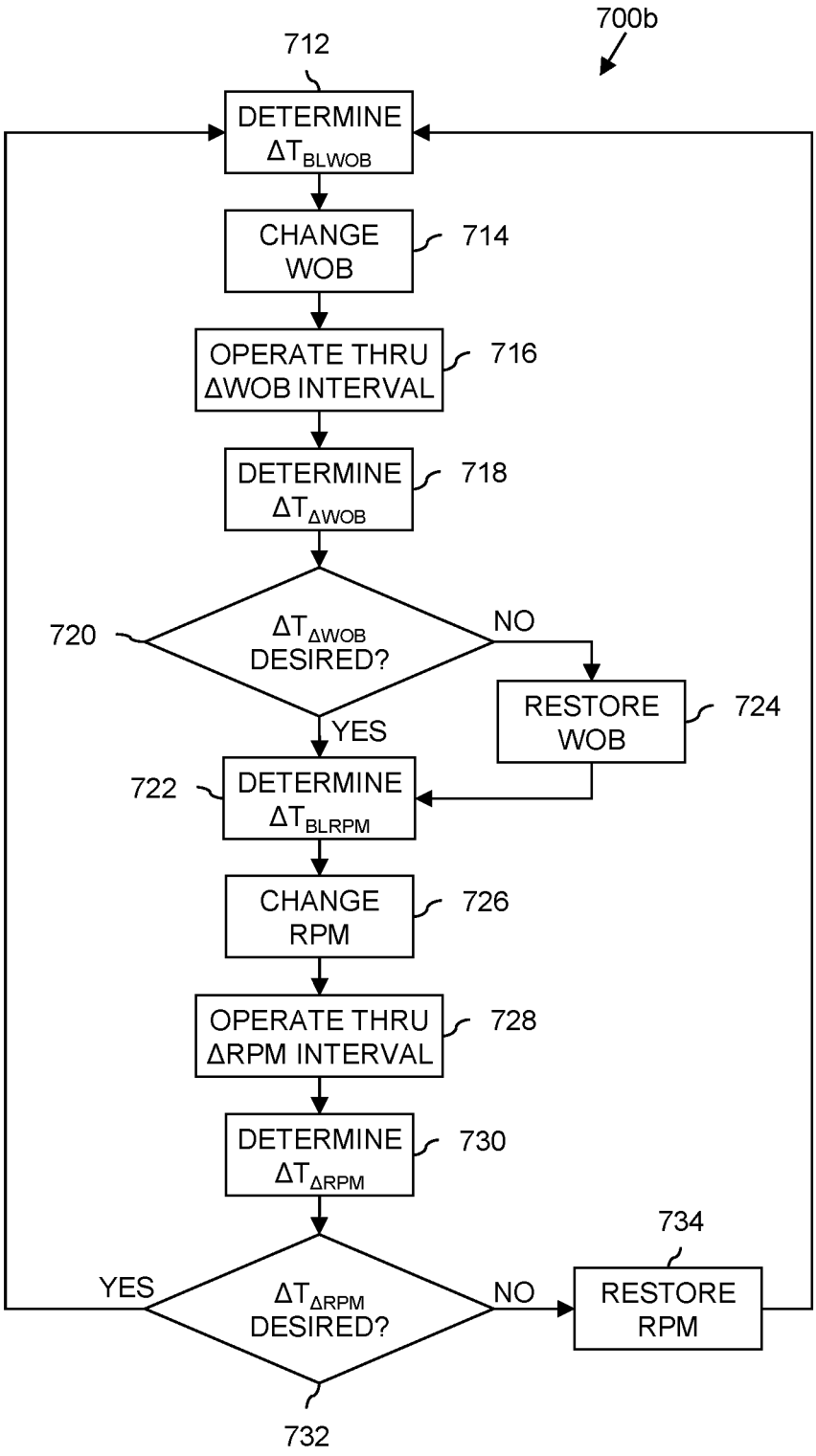

Referring to FIG. 7B, illustrated is a flow-chart diagram of a method 700*b* for monitoring ΔT and/or SSA according to one or more aspects of the present disclosure. The method 700*b* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 690 shown in FIG. 6B. The method 700*b* may also be performed in conjunction with the performance of the method 200*a* shown in FIG. 2A, the method 200*b* shown in FIG. 2B, the method 600*a* shown in FIG. 6A, the method 600*b* shown in FIG. 6C, the method 600*c* shown in FIG. 6D, and/or the method 700*a* shown in FIG. 7A. The method 700*b* shown in FIG. 7B may include or form at least a portion of the method 700*a* shown in FIG. 7A.

During a step 712 of the method 700*b*, a baseline ΔT is determined for optimization based on ΔT by varying WOB. Because the baseline ΔT determined in step 712 will be utilized for optimization by varying WOB, the convention $\Delta T_{BLWOB}$ will be used herein.

In a subsequent step 714, the WOB is changed. Such change can include either increasing or decreasing the WOB. The increase or decrease of WOB during step 714 may be within certain, predefined WOB limits. For example, the WOB change may be no greater than about 10%. However, other percentages are also within the scope of the present disclosure, including where such percentages are within or beyond the predefined WOB limits. The WOB may be manually changed via operator input, or the WOB may be automatically changed via signals transmitted by a controller, control system, and/or other component of the drilling rig and associated apparatus. As above, such signals may be via remote control from another location.

Thereafter, during a step 716, drilling continues with the changed WOB during a predetermined drilling interval ΔWOB. The ΔWOB interval may be a predetermined time period, such as five minutes, ten minutes, thirty minutes, or some other duration. Alternatively, the ΔWOB interval may be a predetermined drilling progress depth. For example, step 716 may include continuing drilling operation with the changed WOB until the existing wellbore is extended five feet, ten feet, fifty feet, or some other depth. The ΔWOB interval may also include both a time and a depth component. For example, the ΔWOB interval may include drilling for at least thirty minutes or until the wellbore is extended ten feet. In another example, the ΔWOB interval may include drilling until the wellbore is extended twenty feet, but no longer than ninety minutes. Of course, the above-described time and depth values for the ΔWOB interval are merely examples, and many other values are also within the scope of the present disclosure.

After continuing drilling operation through the ΔWOB interval with the changed WOB, a step 718 is performed to determine the $\Delta T_{\Delta WOB}$ resulting from operating with the changed WOB during the ΔWOB interval. In a subsequent decisional step 720, the changed $\Delta T_{\Delta WOB}$ is compared to the baseline $\Delta T_{BLWOB}$. If the changed $\Delta T_{\Delta WOB}$ is desirable relative to the $\Delta T_{BLWOB}$, the method 700*b* continues to a step 722. However, if the changed $\Delta T_{\Delta WOB}$ is not desirable relative to the $\Delta T_{BLWOB}$, the method 700*b* continues to a step 724 where the WOB is restored to its value before step 714 was performed, and the method then continues to step 722.

The determination made during decisional step 720 may be performed manually or automatically by a controller, control system, and/or other component of the drilling rig and associated apparatus. The determination may include finding the $\Delta T_{\Delta WOB}$ to be desirable if it is substantially equal to and/or less than the $\Delta T_{BLWOB}$. However, additional or alternative factors may also play a role in the determination made during step 720.

During step 722 of the method 700*b*, a baseline ΔT is determined for optimization based on ΔT by varying the bit rotational speed, RPM. Because the baseline ΔT determined in step 722 will be utilized for optimization by varying RPM, the convention $\Delta T_{BLRPM}$ will be used herein.

In a subsequent step 726, the RPM is changed. Such change can include either increasing or decreasing the RPM. The increase or decrease of RPM during step 726 may be within certain, predefined RPM limits. For example, the RPM change may be no greater than about 10%. However, other percentages are also within the scope of the present disclosure, including where such percentages are within or beyond the predefined RPM limits. The RPM may be manually changed via operator input, or the RPM may be automatically changed via signals transmitted by a controller, control system, and/or other component of the drilling rig and associated apparatus.

Thereafter, during a step 728, drilling continues with the changed RPM during a predetermined drilling interval ΔRPM. The ΔRPM interval may be a predetermined time period, such as five minutes, ten minutes, thirty minutes, or some other duration. Alternatively, the ΔRPM interval may be a predetermined drilling progress depth. For example, step 728 may include continuing drilling operation with the changed RPM until the existing wellbore is extended five feet, ten feet, fifty feet, or some other depth. The ΔRPM interval may also include both a time and a depth component. For example, the ΔRPM interval may include drilling for at least thirty minutes or until the wellbore is extended ten feet. In another example, the ΔRPM interval may include drilling until the wellbore is extended twenty feet, but no longer than ninety minutes. Of course, the above-described time and depth values for the ΔRPM interval are merely examples, and many other values are also within the scope of the present disclosure.

After continuing drilling operation through the ΔRPM interval with the changed RPM, a step 730 is performed to determine the $\Delta T_{\Delta RPM}$ resulting from operating with the changed RPM during the ΔRPM interval. In a subsequent decisional step 732, the changed $\Delta T_{\Delta RPM}$ is compared to the baseline $\Delta T_{BLRPM}$. If the changed $\Delta T_{\Delta RPM}$ is desirable relative to the $\Delta T_{BLRPM}$, the method 700*b* returns to step 712. However, if the changed $\Delta T_{\Delta RPM}$ is not desirable relative to the $\Delta T_{BLRPM}$, the method 700*b* continues to step 734 where the RPM is restored to its value before step 726 was performed, and the method then continues to step 712.

The determination made during decisional step 732 may be performed manually or automatically by a controller, control system, and/or other component of the drilling rig and associated apparatus. The determination may include finding the $\Delta T_{\Delta RPM}$ to be desirable if it is substantially equal to and/or less than the $\Delta T_{BLRPM}$. However, additional or alternative factors may also play a role in the determination made during step 732.

Moreover, after steps 732 and/or 734 are performed, the method 700*b* may not immediately return to step 712 for a subsequent iteration. For example, a subsequent iteration of the method 700*b* may be delayed for a predetermined time interval or drilling progress depth. Alternatively, the method 700*b* may end after the performance of steps 732 and/or 734.

Figure 7C:
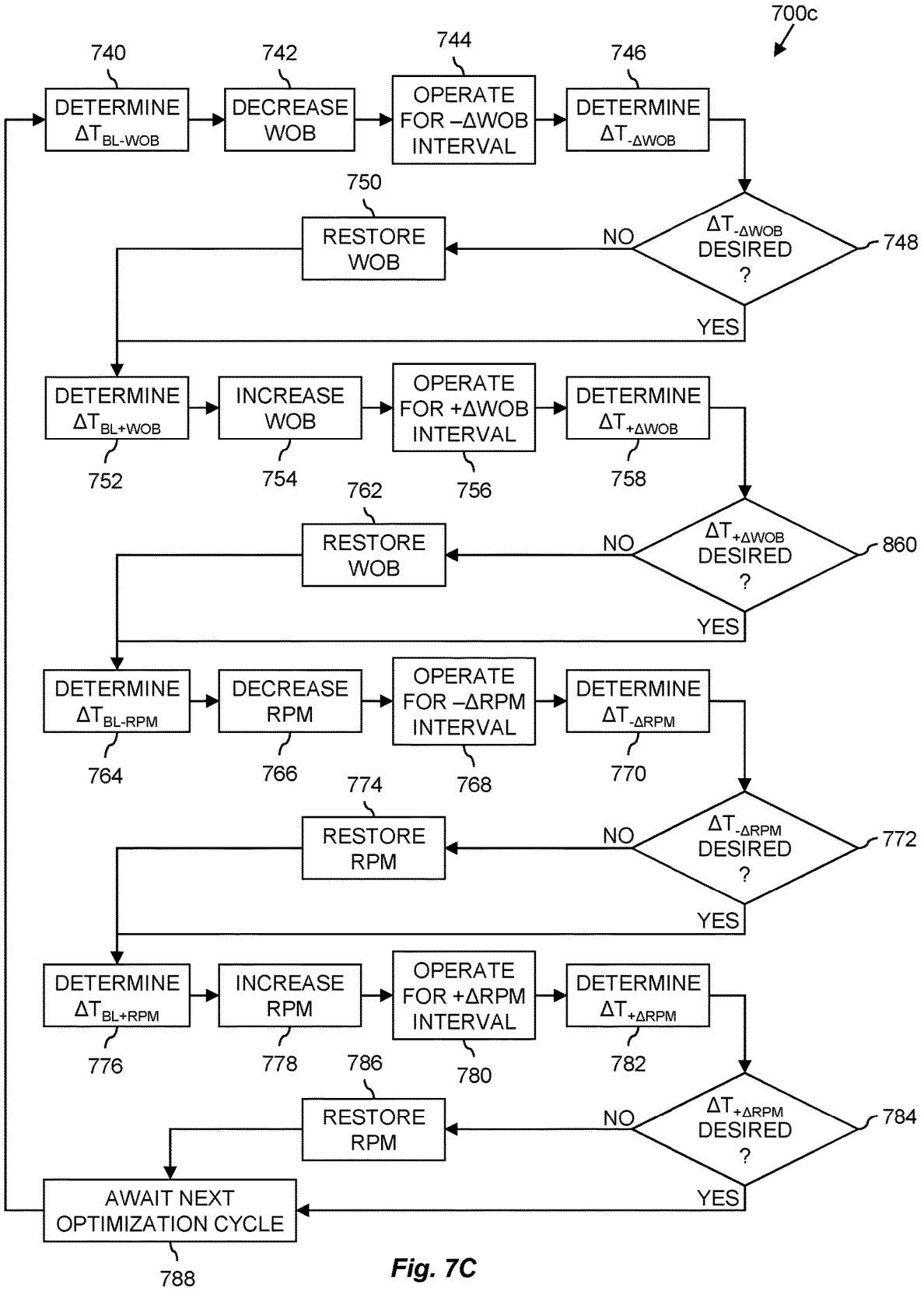

Referring to FIG. 7C, illustrated is a flow-chart diagram of a method 700*c* for optimizing drilling operation based on real-time calculated ΔT according to one or more aspects of the present disclosure. The method 700*c* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 690 shown in FIG. 6B. The method 700*c* may also be performed in conjunction with the performance of the method 200*a* shown in FIG. 2A, the method 200*b* shown in FIG. 2B, the method 600*a* shown in FIG. 6A, the method 600*b* shown in FIG. 6C, the method 600*c* shown in FIG. 6D, the method 700*a* shown in FIG. 7A, and/or the method 700*b* shown in FIG. 7B. The method 700*c* shown in FIG. 7C may include or form at least a portion of the method 700*a* shown in FIG. 7A and/or the method 700*b* shown in FIG. 7B.

During a step 740 of the method 700*c*, a baseline ΔT is determined for optimization based on ΔT by decreasing WOB. Because the baseline ΔT determined in step 740 will be utilized for optimization by decreasing WOB, the convention $\Delta T_{BL\text{-}WOB}$ will be used herein.

In a subsequent step 742, the WOB is decreased. The decrease of WOB during step 742 may be within certain, predefined WOB limits. For example, the WOB decrease may be no greater than about 10%. However, other percentages are also within the scope of the present disclosure, including where such percentages are within or beyond the predefined WOB limits. The WOB may be manually decreased via operator input, or the WOB may be automatically decreased via signals transmitted by a controller, control system, and/or other component of the drilling rig and associated apparatus.

Thereafter, during a step 744, drilling continues with the decreased WOB during a predetermined drilling interval −ΔWOB. The −ΔWOB interval may be a predetermined time period, such as five minutes, ten minutes, thirty minutes, or some other duration. Alternatively, the −ΔWOB interval may be a predetermined drilling progress depth. For example, step 744 may include continuing drilling operation with the decreased WOB until the existing wellbore is extended five feet, ten feet, fifty feet, or some other depth. The −ΔWOB interval may also include both a time and a depth component. For example, the −ΔWOB interval may include drilling for at least thirty minutes or until the wellbore is extended ten feet. In another example, the −ΔWOB interval may include drilling until the wellbore is extended twenty feet, but no longer than ninety minutes. Of course, the above-described time and depth values for the −ΔWOB interval are merely examples, and many other values are also within the scope of the present disclosure.

After continuing drilling operation through the −ΔWOB interval with the decreased WOB, a step 746 is performed to determine the $\Delta T_{-\Delta WOB}$ resulting from operating with the decreased WOB during the −ΔWOB interval. In a subsequent decisional step 748, the decreased $\Delta T_{-\Delta WOB}$ is compared to the baseline $\Delta T_{BL\text{-}WOB}$. If the decreased $\Delta T_{-\Delta WOB}$ is desirable relative to the $\Delta T_{BL\text{-}WOB}$, the method 700*c* continues to a step 752. However, if the decreased $\Delta T_{-\Delta WOB}$ is not desirable relative to the $\Delta T_{BL\text{-}WOB}$, the method 700*c* continues to a step 750 where the WOB is restored to its value before step 742 was performed, and the method then continues to step 752.

The determination made during decisional step 748 may be performed manually or automatically by a controller, control system, and/or other component of the drilling rig and associated apparatus. The determination may include finding the $\Delta T_{-\Delta WOB}$ to be desirable if it is substantially equal to and/or less than the $\Delta T_{BL\text{-}WOB}$. However, additional or alternative factors may also play a role in the determination made during step 748.

During step 752 of the method 700*c*, a baseline ΔT is determined for optimization based on ΔT by increasing the WOB. Because the baseline ΔT determined in step 752 will be utilized for optimization by increasing WOB, the convention $\Delta T_{BL+WOB}$ will be used herein.

In a subsequent step 754, the WOB is increased. The increase of WOB during step 754 may be within certain, predefined WOB limits. For example, the WOB increase may be no greater than about 10%. However, other percentages are also within the scope of the present disclosure, including where such percentages are within or beyond the predefined WOB limits. The WOB may be manually increased via operator input, or the WOB may be automatically increased via signals transmitted by a controller, control system, and/or other component of the drilling rig and associated apparatus.

Thereafter, during a step 756, drilling continues with the increased WOB during a predetermined drilling interval +ΔWOB. The +ΔWOB interval may be a predetermined time period, such as five minutes, ten minutes, thirty minutes, or some other duration. Alternatively, the +ΔWOB interval may be a predetermined drilling progress depth. For example, step 756 may include continuing drilling operation with the increased WOB until the existing wellbore is extended five feet, ten feet, fifty feet, or some other depth. The +ΔWOB interval may also include both a time and a depth component. For example, the +ΔWOB interval may include drilling for at least thirty minutes or until the wellbore is extended ten feet. In another example, the +ΔWOB interval may include drilling until the wellbore is extended twenty feet, but no longer than ninety minutes.

After continuing drilling operation through the +ΔWOB interval with the increased WOB, a step 758 is performed to determine the $\Delta T_{+\Delta WOB}$ resulting from operating with the increased WOB during the +ΔWOB interval. In a subsequent decisional step 760, the changed $\Delta T_{+\Delta WOB}$ is compared to the baseline $\Delta T_{BL+WOB}$. If the changed $\Delta T_{+\Delta WOB}$ is desirable relative to the $\Delta T_{BL+WOB}$, the method 700*c* continues to a step 764. However, if the changed $\Delta T_{+\Delta WOB}$ is not desirable relative to the $\Delta T_{BL+WOB}$, the method 700*c* continues to a step 762 where the WOB is restored to its value before step 754 was performed, and the method then continues to step 764.

The determination made during decisional step 760 may be performed manually or automatically by a controller, control system, and/or other component of the drilling rig and associated apparatus. The determination may include finding the $\Delta T_{+\Delta WOB}$ to be desirable if it is substantially equal to and/or less than the $\Delta T_{BL+WOB}$. However, additional or alternative factors may also play a role in the determination made during step 760.

During step 764 of the method 700*c*, a baseline ΔT is determined for optimization based on ΔT by decreasing the bit rotational speed, RPM. Because the baseline ΔT determined in step 764 will be utilized for optimization by decreasing RPM, the convention $\Delta T_{BL\text{-}RPM}$ will be used herein.

In a subsequent step 766, the RPM is decreased. The decrease of RPM during step 766 may be within certain, predefined RPM limits. For example, the RPM decrease may be no greater than about 10%. However, other percentages are also within the scope of the present disclosure, including where such percentages are within or beyond the predefined RPM limits. The RPM may be manually decreased via operator input, or the RPM may be automatically decreased via signals transmitted by a controller, control system, and/or other component of the drilling rig and associated apparatus.

Thereafter, during a step 768, drilling continues with the decreased RPM during a predetermined drilling interval −ΔRPM. The −ΔRPM interval may be a predetermined time period, such as five minutes, ten minutes, thirty minutes, or some other duration. Alternatively, the −ΔRPM interval may be a predetermined drilling progress depth. For example, step 768 may include continuing drilling operation with the decreased RPM until the existing wellbore is extended five feet, ten feet, fifty feet, or some other depth. The −ΔRPM interval may also include both a time and a depth component. For example, the −ΔRPM interval may include drilling for at least thirty minutes or until the wellbore is extended ten feet. In another example, the −ΔRPM interval may include drilling until the wellbore is extended twenty feet, but no longer than ninety minutes.

After continuing drilling operation through the −ΔRPM interval with the decreased RPM, a step 770 is performed to determine the $\Delta T_{-\Delta RPM}$ resulting from operating with the decreased RPM during the −ΔRPM interval. In a subsequent decisional step 772, the decreased $\Delta T_{-\Delta RPM}$ is compared to the baseline $\Delta T_{BL\text{-}RPM}$. If the changed $\Delta T_{-\Delta RPM}$ is desirable relative to the $\Delta T_{BL\text{-}RPM}$, the method 700*c* continues to a step 776. However, if the changed $\Delta T_{-\Delta RPM}$ is not desirable relative to the $\Delta T_{BL\text{-}RPM}$, the method 700*c* continues to a step 774 where the RPM is restored to its value before step 766 was performed, and the method then continues to step 776.

The determination made during decisional step 772 may be performed manually or automatically by a controller, control system, and/or other component of the drilling rig and associated apparatus. The determination may include finding the $\Delta T_{-\Delta RPM}$ to be desirable if it is substantially equal to and/or less than the $\Delta T_{BL-RPM}$. However, additional or alternative factors may also play a role in the determination made during step 772.

During step 776 of the method 700*c*, a baseline ΔT is determined for optimization based on ΔT by increasing the bit rotational speed, RPM. Because the baseline ΔT determined in step 776 will be utilized for optimization by increasing RPM, the convention $\Delta T_{BL+RPM}$ will be used herein.

In a subsequent step 778, the RPM is increased. The increase of RPM during step 778 may be within certain, predefined RPM limits. For example, the RPM increase may be no greater than about 10%. However, other percentages are also within the scope of the present disclosure, including where such percentages are within or beyond the predefined RPM limits. The RPM may be manually increased via operator input, or the RPM may be automatically increased via signals transmitted by a controller, control system, and/or other component of the drilling rig and associated apparatus.

Thereafter, during a step 780, drilling continues with the increased RPM during a predetermined drilling interval +ΔRPM. The +ΔRPM interval may be a predetermined time period, such as five minutes, ten minutes, thirty minutes, or some other duration. Alternatively, the +ΔRPM interval may be a predetermined drilling progress depth. For example, step 780 may include continuing drilling operation with the increased RPM until the existing wellbore is extended five feet, ten feet, fifty feet, or some other depth. The +ΔRPM interval may also include both a time and a depth component. For example, the +ΔRPM interval may include drilling for at least thirty minutes or until the wellbore is extended ten feet. In another example, the +ΔRPM interval may include drilling until the wellbore is extended twenty feet, but no longer than ninety minutes.

After continuing drilling operation through the +ΔRPM interval with the increased RPM, a step 782 is performed to determine the $\Delta T_{+\Delta RPM}$ resulting from operating with the increased RPM during the +ΔRPM interval. In a subsequent decisional step 784, the increased $\Delta T_{+\Delta RPM}$ is compared to the baseline $\Delta T_{BL+RPM}$. If the changed $\Delta T_{+\Delta RPM}$ is desirable relative to the $\Delta T_{BL+RPM}$, the method 700*c* continues to a step 788. However, if the changed $\Delta T_{+\Delta RPM}$ is not desirable relative to the $\Delta T_{BL+RPM}$, the method 700*c* continues to a step 786 where the RPM is restored to its value before step 778 was performed, and the method then continues to step 788.

The determination made during decisional step 784 may be performed manually or automatically by a controller, control system, and/or other component of the drilling rig and associated apparatus. The determination may include finding the $\Delta T_{+\Delta RPM}$ to be desirable if it is substantially equal to and/or less than the $\Delta T_{BL+RPM}$. However, additional or alternative factors may also play a role in the determination made during step 784.

Step 788 includes awaiting a predetermined time period or drilling depth interval before reiterating the method 700*c* by returning to step 740. However, in an exemplary embodiment, the interval may be as small as 0 seconds or 0 feet, such that the method returns to step 740 substantially immediately after performing steps 784 and/or 786. Alternatively, the method 700*c* may not require iteration, such that the method 700*c* may substantially end after the performance of steps 784 and/or 786.

Moreover, the drilling intervals −ΔWOB, +ΔWOB, −ΔRPM and +ΔROM may each be substantially identical within a single iteration of the method 700*c*. Alternatively, one or more of the intervals may vary in duration or depth relative to the other intervals. Similarly, the amount that the WOB is decreased and increased in steps 742 and 754 may be substantially identical or may vary relative to each other within a single iteration of the method 700*c*. The amount that the RPM is decreased and increased in steps 766 and 778 may be substantially identical or may vary relative to each other within a single iteration of the method 700*c*. The WOB and RPM variances may also change or stay the same relative to subsequent iterations of the method 700*c*.

Figure 8A:
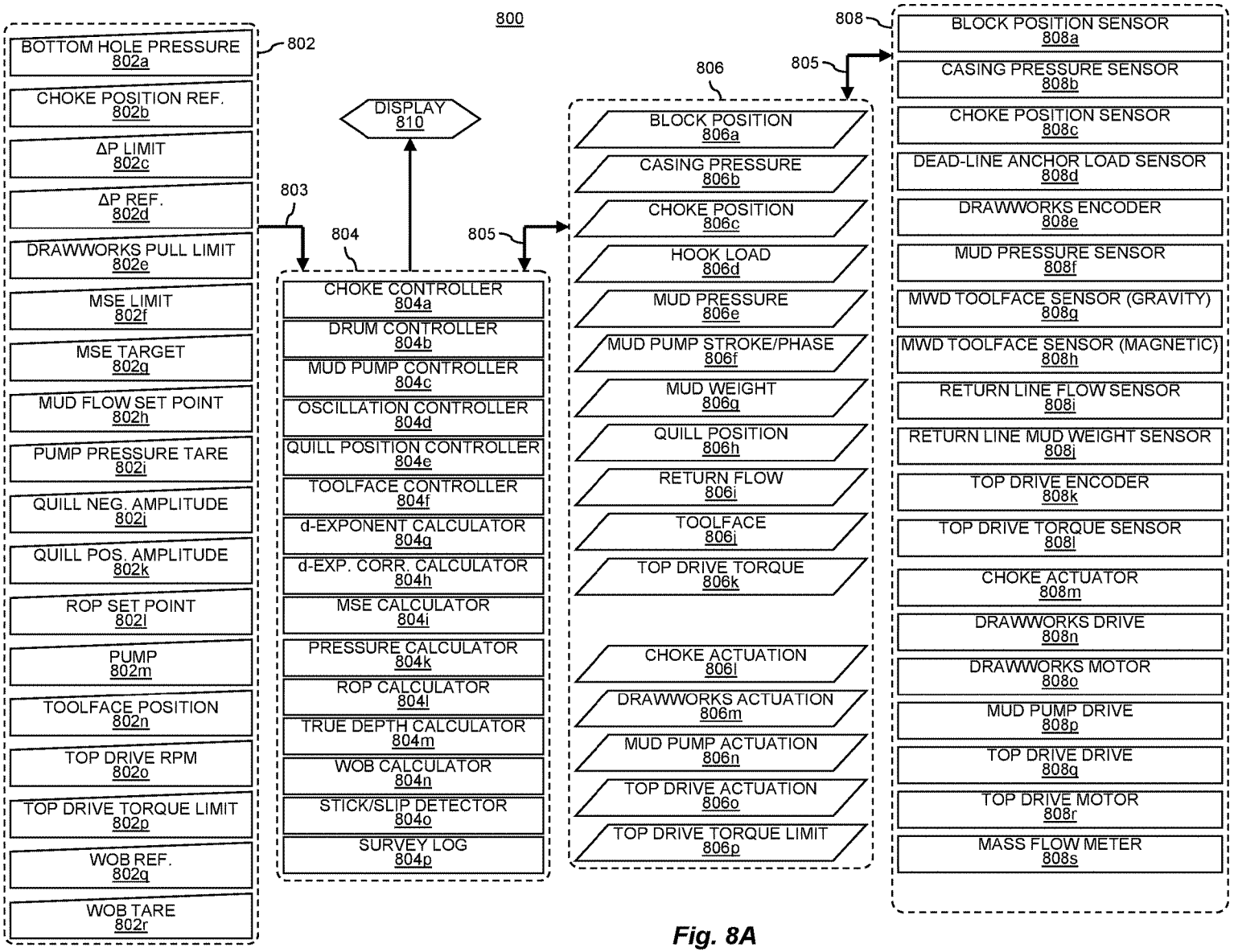
FIGS. 8A-8B are schematic diagrams of apparatuses according to one or more aspects of the present disclosure.

Referring to FIG. 8A, illustrated is a schematic view of apparatus 800 according to one or more aspects of the present disclosure. The apparatus 800 may include or compose at least a portion of the apparatus 100 shown in FIG. 1, the apparatus 300 shown in FIG. 3, the apparatus 400*a* shown in FIG. 4A, the apparatus 400*b* shown in FIG. 4B, the apparatus 400*c* in FIG. 4C, and/or the apparatus 690 shown in FIG. 6B. The apparatus 800 represents an exemplary embodiment in which one or more methods within the scope of the present disclosure may be performed or otherwise implemented, including the method 200*a* shown in FIG. 2A, the method 200*b* shown in FIG. 2B, the method 500 in FIG. 5A, the method 600*a* shown in FIG. 6A, the method 600*b* shown in FIG. 6C, the method 600*c* shown in FIG. 6D, the method 700*a* shown in FIG. 7A, the method 700*b* shown in FIG. 7B, and/or the method 700*c* shown in FIG. 7C.

The apparatus 800 includes a plurality of manual or automated data inputs, collectively referred to herein as inputs 802. The apparatus also includes a plurality of controllers, calculators, detectors, and other processors, collectively referred to herein as processors 804. Data from the various ones of the inputs 802 is transmitted to various ones of the processors 804, as indicated in FIG. 8A by the arrow 803. The apparatus 800 also includes a plurality of sensors, encoders, actuators, drives, motors, and other sensing, measurement, and actuation devices, collectively referred to herein as devices 808. Various data and signals, collectively referred to herein as data 806, are transmitted between various ones of the processors 804 and various ones of the devices 808, as indicated in FIG. 8A by the arrows 805.

The apparatus 800 may also include, be connected to, or otherwise be associated with a display 810, which may be driven by or otherwise receive data from one or more of the processors 804, if not also from other components of the apparatus 800. The display 810 may also be referred to herein as a human-machine interface (HMI), although such HMI may further include one or more of the inputs 802 and/or processors 804.

In the exemplary embodiment shown in FIG. 8A, the inputs 802 include means for providing the following set points, limits, ranges, and other data:

bottom hole pressure input 802*a;*
choke position reference input 802*b;*
ΔP limit input 802*c;*
ΔP reference input 802*d;*
drawworks pull limit input 802*e;*
MSE limit input 802*f;*
MSE target input 802*g;*
mud flow set point input 802*h;*
pump pressure tare input 802*i;*
quill negative amplitude input 802*j;*
quill positive amplitude input 802*k;*
ROP set point input 802*l;*
pump input 802*m;* toolface position input 802*n;*
top drive RPM input 802*o;*
top drive torque limit input 802*p;*
WOB reference input 802*q*; and
WOB tare input 802*r*.

However, the inputs 802 may include means for providing additional or alternative set points, limits, ranges, and other data within the scope of the present disclosure.

The bottom hole pressure input 802*a* may indicate a value of the maximum desired pressure of the gaseous and/or other environment at the bottom end of the wellbore. Alternatively, the bottom hole pressure input 802*a* may indicate a range within which it is desired that the pressure at the bottom of the wellbore be maintained. Such pressure may be expressed as an absolute pressure or a gauge pressure (e.g., relative to atmospheric pressure or some other predetermined pressure).

The choke position reference input 802*b* may be a set point or value indicating the desired choke position. Alternatively, the choke position reference input 802*b* may indicate a range within which it is desired that the choke position be maintained. The choke may be a device having an orifice or other means configured to control fluid flow rate and/or pressure. The choke may be positioned at the end of a choke line, which is a high-pressure pipe leading from an outlet on the BOP stack, whereby the fluid under pressure in the wellbore can flow out of the well through the choke line to the choke, thereby reducing the fluid pressure (e.g., to atmospheric pressure). The choke position reference input 802*b* may be a binary indicator expressing the choke position as either "opened" or "closed." Alternatively, the choke position reference input 802*b* may be expressed as a percentage indicating the extent to which the choke is partially opened or closed.

The ΔP limit input 802*c* may be a value indicating the maximum or minimum pressure drop across the mud motor. Alternatively, the ΔP limit input 802*c* may indicate a range within which it is desired that the pressure drop across the mud motor be maintained. The ΔP reference input 802*d* may be a set point or value indicating the desired pressure drop across the mud motor. In an exemplary embodiment, the ΔP limit input 802*c* is a value indicating the maximum desired pressure drop across the mud motor, and the ΔP reference input 802*d* is a value indicating the nominal desired pressure drop across the mud motor.

The drawworks pull limit input 802*e* may be a value indicating the maximum force to be applied to the drawworks by the drilling line (e.g., when supporting the drill string off-bottom or pulling on equipment stuck in the wellbore). For example, the drawworks pull limit input 802*e* may indicate the maximum hook load that should be supported by the drawworks during operation. The drawworks pull limit input 802*e* may be expressed as the maximum weight or drilling line tension that can be supported by the drawworks without damaging the drawworks, drilling line, and/or other equipment.

The MSE limit input 802*f* may be a value indicating the maximum or minimum MSE desired during drilling. Alternatively, the MSE limit input 802*f* may be a range within which it is desired that the MSE be maintained during drilling. As discussed above, the actual value of the MSE is at least partially dependent upon WOB, bit diameter, bit speed, drill string torque, and ROP, each of which may be adjusted according to aspects of the present disclosure to maintain the desired MSE. The MSE target input 802*g* may be a value indicating the desired MSE, or a range within which it is desired that the MSE be maintained during drilling. In an exemplary embodiment, the MSE limit input 802*f* is a value or range indicating the maximum and/or minimum MSE, and the MSE target input 802*g* is a value indicating the desired nominal MSE.

The mud flow set point input 802*h* may be a value indicating the maximum, minimum, or nominal desired mud flow rate output by the mud pump. Alternatively, the mud flow set point input 802*h* may be a range within which it is desired that the mud flow rate be maintained. The pump pressure tare input 802*i* may be a value indicating the current, desired, initial, surveyed, or other mud pump pressure tare. The mud pump pressure tare generally accounts for the difference between the mud pressure and the casing or wellbore pressure when the drill string is off bottom.

The quill negative amplitude input 802*j* may be a value indicating the maximum desired quill rotation from the quill oscillation neutral point in a first angular direction, whereas the quill positive amplitude input 802*k* may be a value indicating the maximum desired quill rotation from the quill oscillation neutral point in an opposite angular direction. For example, during operation of the top drive to oscillate the quill, the quill negative amplitude input 802*j* may indicate the maximum desired clockwise rotation of the quill past the oscillation neutral point, and the quill positive amplitude input 802*k* may indicate the maximum desired counterclockwise rotation of the quill past the oscillation neutral point.

The ROP set point input 802*l* may be a value indicating the maximum, minimum, or nominal desired ROP. Alternatively, the ROP set point input 802*l* may be range within which it is desired that the ROP be maintained.

The pump input 802*m* may be a value indicating a maximum, minimum, or nominal desired flow rate, power, speed (e.g., strokes-per-minute), and/or other operating parameter related to operation of the mud pump. For example, the mud pump may actually include more than one pump, and the pump input 802*m* may indicate a desired maximum or nominal aggregate pressure, flow rate, or other parameter of the output of the multiple mud pumps, or whether a pump system is operating in conjunction with the multiple mud pumps.

The toolface position input 802*n* may be a value indicating the desired orientation of the toolface. Alternatively, the toolface position input 802*n* may be a range within which it is desired that the toolface be maintained. The toolface position input 802*n* may be expressed as one or more angles relative to a fixed or predetermined reference. For example, the toolface position input 802*n* may represent the desired toolface azimuth orientation relative to true North and/or the desired toolface inclination relative to vertical. As discussed above, in some embodiments, this is input directly, or may be based upon a planned drilling path. While drilling using the method in FIG. 5A, the toolface orientation may be calculated based upon other data, such as survey data or trend data and the amount of deviation from a planned drilling path. This may be a value considered in order to steer the BHA along a modified drilling path.

The top drive RPM input 802*o* may be a value indicating a maximum, minimum, or nominal desired rotational speed of the top drive. Alternatively, the top drive RPM input 802*o* may be a range within which it is desired that the top drive rotational speed be maintained. The top drive torque limit input 802*p* may be a value indicating a maximum torque to be applied by the top drive.

The WOB reference input 802*q* may be a value indicating a maximum, minimum, or nominal desired WOB resulting from the weight of the drill string acting on the drill bit, although perhaps also taking into account other forces affecting WOB, such as friction between the drill string an the wellbore. Alternatively, the WOB reference input 802*q* may be a range in which it is desired that the WOB be maintained. The WOB tare input 802*r* may be a value indicating the current, desired, initial, survey, or other WOB tare, which takes into account the hook load and drill string weight when off bottom.

One or more of the inputs 802 may include a keypad, voice-recognition apparatus, dial, joystick, mouse, data base and/or other conventional or future-developed data input device. One or more of the inputs 802 may support data input from local and/or remote locations. One or more of the inputs 802 may include means for user-selection of predetermined set points, values, or ranges, such as via one or more drop-down menus. One or more of the inputs 802 may also or alternatively be configured to enable automated input by one or more of the processors 804, such as via the execution of one or more database look-up procedures. One or more of the inputs 802, possibly in conjunction with other components of the apparatus 800, may support operation and/or monitoring from stations on the rig site as well as one or more remote locations. Each of the inputs 802 may have individual means for input, although two or more of the inputs 802 may collectively have a single means for input. One or more of the inputs 802 may be configured to allow human input, although one or more of the inputs 802 may alternatively be configured for the automatic input of data by computer, software, module, routine, database lookup, algorithm, calculation, and/or otherwise. One or more of the inputs 802 may be configured for such automatic input of data but with an override function by which a human operator may approve or adjust the automatically provided data.

In the exemplary embodiment shown in FIG. 8A, the devices 808 include:

a block position sensor 808*a;*
a casing pressure sensor 808*b;*
a choke position sensor 808*c;*
a dead-line anchor load sensor 808*d;*
a drawworks encoder 808*e;*
a mud pressure sensor 808*f;*
an MWD toolface gravity sensor 808*g;*
an MWD toolface magnetic sensor 808*h;*
a return line flow sensor 808*i;*
a return line mud weight sensor 808*j;*
a top drive encoder 808*k;*
a top drive torque sensor 808*l;*
a choke actuator 808*m;*
a drawworks drive 808*n;*
a drawworks motor 808*o;*
a mud pump drive 808*p;*
a top drive drive 808*q*; and
a top drive motor 808*r.*

However, the devices 808 may include additional or alternative devices within the scope of the present disclosure. The devices 808 are configured for operation in conjunction with corresponding ones of a drawworks, a choke, a mud pump, a top drive, a block, a drill string, and/or other components of the rig. Alternatively, the devices 808 also include one or more of these other rig components.

The block position sensor 808*a* may be or include an optical sensor, a radio-frequency sensor, an optical or other encoder, or another type of sensor configured to sense the relative or absolute vertical position of the block. The block position sensor 808*a* may be coupled to or integral with the block, the crown, the drawworks, and/or another component of the apparatus 800 or rig.

The casing pressure sensor 808*b* is configured to detect the pressure in the annulus defined between the drill string and the casing or wellbore, and may be or include one or more transducers, strain gauges, and/or other devices for detecting pressure changes or otherwise sensing pressure. The casing pressure sensor 808*b* may be coupled to the casing, drill string, and/or another component of the apparatus 800 or rig, and may be positioned at or near the wellbore surface, slightly below the surface, or significantly deeper in the wellbore.

The choke position sensor 808*c* is configured to detect whether the choke is opened or closed, and may be further configured to detect the degree to which the choke is partially opened or closed. The choke position sensor 808*c* may be coupled to or integral with the choke, the choke actuator, and/or another component of the apparatus 800 or rig. The choke may alternatively maintain a set pressure or steady mass flow, e.g., based on a casing pressure. This can be measured with an optional mass flow meter 808*s*.

The dead-line anchor load sensor 808*d* is configured to detect the tension in the drilling line at or near the anchored end. It may include one or more transducers, strain gauges, and/or other sensors coupled to the drilling line.

The drawworks encoder 808*e* is configured to detect the rotational position of the drawworks spools around which the drilling line is wound. It may include one or more optical encoders, interferometers, and/or other sensors configured to detect the angular position of the spool and/or any change in the angular position of the spool. The drawworks encoder 808*e* may include one or more components coupled to or integral with the spool and/or a stationary portion of the drawworks.

The mud pressure sensor 808*f* is configured to detect the pressure of the hydraulic fluid output by the mud motor, and may be or include one or more transducers, strain gauges, and/or other devices for detecting fluid pressure. It may be coupled to or integral with the mud pump, and thus positioned at or near the surface opening of the wellbore.

The MWD toolface gravity sensor 808*g* is configured to detect the toolface orientation based on gravity. The MWD toolface magnetic sensor 808*h* is configured to detect the toolface orientation based on magnetic field. These sensors 808*g* and 808*h* may be coupled to or integral with the MWD assembly, and are thus positioned downhole.

The return line flow sensor 808*i* is configured to detect the flow rate of mud within the return line, and may be expressed in gallons/minute. The return line mud weight sensor 808*j* is configured to detect the weight of the mud flowing within the return line. These sensors 808*i* and 808*j* may be coupled to the return flow line, and may thus be positioned at or near the surface opening of the wellbore.

The top drive encoder 808*k* is configured to detect the rotational position of the quill. It may include one or more optical encoders, interferometers, and/or other sensors configured to detect the angular position of the quill, and/or any change in the angular position of the quill, relative to the top drive, true North, or some other fixed reference point. The top drive torque sensor 808*l* is configured to detect the torque being applied by the top drive, or the torque necessary to rotate the quill or drill string at the current rate. These sensors 808*k* and 808*l* may be coupled to or integral with the top drive.

The choke actuator 808*m* is configured to actuate the choke to configure the choke in an opened configuration, a closed configured, and/or one or more positions between fully opened and fully closed. It may be hydraulic, pneumatic, mechanical, electrical, or combinations thereof.

The drawworks drive 808*n* is configured to provide an electrical signal to the drawworks motor 808*o* for actuation thereof. The drawworks motor 808*o* is configured to rotate the spool around which the drilling line is wound, thereby feeding the drilling line in or out.

The mud pump drive 808*p* is configured to provide an electrical signal to the mud pump, thereby controlling the flow rate and/or pressure of the mud pump output. The top drive drive 808*q* is configured to provide an electrical signal to the top drive motor 808*r* for actuation thereof. The top drive motor 808*r* is configured to rotate the quill, thereby rotating the drill string coupled to the quill.

The devices 808 may (things applicable to most of the sensors)

In the exemplary embodiment shown in FIG. 8A, the data 806 which is transmitted between the devices 808 and the processors 804 includes:

block position 806*a;*
casing pressure 806*b;*
choke position 806*c;*
hook load 806*d;*
mud pressure 806*e;*
mud pump stroke/phase 806*f;*
mud weight 806*g;*
quill position 806*h;*
return flow 806*i;*
toolface 806*j;*
top drive torque 806*k;*
choke actuation signal 806*l;*
drawworks actuation signal 806*m;*
mud pump actuation signal 806*n;*
top drive actuation signal 806*o*; and
top drive torque limit signal 806*p.*

However, the data 806 transferred between the devices 808 and the processors 804 may include additional or alternative data within the scope of the present disclosure.

In the exemplary embodiment shown in FIG. 8A, the processors 804 include:

a choke controller 804*a;*
a drum controller 804*b;*
a mud pump controller 804*c;*
an oscillation controller 804*d;*
a quill position controller 804*e;*
a toolface controller 804*f;*
a d-exponent calculator 804*g;*
a d-exponent-corrected calculator 804*h;*
an MSE calculator 804*i;*
an ROP calculator 804*l;*
a true depth calculator 804*m;*
a WOB calculator 804*n;*
a stick/slip detector 804*o*; and
a survey log 804*p.*

However, the processors 804 may include additional or alternative controllers, calculators, detectors, data storage, and/or other processors within the scope of the present disclosure.

The choke controller 804*a* is configured to receive the bottom hole pressure setting from the bottom hole pressure input 802*a*, the casing pressure 806*b* from the casing pressure sensor 808*b*, the choke position 806*c* from the choke position sensor 808*c*, and the mud weight 806*g* from the return line mud weight sensor 808*j*. The choke controller 804*a* may also receive bottom hole pressure data from the pressure calculator 804*k*. Alternatively, the processors 804 may include a comparator, summing, or other device which performs an algorithm utilizing the bottom hole pressure setting received from the bottom hole pressure input 802*a* and the current bottom hole pressure received from the pressure calculator 804*k*, with the result of such algorithm being provided to the choke controller 804*a* in lieu of or in addition to the bottom hole pressure setting and/or the current bottom hole pressure. The choke controller 804*a* is configured to process the received data and generate the choke actuation signal 806*l*, which is then transmitted to the choke actuator 808.

For example, if the current bottom hole pressure is greater than the bottom hole pressure setting, then the choke actuation signal 806*l* may direct the choke actuator 808*m* to further open, thereby increasing the return flow rate and decreasing the current bottom hole pressure. Similarly, if the current bottom hole pressure is less than the bottom hole pressure setting, then the choke actuation signal 806*l* may direct the choke actuator 808*m* to further close, thereby decreasing the return flow rate and increasing the current bottom hole pressure. Actuation of the choke actuator 808*m* may be incremental, such that the choke actuation signal 806*l* repeatedly directs the choke actuator 808*m* to further open or close by a predetermined amount until the current bottom hole pressure satisfactorily complies with the bottom hole pressure setting. Alternatively, the choke actuation signal 806*l* may direct the choke actuator 808*m* to further open or close by an amount proportional to the current discord between the current bottom hole pressure and the bottom hole pressure setting.

The drum controller 804*b* is configured to receive the ROP set point from the ROP set point input 802*l*, as well as the current ROP from the ROP calculator 804*l*. The drum controller 804*b* is also configured to receive WOB data from a comparator, summing, or other device which performs an algorithm utilizing the WOB reference point from the WOB reference input 802*g* and the current WOB from the WOB calculator 804*n*. This WOB data may be modified based current MSE data. Alternatively, the drum controller 804*b* is configured to receive the WOB reference point from the WOB reference input 802*g* and the current WOB from the WOB calculator 804*n* directly, and then perform the WOB comparison or summing algorithm itself. The drum controller 804*b* is also configured to receive ΔP data from a comparator, summing, or other device which performs an algorithm utilizing the ΔP reference received from the ΔP reference input 802*d* and a current ΔP received from one of the processors 804 that is configured to determine the current ΔP. The current ΔP may be corrected to take account the casing pressure 806*b*.

The drum controller 804*b* is configured to process the received data and generate the drawworks actuation signal 806*m*, which is then transmitted to the drawworks drive 808*n*. For example, if the current WOB received from the WOB calculator 804*n* is less than the WOB reference point received from the WOB reference input 802*q*, then the drawworks actuation signal 806*m* may direct the drawworks drive 808*n* to cause the drawworks motor 808*o* to feed out more drilling line. If the current WOB is less than the WOB reference point, then the drawworks actuation signal 806*m* may direct the drawworks drive 808*n* to cause the drawworks motor 808*o* to feed in the drilling line.

If the current ROP received from the ROP calculator 804*l* is less than the ROP set point received from the ROP set point input 802*l*, then the drawworks actuation signal 806*m* may direct the drawworks drive 808*n* to cause the drawworks motor 808*o* to feed out more drilling line. If the current ROP is greater than the ROP set point, then the drawworks actuation signal 806*m* may direct the drawworks drive 808*n* to cause the drawworks motor 808*o* to feed in the drilling line.

If the current ΔP is less than the ΔP reference received from the ΔP reference input 802*d*, then the drawworks actuation signal 806*m* may direct the drawworks drive 808*n* to cause the drawworks motor 808*o* to feed out more drilling line. If the current ΔP is greater than the ΔP reference, then the drawworks actuation signal 806*m* may direct the drawworks drive 808*n* to cause the drawworks motor 808*o* to feed in the drilling line.

The mud pump controller 804*c* is configured to receive the mud pump stroke/phase data 806*f*, the mud pressure 806*e* from the mud pressure sensor 808*f*, the current ΔP, the current MSE from the MSE calculator 804*i*, the current ROP from the ROP calculator 804*l*, a stick/slip indicator from the stick/slip detector 804*o*, the mud flow rate set point from the mud flow set point input 802*h*, and the pump data from the pump input 802*m*. The mud pump controller 804*c* then utilizes this data to generate the mud pump actuation signal 806*n*, which is then transmitted to the mud pump 808*p*.

The oscillation controller 804*d* is configured to receive the current quill position 806*h*, the current top drive torque 806*k*, the stick/slip indicator from the stick/slip detector 804*o*, the current ROP from the ROP calculator 804*l*, and the quill oscillation amplitude limits from the inputs 802*j* and 802*k*. The oscillation controller 804*d* then utilizes this data to generate an input to the quill position controller 804*e* for use in generating the top drive actuation signal 806*o*. For example, if the stick/slip indicator from the stick/slip detector 804*o* indicates that stick/slip is occurring, then the signal generated by the oscillation controller 804*d* will indicate that oscillation needs to commence or increase in amplitude.

The quill position controller 804*e* is configured to receive the signal from the oscillation controller 804*d*, the top drive RPM setting from the top drive RPM input 802*o*, a signal from the toolface controller 804*f*, the current WOB from the WOB calculator 804*n*, and the current toolface 806*j* from at least one of the MWD toolface sensors 808*g* and 808*h*. The quill position controller 804*e* may also be configured to receive the top drive torque limit setting from the top drive torque limit input 802*p*, although this setting may be adjusted by a comparator, summing, or other device to account for the current MSE, where the current MSE is received from the MSE calculator 804*i*. The quill position controller 804*e* may also be configured to receive a stick/slip indicator from the stick/slip detector 804*o*. The quill position controller 804*e* then utilizes this data to generate the top drive actuation signal 806*o*.

For example, the top drive actuation signal 806*o* causes the top drive drive 808*q* to cause the top drive motor 808*r* to rotate the quill at the speed indicated by top drive RPM input 802*o*. However, this may only occur when other inputs aren't overriding this objective. For example, if so directed by the signal from the oscillation controller 804*d*, the top drive actuation signal 806*o* will also cause the top drive drive 808*q* to cause the top drive motor 808*r* to rotationally oscillate the quill. Additionally, the signal from the toolface controller 804*d* may override or otherwise influence the top drive actuation signal 806*o* to rotationally orient the quill at a certain static position or set a neutral point for oscillation.

The toolface controller 804*f* is configured to receive the toolface position setting from the toolface position input 802*n*, as well as the current toolface 806*j* from at least one of the MWD toolface sensors 808*g* and 808*h*. The toolface controller 804*f* may also be configured to receive ΔP data. The toolface controller 804*f* then utilizes this data to generate a signal which is provided to the quill position controller 804*e*.

The d-exponent calculator 804*g* is configured to receive the current ROP from the ROP calculator 804*l*, the current ΔP and/or other pressure data, the bit diameter, the current WOB from the WOB calculator 804*n*, and the current mud weight 806*g* from the return line mud weight sensor 808*j*. The d-exponent calculator 804*g* then utilizes this data to calculate the d-exponent, which is a factor for evaluating ROP and detecting or predicting abnormal pore pressure zones. Assuming all other parameters are constant, the d-exponent should increase with depth when drilling in a normal pressure section, whereas a reversal of this trend is an indication of drilling into potential overpressures. The signal from the d-exponent calculator 804*g* is optionally provided to the display 810, as well as to the toolface calculation engine 404. Consequently, the steering module 420 can cease drilling or adjust the planned path by treating an area causing increased values from the d-exponent calculator 804*g* as a deviation from the planned path outside the tolerance zone. This can advantageously automatically direct the main controller to drill in a different direction to avoid drilling into the potential overpressure area. The d-exponent calculator is simply another suitable method, or algorithm, for analyzing ROP and is another calculation that can be accomplished similar to that for MSE.

The d-exponent-corrected calculator 804*h* may be configured to receive substantially the same data as received by the d-exponent calculator 804*g*. Alternatively, the d-exponent-corrected calculator 804*h* is configured to receive the current d-exponent as calculated by the d-exponent calculator 804*g*. The d-exponent-corrected calculator 804*h* then utilizes this data to calculate the corrected d-exponent, which corrects the d-exponent value for mud weight and which can be related directly to formation pressure rather than to differential pressure. The signal from the d-exponent calculator 804*g* is provided, e.g., to the display 810.

The MSE calculator 804*i* is configured to receive current RPM data from the top drive RPM input 802*o*, the top drive torque 806*k* from the top drive torque sensor 808*l*, and the current WOB from the WOB calculator 804*n*. The MSE calculator 804*i* then utilizes this data to calculate the current MSE, which is then transmitted to the drum controller 804*b*, the quill position controller 804*e*, and the mud pump controller 804*c*. The MSE calculator 804*i* may also be configured to receive the MSE limit setting from the MSE limit input 802*f*, in which case the MSE calculator 804*i* may also be configured to compare the current MSE to the MSE limit setting and trigger an alert if the current MSE exceeds the MSE limit setting. The MSE calculator 804*i* may also be configured to receive the MSE target setting from the MSE target input 802*g*, in which case the MSE calculator 804*i* may also be configured to generate a signal indicating the difference between the current MSE and the MSE target. This signal may be utilized by one or more of the processors 804 to correct adjust various data values utilized thereby, such as the adjustment to the current or reference WOB utilized by the drum controller 804*b*, and/or the top drive torque limit setting utilized by the quill position controller 804*e*, as described above.

The pressure calculator 804*k* is configured to receive the casing pressure 806*b* from the casing pressure sensor 808*b*, the mud pressure 806*e* from the mud pressure sensor 808*f*, the mud weight 806*g* from the return line mud weight sensor 808*j*, and the true vertical depth from the true depth calculator 804*m*. The pressure calculator 804*k* then utilizes this data to calculate the current bottom hole pressure, which is then transmitted to choke controller 804*a*. However, before being sent to the choke controller 804*a*, the current bottom hole pressure may be compared to the bottom hole pressure setting received from the bottom hole pressure input 802*a*, in which case the choke controller 804*a* may utilize only the difference between the current bottom home pressure and the bottom hole pressure setting when generating the choke actuation signal 806*l*. This comparison between the current bottom hole pressure and the bottom hole pressure setting may be performed by the pressure calculator 804*k*, the choke controller 804*a*, or another one of the processors 804.

The ROP calculator 804*l* is configured to receive the block position 806*a* from the block position 808*a* and then utilize this data to calculate the current ROP. The current ROP is then transmitted to the true depth calculator 804*m*, the drum controller 804*b*, the mud pump controller 804*c*, and the oscillation controller 804*d*.

The true depth calculator 804*m* is configured to receive the current toolface 806*j* from at least one of the MWD toolface sensors 808*g* and 808*h*, the survey log 804*p*, and the current measured depth that is calculated from the current ROP received from the ROP calculator 804*l*. The true depth calculator 804*m* then utilizes this data to calculate the true vertical depth, which is then transmitted to the pressure calculator 804*k*.

The WOB calculator 804*n* is configured to receive the stick/slip indicator from the stick/slip detector 804*o*, as well as the current hook load 806*d* from the dead-line anchor load sensor 808*d*. The WOB calculator 804*n* may also be configured to receive an off-bottom string weight tare, which may be the difference between the WOB tare received from the WOB tare input 802*r* and the current hook load 806*d* received from the dead-line anchor load sensor 808*d*. In any case, the WOB calculator 804*n* is configured to calculate the current WOB based on the current hook load, the current string weight, and the stick-slip indicator. The current WOB is then transmitted to the quill position controller 804*e*, the d-exponent calculator 804*g*, the d-exponent-corrected calculator 804*h*, the MSE calculator 804*i*, and the drum controller 804*b*.

The stick/slip detector 804*o* is configured to receive the current top drive torque 806*k* and utilize this data to generate the stick/slip indicator, which is then provided to the mud pump controller 804*c*, the oscillation controller 804*d*, and the quill position controller 804*e*. The stick/slip detector 804*o* measures changes in the top drive torque 806*k* relative to time, which is indicative of whether the bit may be exhibiting stick/slip behavior, indicating that the top drive torque and/or WOB should be reduced or the quill oscillation amplitude should be modified.

The processors 804 may be collectively implemented as a single processing device, or as a plurality of processing devices. Each processor 804 may include one or more software or other program product modules, sub-modules, routines, sub-routines, state machines, algorithms. Each processor 804 may additional include one or more computer memories or other means for digital data storage. Aspects of one or more of the processors 804 may be substantially similar to those described herein with reference to any controller or other data processing apparatus. Accordingly, the processors 804 may include or be composed of at least a portion of controller 190 in FIG. 1, the controller 325 in FIG. 3, the controller 420 in FIGS. 4A-C, and the controller 698 in FIG. 6B, for example.

Figure 8B:
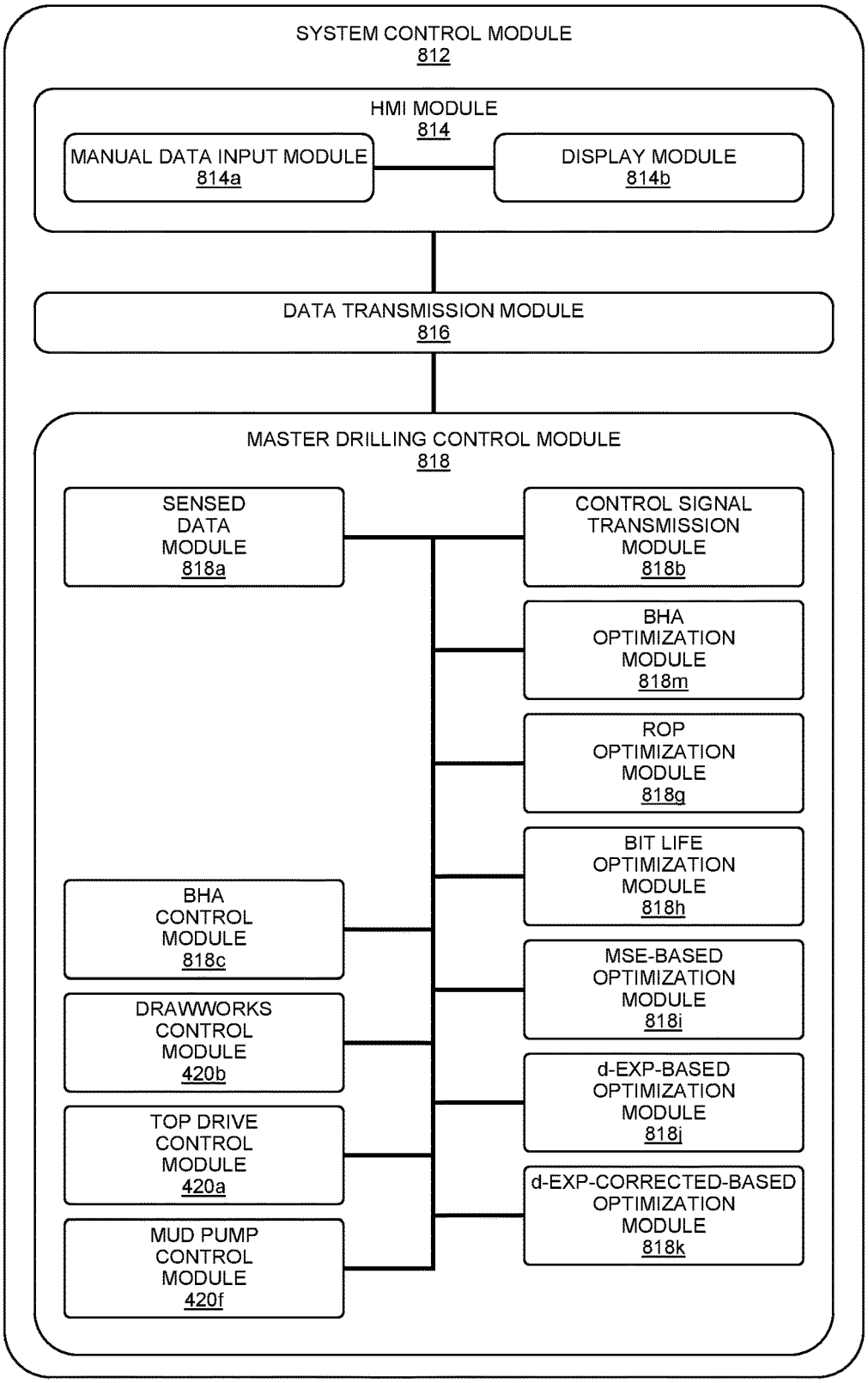

FIG. 8B illustrates a system control module 812 according to one or more aspects of the present disclosure. The system control module 812 is one possible implementation of the apparatus 800 shown in FIG. 8A, and may be utilized in conjunction with or implemented within the apparatus 100 shown in FIG. 1, and any of the apparatuses 300, 400*a*, 400*b*, 400*c*, and 790 shown respectively in FIGS. 3, 4A-C, and 7B. The system control module 812 may also be utilized to perform one or more aspects of the methods shown in any of FIGS. 2A, 2B, 5A, 6A, 6C, 7A, 7B, and 7C.

The system control module 812 includes an HMI module 814, a data transmission module 816, and a master drilling control module 818. The HMI module 814 includes a manual data input module 814*a* and a display module 814*b*. The master drilling control module 818 includes a sensed data module 818*a*, a control signal transmission module 818*b*, a BHA control module 818*c*, a drawworks control module 420*b*, a top drive control module 420*a*, a mud pump control module 420*f*, an ROP optimization module 818*g*, a bit life optimization module 818*h*, an MSE-based optimization module 818*i*, a d-exponent-based optimization module 818*j*, a d-exponent-corrected-based optimization module 818*k*, -, and a BHA optimization module 818*m*.

The manual data input module 814*a* is configured to facilitate user-input of various set points, operating ranges, formation conditions, equipment parameters, and/or other data, including a drilling plan or data for determining a drilling plan. For example, the manual data input module 814*a* may enable the inputs 802 shown in FIG. 8A, among others. Such data may be received by the manual data input module 814*a* via the data transmission module 816, which may include or support one or more connectors, ports, and/or other means for receiving data from various data input devices. The display module 814*b* is configured to provide an indication that the user has successfully entered some or all of the input facilitated by the manual data input module 814*a*. Such indication may be include a visual indication of some type, such as via the display of text or graphic icons or other information, the illumination of one or more lights or LEDs, or the change in color of a light, LED, graphic icon or symbol, among others.

The master drilling control module 818 is configured to receive data input by the user from the HMI module 814, which in some embodiments is communicated via the data transmission module 816 as in the exemplary embodiment depicted in FIG. 8B.

The sensed data module 818*a* of the master drilling control module 818 also receives sensed or detected data from various sensors, detectors, encoders, and other such devices associated with the various equipment and components of the rig. Examples of such sensing and information obtaining devices include the devices 430 in FIG. 4A and 806 in FIG. 8A among other figures included herein. This sensed data may also be received by the sensed data module 818*a* via the data transmission module 816.

The control signal transmission module 718*b* interfaces between the control modules of the master drilling control module 818 and the actual working systems. For example, it sends and receives control signals to the drawworks 130, the top drive 140, the mud pump 180, and in some embodiments, the BHA 170 in FIG. 1 The BHA control module 718*c* may be employed when the BHA is configured to be controlled downhole.

The drawworks control module 420*b*, the top drive control module 420*a*, and the mud pump control module 420*f* are used to generate control signals sent via the control signal transmission module 718*b* to the drawworks, the top drive, and the mud pump. These may correspond to the controllers shown in FIG. 4C.

In some embodiments, the master drilling control module 818 may include less than all the optimization modules 818*g*-*m* shown, with each of the optimization modules being separately purchasable by a user. Accordingly, some embodiments may include only one of the optimization modules while other embodiments include more than one of the optimization modules. Thus, the master drilling control module 818 may be configured so that the available modules cooperate to arrive at optimization values considering all the optimization modules available in the master drilling control module. This is further discussed below with reference to FIG. 8C.

Still referring to FIG. 8B, the ROP optimization module 818*g* determines methods or adjustments to processes that improve the ROP of the BHA. The ROP optimization module 818*g* receives data from the sensed data module 430 as well as other data, including data relating to toolface orientation, among others, to determine the most effective way to maximize ROP. After considering these and/or other factors, the ROP optimization module 818*g* communicates with the control modules 818*c*, 420*a*, 420*b*, and 420*f* so that the control modules can determine whether steering changes would optimize ROP in a way that maximizes productivity and effectiveness.

The bit life optimization module 818*h* may consider data received from the sensed data module 430 as well as toolface orientation data, including azimuth, inclination toolface orientation data, time in drilling, to determine the most effective way to preserve bit life without compromising effectiveness or productivity. After considering these or other factors, the bit life optimization module communicates with the control modules 818*c*, 420*a*, 420*b*, and 420*f* so that the control modules can determine whether steering changes would preserve bit life in a way that maximizes productivity and effectiveness.

The MSE-based optimization module 818*i* performs the MSE based optimization processes discussed above with reference to FIGS. 6A, 6C, and 6D. The outputs of the optimization module 818*i* may be communicated to the control modules 818*c*, 420*a*, 420*b*, and 420*f* to actually implement the changes that result in the efficiencies.

The d-exponent-based optimization module 818*j* may include the d-exponent calculator 804*g* to determine the d-exponent and evaluate ROP while detecting or predicting abnormal pore pressure zones. Accordingly, as the d-exponent module detects variance in normal pressure, the d-exponent module can communicate with the control modules 818*c*, 420*a*, 420*b*, and 420*f* to consider making any steering changes necessary for efficient and effective drilling.

The d-exponent-corrected-based optimization module 818*k* may include the d-exponent-corrected calculator 804*h*. Using the data received, the optimization module 818*k* corrects the d-exponent value for mud weight which can be related directly to formation pressure rather than to differential pressure. This corrected value also can be communicated to the control modules 818*c*, 420*a*, 420*b*, and 420*f* to consider making any steering changes necessary for efficient and effective drilling.

The BHA optimization module 818*m* may consider data received from the sensed data module 430, data input at the manual data input module 714*a*, and other obtainable data to determine optimization profiles for the BHA. In some embodiments, the BHA optimization module 818*m* processes information received from other modules in the master drilling control module 718. Using this information, the BHA optimization module 818*m* outputs data to the control modules 818*c*, 420*a*, 420*b*, and 420*f* to consider making any steering changes to the BHA necessary to optimize the BHA.

As the drawworks control module 420*b*, the top drive control module 420*a*, and the mud pump control module 420*f* receive information from the optimization modules, they process the data to determine whether the interaction of the recommended changes would positively or negatively affect the overall productivity of the well system, and generate control signals instructing the drawworks 130, the top drive 140, and the mudpump 180 of FIG. 1 in a manner to most effectively implement changes.

Figure 8C:
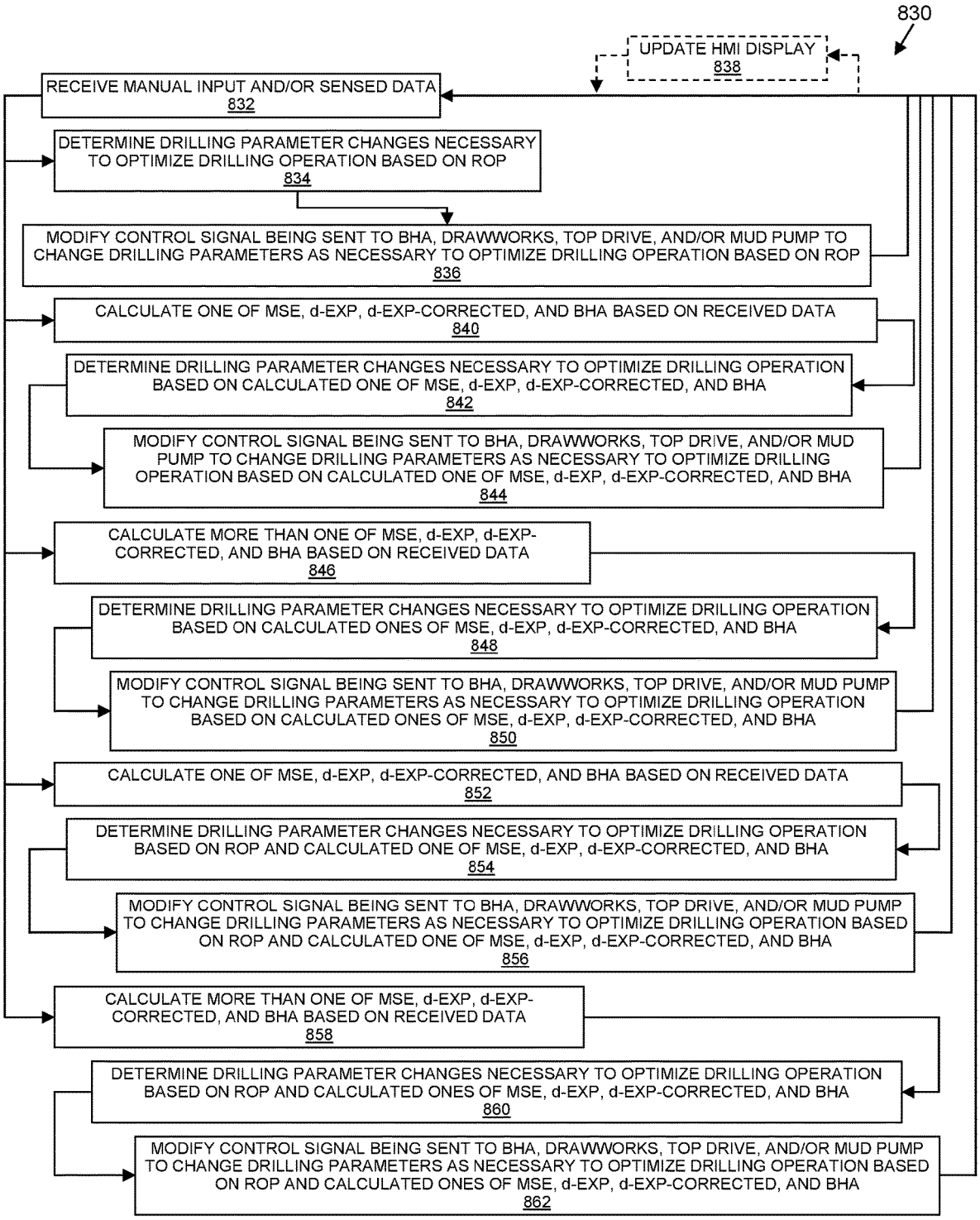
FIG. 8C is a flow-chart diagram of a method according to one or more aspects of the present disclosure.

FIG. 8C shows an exemplary method 830 performed by the master drilling control module 818 to optimize the overall drilling operation of the drilling rig. As discussed above, some embodiments of the master drilling control module 818 do not include all the optimization modules shown in FIG. 8B. Accordingly, the method 830 considers the circumstances where the master drilling control module includes one, more than one, or less than all the optimization modules shown. It is contemplated that these modules are exemplary and that other optimization modules may be included therein.

The method 830 includes steps that appear in parallel, and are not necessarily done in series. In some embodiments, these parallel method paths are alternative paths and may be implemented based upon the configuration of the master drilling control module and/or the availability of the optimization modules. For example, from step 832, the method 830 continues to steps 834, 840, 846, 852, and 858. These are each discussed below.

Referring to FIG. 8C, at a step 832, the master drilling control module 718 receives manual inputs and/or sensed data from the manual data input module 814*a* and/or the sensed data module 430 (input or sensed data not shown). In some instances, the master drilling control module 718 may access trend data stored from prior surveys.

Using this information and data, the optimization modules in the master drilling control module 818 calculate or otherwise process data using algorithms to determine optimization values for any number of factors affecting drilling efficiency or productivity, including ROP. In some embodiments, the alternative paths in FIG. 8C are dependent on the availability of the optimization modules. For example, from step 832, the method 830 continues to step 834 if the master drilling control module 818 includes only the ROP optimization module 818*g* of the optimization modules. Alternatively, from step 832, the method 830 continues to step 840 if the master drilling control module 818 includes only one of the MSE-based optimization module 818*i*, the d-exponent-based optimization module 818*j*, the d-exponent-corrected-based optimization module 818*k*, and the BHA optimization module 818*m*. Again, alternatively, from step 832, the method 830 continues to step 846 if the master drilling control module 818 includes more than one optimization module. The method 832 continues to step 852 if the master drilling control module 818 includes the ROP optimization module 818*g* and one of the MSE-based optimization module 818*i*, the d-exponent-based optimization module 818*j*, the d-exponent-corrected-based optimization module 818*k*, and the BHA optimization module 818*m*. The method 832 continues to step 858 if the master drilling control module 818 includes the ROP optimization module 818*g* and more than one optimization module 818*i*, 818*j*, 818*k*, 818*l*, and 818*m*.

In alternative embodiments, the master drilling control module 818 performs all the steps of the method rather than treating them as alternative steps as described above. Accordingly, although the master drilling control module includes a plurality of optimization modules, it still considers the ROP optimization module 818*g* independently at step 834, considers one of the other optimization modules independently at step 840, and so on with steps 846, 852, and 858.

In the circumstances where only the ROP optimization module 818*g* is included in the master drilling control module 818, or the master control module 818 is configured to consider only the ROP optimization module 818*g*, at step 834, the ROP optimization module 818*g* determines drilling parameter changes that optimize drilling operation based on ROP using the manual inputs and/or sensed data. These drilling parameter changes are communicated to the BHA control module 818*c*, the drawworks control module 420*b*, the top drive control module 420*a*, and/or the mud pump control module 420*f*. At step 836, these control modules modify the one or more control signals being sent to the BHA, the drawworks, the top drive, and or the mudpump to change the drilling parameter(s) necessary to optimize the drilling operation based on ROP.

In the circumstances where only one optimization module is included in the master drilling control module 818, or the master control module 818 is configured to consider only one optimization module, at step 840, using the MSE-based optimization module 818*i*, the d-exponent-based optimization module 818*j*, the d-exponent-corrected-based optimization module 818*k*, and the BHA optimization module 818*m*, the master drilling control module 818 can calculate one of MSE, d-exp, d-exp-corrected, and BHA optimization values based on data received from the sensed data module and/or the manual data input module 814*a*. Based on this data, at step 842, the master drilling control module 818 can determine the drilling parameter changes necessary to optimize the drilling operation based on the calculated one of MSE, d-exp, d-exp-corrected, and BHA optimization values. These drilling parameter changes are communicated to the BHA control module 818*c*, the drawworks control module 420*b*, the top drive control module 420*a*, and/or the mud pump control module 420*f*. At step 844, these control modules modify the control signals being sent to the BHA, the drawworks, the top drive, and or the mudpump to change the drilling parameters necessary to optimize the drilling operation based on the calculated value.

In the circumstances where more than one optimization module is included in the master drilling control module, at step 846 using the optimization modules 818*i*, 818*j*, 818*k*, 818*l*, and 818*m*, the master drilling control module 818 preferably calculates more than one (typically, at least two) of MSE, d-exp, d-exp-corrected, and BHA optimization values based on data received form the sensed data module and/or the manual data input module 814*a*. Based on this data, at step 848, the master drilling control module 818 can determine the drilling parameter changes necessary to optimize the drilling operation based on the plurality of calculated values. These drilling parameter changes are communicated to the BHA control module 818*c*, the drawworks control module 420*b*, the top drive control module 420*a*, and/or the mud pump control module 420*f* and at step 850, these control modules modify the control signals being sent to the BHA, the drawworks, the top drive, and or the mudpump to change the drilling parameters necessary to optimize the drilling operation based on the plurality of calculated values.

In the circumstances where the ROP optimization module 818*g* and only one other optimization module are included in the master drilling control module 818, or the master control module 818 is configured to consider only the ROP optimization module 818*g* and only one other optimization module, at step 854, the master drilling control module 818 preferably determines the drilling parameter changes necessary to optimize the drilling operation based on the one calculated value and the ROP optimization value. These values are communicated to the control modules and at step 856, these control modules can modify the control signals being sent to the BHA, the drawworks, the top drive, and or the mudpump to change the drilling parameters necessary to optimize the drilling operation based on the calculated value.

In the circumstances where the ROP optimization module and more than one additional optimization module are included in the master drilling control module, at step 858, using the optimization modules 818*i*, 818*j*, 818*k*, 818*l*, and 818*m* the master drilling control module 818 calculates more than one of MSE, d-exp, d-exp-corrected, and BHA optimization values based on data received from the sensed data module and/or the manual data input module 814*a*. Here, the master drilling control module 818 considers ROP when determining the drilling parameter changes necessary to optimize the drilling operation. Accordingly the master drilling control module 818 can consider the plurality of calculated values from the optimization modules, including the ROP, to determine the optimized drilling parameter changes. These drilling parameter changes are communicated to the control modules 818*c*, 420*b*, 420*a*, and/or 420*f* and at step 862, these control modules modify the control signals being sent to the BHA, the drawworks, the top drive, and/or the mudpump to change the drilling parameters necessary to optimize the drilling operation based on the plurality of calculated values.

Regardless of which path is used, after modified control signals are sent from the master drilling control module, the display module 814*b* preferably updates the optional but preferred HMI display at step 838 to reflect these new changed control signals. The HMI display is discussed further herein and as incorporated.

In some instances, the master drilling control module 818 performs all or some of the steps 834, 840, 846, 852, and 858 at the same time, or in sufficiently rapid succession so as to appear simultaneous, and the control signals are modified based on multiple inputs from the system.

Figure 9A:
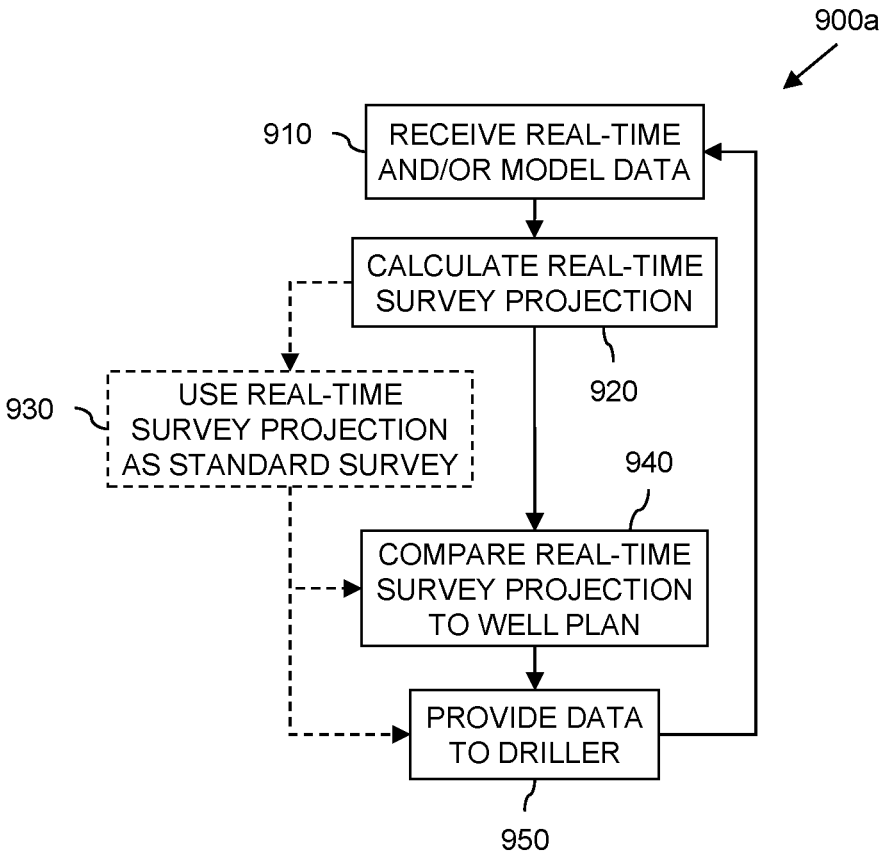
FIGS. 9A-9B are flow-chart diagrams of methods according to one or more aspects of the present disclosure.
Figure 9B:
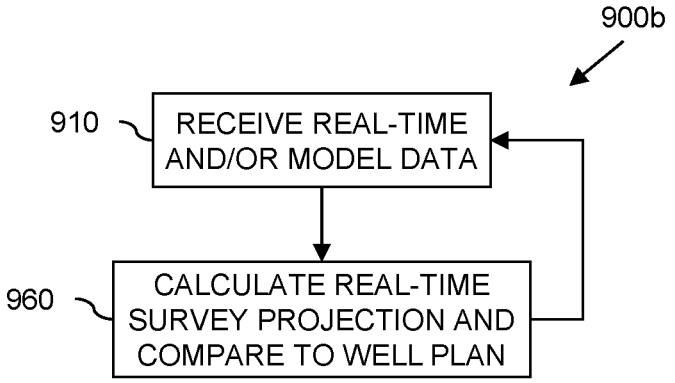

FIGS. 9A and 9B show flow charts detailing methods of optimizing directional drilling accuracy during drilling operations performed via the apparatus 100 in FIG. 1. Any of the control systems disclosed herein, including FIGS. 1, 3, 4A-C, 6B, 8A, and 8B may be used to execute the methods of FIGS. 9A and 9B. The real-time data obtained in these methods may be configured as inputs in FIG. 4A to optimize drilling operations and to calculate bit position in order to identify and correct any deviations of the bit from the planned drilling path during drilling operations.

Referring first to FIG. 9A, illustrated is a flow-chart diagram of a method 900 according to one or more aspects of the present disclosure. The method 900 may be performed in association with one or more components of the apparatus 100 shown in FIG. 1 during operation of the apparatus 100. For example, the method 900 may be performed to optimize directional drilling accuracy during drilling operations performed via the apparatus 100.

The method 900 includes a step 910 during which real-time toolface, hole depth, pipe rotation, hook load, delta pressure, and/or other data are received by a controller or other processing device (e.g., any of the controller 190, 325, 420, 402, 698, 804, 812 or others discussed herein). The data may be obtained from various rig instruments and/or sensors configured for such measurement (such as the sensors shown in FIGS. 1, 4A, 8A, and others). The step 910 may also include receiving modeled dogleg and/or other well plan data taken from surveys or otherwise obtained. In a subsequent step 920, the real-time and/or modeled data received during step 910 is utilized to calculate a real-time survey projection ahead of the most recent standard survey result. The real-time survey projection calculated during step 920 can then optionally be temporarily utilized as the next standard survey point during a subsequent step 930. The method 900 may also include a step 940 following step 920 and/or step 930, during which the real-time survey projection calculated during step 920 is compared to the well plan at the corresponding hole depth. A step 950 may follow step 930 and/or step 940, during which the directional driller is given the real-time survey projection calculated during step 920 and/or the results of the comparison performed during step 940. Consequently, the directional driller can more accurately assess the progress of the current drilling operation even in the absence of any direct inclination and azimuth measurements at hole depth.

In an exemplary embodiment within the scope of the present disclosure, the method 900 then repeats, such that the method flow goes back to step 910 and begins again. Iteration of the method 900 may be utilized to characterize the performance of the bottom hole assembly. Moreover, iteration may allow the real-time survey projection calculation model to refine itself each time a survey is received. Use of the method 900 may, at least in some embodiments, assist the directional driller in the drilling operation by applying build and turn rates to the slide sections and projections across sections drilled by rotating.

As described above, the conventional approach entails conducting a standard survey at each drill pipe connection to obtain a measurement of inclination and azimuth for the new survey position. Thus, the prior art makes measurements after the hole is drilled. In contrast, with the method 900 and others within the scope the present disclosure, real-time measurements are made ahead of the last standard survey, and can give the directional driller feedback on the progress and effectiveness of a slide or rotation procedure.

Referring to FIG. 9B, illustrated is a flow-chart diagram of a simplified version of the method 900 shown in FIG. 9A, herein designated by the reference numeral 900*a*. The method 900*a* includes step 910 during which toolface and hole depth measurements are received from rig instruments. Step 910 may also include receiving model or well plan data corresponding to the real-time data received from the rig instruments. Such receipt of the real-time and/or model data may be at one or more controllers, processing devices, and/or other devices, such as the controller 190 shown in FIG. 1.

In a subsequent step 960, these measurements are utilized with modeled or calculated data from previous surveys (e.g., including build rates, doglegs, etc.) to track the progress of the hole by calculating a real-time survey projection and comparing the projection to the well plan. Steps 910 and 960 are then repeated, perhaps at rates or intervals which yield high granularity. Step 960 may also include averaging the received data across depth intervals (e.g., averaging most recently received data with previously received data). Consequently, the data received during step 910 and processed during step 960 may provide precise resolution, perhaps on a foot-by-foot basis during a slide operation, and may demonstrate how a particular drilling operation will be or is being affected by how precise a particular toolface is being maintained.

A high resolution view of the current hole versus the well plan is often key to tracking the effectiveness of a slide operation. For example, within the span of a single joint, a directional driller may be required (e.g., by the well plan) to perform a 20 foot slide, 50 feet of rotary drilling, and then another 20 foot slide. Conventionally, the driller would not know the effectiveness of this section until he receives his next survey, which is performed after the slide-rotate-slide procedure is attempted. However, according to one or more aspects of the present disclosure, the driller can calculate utilize realtime surveys projections throughout the slide-rotate-slide procedure to show the projected well path of the bit. Thus, the accuracy with which the slide-rotate-slide procedure is performed may be dramatically increased, and when used to perform the method in FIG. 5A, provides more accurate directional correction than conventional systems. Moreover, the methods 900 and 900*a* may include updating build rates and model on each real-time survey, thus increasing the accuracy of each subsequent survey, survey projection, and/or drilling stage.

Figure 10A:
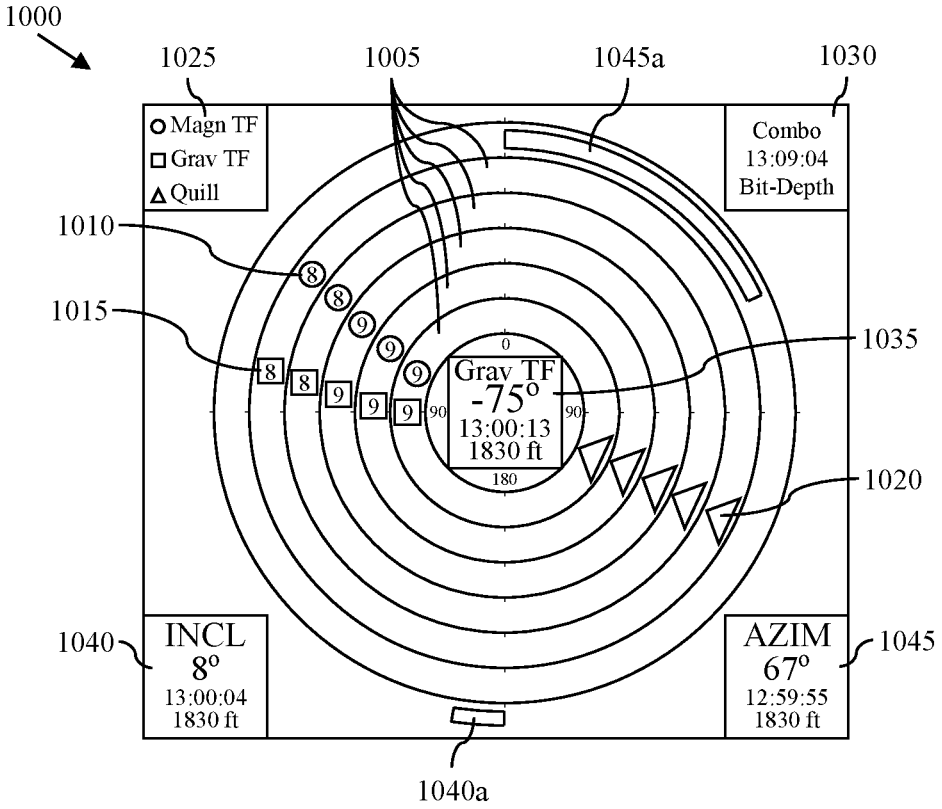
FIGS. 10A-10B are schematic diagrams of a display apparatus according to one or more aspects of the present disclosure.
Figure 10B:
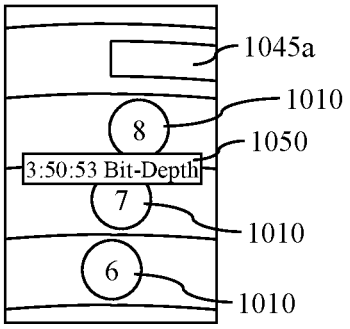

FIGS. 10A and 10B are exemplary illustrations of user displays relaying information about the bit location to a user. The display in the figures may be any display discussed herein, including the displays 335, 472, 692*c*, and 810. Turning to FIG. 10A, illustrated is a schematic view of a human-machine interface (HMI) 1000 according to one or more aspects of the present disclosure. The HMI 100 may be utilized by a human operator during directional and/or other drilling operations to monitor the relationship between toolface orientation and quill position. In an exemplary embodiment, the HMI 1000 is one of several display screens selectable by the user during drilling operations, and may be included as or within the human-machine interfaces, drilling operations and/or drilling apparatus described in the systems herein and the systems incorporated by reference. The HMI 100 may also be implemented as a series of instructions recorded on a computer-readable medium, such as described in one or more of these references.

The HMI 100 is used by the directional driller while drilling to monitor the BHA in three-dimensional space. The control system or computer which drives one or more other human-machine interfaces during drilling operation may be configured to also display the HMI 1000. Alternatively, the HMI 1000 may be driven or displayed by a separate control system or computer, and may be displayed on a computer display (monitor) other than that on which the remaining drilling operation screens are displayed.

The control system or computer driving the HMI 1000 includes a "survey" or other data channel, or otherwise includes means for receiving and/or reading sensor data relayed from the BHA, a measurement-while-drilling (MWD) assembly, and/or other drilling parameter measurement means, where such relay may be via the Wellsite Information Transfer Standard (WITS), WITS Markup Language (WITSML), and/or another data transfer protocol. Such electronic data may include gravity-based toolface orientation data, magnetic-based toolface orientation data, azimuth toolface orientation data, and/or inclination toolface orientation data, among others. In an exemplary embodiment, the electronic data includes magnetic-based toolface orientation data when the toolface orientation is less than about 7° relative to vertical, and alternatively includes gravity-based toolface orientation data when the toolface orientation is greater than about 7° relative to vertical. In other embodiments, however, the electronic data may include both gravity- and magnetic-based toolface orientation data. The azimuth toolface orientation data may relate the azimuth direction of the remote end of the drill string relative to true North, wellbore high side, and/or another predetermined orientation. The inclination toolface orientation data may relate the inclination of the remote end of the drill string relative to vertical.

As shown in FIG. 10A, the HMI 1000 may be depicted as substantially resembling a dial or target shape having a plurality of concentric nested rings 1005. The magnetic-based toolface orientation data is represented in the HMI 1000 by symbols 1010, and the gravity-based toolface orientation data is represented by symbols 1015. The HMI 1000 also includes symbols 1020 representing the quill position. In the exemplary embodiment shown in FIG. 10A, the magnetic toolface data symbols 1010 are circular, the gravity toolface data symbols 1015 are rectangular, and the quill position data symbols 1020 are triangular, thus distinguishing the different types of data from each other. Of course, other shapes may be utilized within the scope of the present disclosure. The symbols 1010, 1015, 1020 may also or alternatively be distinguished from one another via color, size, flashing, flashing rate, and/or other graphic means.

The symbols 1010, 1015, 1020 may indicate only the most recent toolface (1010, 1015) and quill position (120) measurements. However, as in the exemplary embodiment shown in FIGS. 10A and 10B, the HMI 1000 may include a historical representation of the toolface and quill position measurements, such that the most recent measurement and a plurality of immediately prior measurements are displayed. Thus, for example, each ring 1005 in the HMI 1000 may represent a measurement iteration or count, or a predetermined time interval, or otherwise indicate the historical relation between the most recent measurement(s) and prior measurement(s). In the exemplary embodiment shown in FIG. 10A, there are five such rings 1005 in the dial (the outermost ring being reserved for other data indicia), with each ring 1005 representing a data measurement or relay iteration or count. The toolface symbols 1010, 1015 may each include a number indicating the relative age of each measurement. In other embodiments, color, shape, and/or other indicia may graphically depict the relative age of measurement. Although not depicted as such in FIG. 10A, this concept may also be employed to historically depict the quill position data.

The HMI 1000 may also include a data legend 1025 linking the shapes, colors, and/or other parameters of the data symbols 1010, 1015, 1020 to the corresponding data represented by the symbols. The HMI 1000 may also include a textual and/or other type of indicator 1030 of the current toolface mode setting. For example, the toolface mode may be set to display only gravitational toolface data, only magnetic toolface data, or a combination thereof (perhaps based on the current toolface and/or drill string end inclination). The indicator 1030 may also indicate the current system time. The indicator 1030 may also identify a secondary channel or parameter being monitored or otherwise displayed by the HMI 1000. For example, in the exemplary embodiment shown in FIG. 10A, the indicator 1030 indicates that a combination ("Combo") toolface mode is currently selected by the user, that the bit depth is being monitored on the secondary channel, and that the current system time is 13:09:04.

The HMI 1000 may also include a textual and/or other type of indicator 1035 displaying the current or most recent toolface orientation. The indicator 1035 may also display the current toolface measurement mode (e.g., gravitational vs. magnetic). The indicator 1035 may also display the time at which the most recent toolface measurement was performed or received, as well as the value of any parameter being monitored by a second channel at that time. For example, in the exemplary embodiment shown in FIG. 10A, the most recent toolface measurement was measured by a gravitational toolface sensor, which indicated that the toolface orientation was −75°, and this measurement was taken at time 13:00:13 relative to the system clock, at which time the bit-depth was most recently measured to be 1830 feet.

The HMI 1000 may also include a textual and/or other type of indicator 1040 displaying the current or most recent inclination of the remote end of the drill string. The indicator 1040 may also display the time at which the most recent inclination measurement was performed or received, as well as the value of any parameter being monitored by a second channel at that time. For example, in the exemplary embodiment shown in FIG. 10A, the most recent drill string end inclination was 8°, and this measurement was taken at time 13:00:04 relative to the system clock, at which time the bit-depth was most recently measured to be 1830 feet. The HMI 1000 may also include an additional graphical or other type of indicator 1040*a* displaying the current or most recent inclination. Thus, for example, the HMI 1000 may depict the current or most recent inclination with both a textual indicator (e.g., indicator 1040) and a graphical indicator (e.g., indicator 1040*a*). In the embodiment shown in FIG. 10A, the graphical inclination indicator 1040*a* represents the current or most recent inclination as an arcuate bar, where the length of the bar indicates the degree to which the inclination varies from vertical, and where the direction in which the bar extends (e.g., clockwise vs. counterclockwise) may indicate a direction of inclination (e.g., North vs. South).

The HMI 1000 may also include a textual and/or other type of indicator 1045 displaying the current or most recent azimuth orientation of the remote end of the drill string. The indicator 1045 may also display the time at which the most recent azimuth measurement was performed or received, as well as the value of any parameter being monitored by a second channel at that time. For example, in the exemplary embodiment shown in FIG. 10A, the most recent drill string end azimuth was 67°, and this measurement was taken at time 12:59:55 relative to the system clock, at which time the bit-depth was most recently measured to be 1830 feet. The HMI 1000 may also include an additional graphical or other type of indicator 1045*a* displaying the current or most recent inclination. Thus, for example, the HMI 1000 may depict the current or most recent inclination with both a textual indicator (e.g., indicator 1045) and a graphical indicator (e.g., indicator 1045*a*). In the embodiment shown in FIG. 10A, the graphical azimuth indicator 1045*a* represents the current or most recent azimuth measurement as an arcuate bar, where the length of the bar indicates the degree to which the azimuth orientation varies from true North or some other predetermined position, and where the direction in which the bar extends (e.g., clockwise vs. counterclockwise) may indicate an azimuth direction (e.g., East-of-North vs. West-of-North).

In some embodiments, the HMI 1000 includes data corresponding to the planned drilling path and the actual drilling path discussed with reference to FIGS. 4C and 5A. This data may provide a visual indicator to a driller of the location of the BHA bit relative to the planned drilling path and/or the target location. In addition, the taken-over-time data displayed in the HMI 1000 in FIG. 10A may be considered when calculating the position of the BHA, whether it is deviating from the planned drilling path, and which zone in FIG. 5B it is located in.

Referring to FIG. 10B, illustrated is a magnified view of a portion of the HMI 1000 shown in FIG. 10A. In embodiments in which the HMI 1000 is depicted as a dial or target shape, the most recent toolface and quill position measurements may be closest to the edge of the dial, such that older readings may step toward the middle of the dial. For example, in the exemplary embodiment shown in FIG. 2, the last reading was 8 minutes before the currently-depicted system time, the next reading was 7 minutes before that one, and the oldest reading was 6 minutes older than the others, for a total of 21 minutes of recorded activity. Readings that are hours or seconds old may indicate the length/unit of time with an "h" or an "s."

As also shown in FIG. 10B, positioning the user's mouse pointer or other graphical user-input means over one of the toolface or quill position symbols 1010, 1015, 1020 may show the symbol's timestamp, as well as the secondary indicator (if any), in a pop-up window 1050. Timestamps may be dependent upon the device settings at the actual time of recording the measurement. The toolface symbols 1010, 1015 may show the time elapsed from when the measurement is recorded by the sensing device (e.g., relative to the current system time). Secondary channels set to display a timestamp may show a timestamp according to the device recording the measurement.

In the embodiment shown in FIGS. 10A and 10B, the HMI 1000 shows the absolute position of the top-drive quill referenced to true North, hole high-side, or to some other predetermined orientation. The HMI 1000 also shows current and historical toolface data received from the downhole tools (e.g., MWD). The HMI 1000, other human-machine interfaces within the scope of the present disclosure, and/or other tools within the scope of the present disclosure may have, enable, and/or exhibit a simplified understanding of the effect of reactive torque on toolface measurements, by accurately monitoring and simultaneously displaying both toolface and quill position measurements to the user.

In view of the above, the Figures, and the references incorporated herein, those of ordinary skill in the art should readily understand that the present disclosure introduces a method of visibly demonstrating a relationship between toolface orientation and quill orientation, such method including: (1) receiving electronic data on an on-going basis, wherein the electronic data includes quill orientation data and at least one of gravity-based toolface orientation data and magnetic-based toolface orientation data; and (2) displaying the electronic data on a user-viewable display in a historical format depicting data resulting from a most recent measurement and a plurality of immediately prior measurements. The electronic data may further include toolface azimuth data, relating the azimuth orientation of the drill string near the bit. The electronic data may further include toolface inclination data, relating the inclination of the drill string near the bit. The quill position data may relate the orientation of the quill, top drive, Kelly, and/or other rotary drive means to the bit and/or toolface. The electronic data may be received from MWD and/or other downhole sensor/measurement means.

The method may further include associating the electronic data with time indicia based on specific times at which measurements yielding the electronic data were performed. In an exemplary embodiment, the most current data may be displayed textually and older data may be displayed graphically, such as a dial- or target-shaped representation. The graphical display may include time-dependent or time-specific symbols or other icons, which may each be user-accessible to temporarily display data associated with that time (e.g., pop-up data). The icons may have a number, text, color, or other indication of age relative to other icons. The icons may be oriented by time, newest at the dial edge, oldest at the dial center. The icons may depict the change in time from (1) the measurement being recorded by a corresponding sensor device to (2) the current computer system time. The display may also depict the current system time.

The present disclosure also introduces an apparatus including: (1) means for receiving electronic data on an on-going basis, wherein the electronic data includes quill orientation data and at least one of gravity-based toolface orientation data and magnetic-based toolface orientation data; and (2) means for displaying the electronic data on a user-viewable display in a historical format depicting data resulting from a most recent measurement and a plurality of immediately prior measurements.

Embodiments within the scope of the present disclosure may offer certain advantages over the prior art. For example, when toolface and quill position data are combined on a single visual display, it may help an operator or other human personnel to understand the relationship between toolface and quill position. Combining toolface and quill position data on a single display may also or alternatively aid understanding of the relationship that reactive torque has with toolface and/or quill position.

Figure 11:
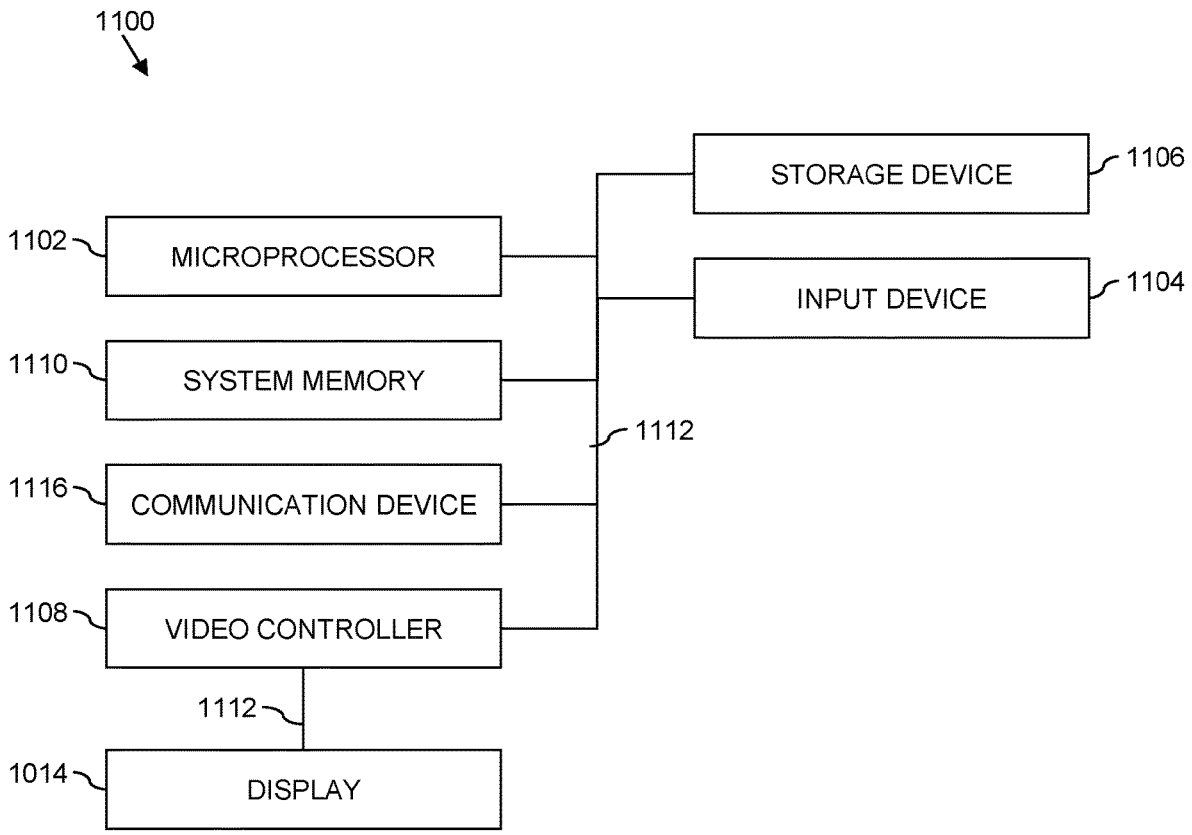
FIG. 11 is a schematic diagram of an apparatus according to one or more aspects of the present disclosure.

Referring to FIG. 11, illustrated is an exemplary system 1100 for implementing one or more embodiments of at least portions of the apparatus and/or methods described herein. The system 1100 includes a processor 1102, an input device 1104, a storage device 1106, a video controller 1108, a system memory 1110, a display 1114, and a communication device 1116, all interconnected by one or more buses 1112. The storage device 1106 may be a floppy drive, hard drive, CD, DVD, optical drive, or any other form of storage device. In addition, the storage device 1106 may be capable of receiving a floppy disk, CD, DVD, or any other form of computer-readable medium that may contain computer-executable instructions. Communication device 1116 may be a modem, network card, or any other device to enable the system 1100 to communicate with other systems.

A computer system typically includes at least hardware capable of executing machine readable instructions, as well as software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, PDAs, and personal computing devices (PCDs), for example). Furthermore, hardware typically includes any physical device that is capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

In view of all of the above and FIGS. 1-11, those of ordinary skill in the art should readily recognize that the present disclosure introduces a method of directionally steering a bottom hole assembly during a drilling operation from a drilling rig to an underground target location. The method includes generating a drilling plan having a drilling path and an acceptable margin of error as a tolerance zone; receiving data indicative of directional trends and projection to bit depth; determining the actual location of the bottom hole assembly based on the direction trends and the projection to bit depth; determining whether the bit is within the tolerance zone; comparing the actual location of the bottom hole assembly to the planned drilling path to identify an amount of deviation of the bottom hole assembly from the actual drilling path; creating a modified drilling path based on the amount of identified deviation from the planned path including: creating a modified drilling path that intersects the planned drilling path if the amount of deviation from the planned path is less than a threshold amount of deviation, and creating a modified drilling path to the target location that does not intersect the planned drilling path if the amount of deviation from the planned path is greater than a threshold amount of deviation; determining a desired tool face orientation to steer the bottom hole assembly along the modified drilling path; automatically and electronically generating drilling rig control signals at a directional steering controller; and outputting the drilling rig control signals to a drawworks and a top drive to steer the bottom hole assembly along the modified drilling path.

The present disclosure also introduces a method of using a quill to steer a hydraulic motor when elongating a wellbore in a direction having a horizontal component, wherein the quill and the hydraulic motor are coupled to opposing ends of a drill string, the method including: monitoring an actual toolface orientation of a tool driven by the hydraulic motor by monitoring a drilling operation parameter indicative of a difference between the actual toolface orientation and a desired toolface orientation; and adjusting a position of the quill by an amount that is dependent upon the monitored drilling operation parameter. The amount of quill position adjustment may be sufficient to compensate for the difference between the actual and desired toolface orientations. Adjusting the quill position may include adjusting a rotational position of the quill relative to the wellbore, a vertical position of the quill relative to the wellbore, or both. Monitoring the drilling operation parameter indicative of the difference between the actual and desired toolface orientations may include monitoring a plurality of drilling operation parameters each indicative of the difference between the actual and desired toolface orientations, and the amount of quill position adjustment may be further dependent upon each of the plurality of drilling operation parameters.

Monitoring the drilling operation parameter may include monitoring data received from a toolface orientation sensor, and the amount of quill position adjustment may be dependent upon the toolface orientation sensor data. The toolface sensor may include a gravity toolface sensor and/or a magnetic toolface sensor.

The drilling operation parameter may include a weight applied to the tool (WOB), a depth of the tool within the wellbore, and/or a rate of penetration of the tool into the wellbore (ROP). The drilling operation parameter may include a hydraulic pressure differential across the hydraulic motor ($\Delta P$), and the $\Delta P$ may be a corrected $\Delta P$ based on monitored pressure of fluid existing in an annulus defined between the wellbore and the drill string.

In an exemplary embodiment, monitoring the drilling operation parameter indicative of the difference between the actual and desired toolface orientations includes monitoring data received from a toolface orientation sensor, monitoring a weight applied to the tool (WOB), monitoring a depth of the tool within the wellbore, monitoring a rate of penetration of the tool into the wellbore (ROP), and monitoring a hydraulic pressure differential across the hydraulic motor ($\Delta P$). Adjusting the quill position may include adjusting the quill position by an amount that is dependent upon the monitored toolface orientation sensor data, the monitored WOB, the monitored depth of the tool within the wellbore, the monitored ROP, and the monitored $\Delta P$.

Monitoring the drilling operation parameter and adjusting the quill position may be performed simultaneously with operating the hydraulic motor. Adjusting the quill position may include causing a drawworks to adjust a weight applied to the tool (WOB) by an amount dependent upon the monitored drilling operation parameter. Adjusting the quill position may include adjusting a neutral rotational position of the quill, and the method may further include oscillating the quill by rotating the quill through a predetermined angle past the neutral position in clockwise and counterclockwise directions.

The present disclosure also introduces a system for using a quill to steer a hydraulic motor when elongating a wellbore in a direction having a horizontal component, wherein the quill and the hydraulic motor are coupled to opposing ends of a drill string. In an exemplary embodiment, the system includes means for monitoring an actual toolface orientation of a tool driven by the hydraulic motor, including means for monitoring a drilling operation parameter indicative of a difference between the actual toolface orientation and a desired toolface orientation; and means for adjusting a position of the quill by an amount that is dependent upon the monitored drilling operation parameter.

The present disclosure also provides an apparatus for using a quill to steer a hydraulic motor when elongating a wellbore in a direction having a horizontal component, wherein the quill and the hydraulic motor are coupled to opposing ends of a drill string. In an exemplary embodiment, the apparatus includes a sensor configured to detect a drilling operation parameter indicative of a difference between an actual toolface orientation of a tool driven by the hydraulic motor and a desired toolface orientation of the tool; and a toolface controller configured to adjust the actual toolface orientation by generating a quill drive control signal directing a quill drive to adjust a rotational position of the quill based on the monitored drilling operation parameter.

The present disclosure also introduces a method of using a quill to steer a hydraulic motor when elongating a wellbore in a direction having a horizontal component, wherein the quill and the hydraulic motor are coupled to opposing ends of a drill string. In an exemplary embodiment, the method includes monitoring a hydraulic pressure differential across the hydraulic motor (ΔP) while simultaneously operating the hydraulic motor, and adjusting a toolface orientation of the hydraulic motor by adjusting a rotational position of the quill based on the monitored ΔP. The monitored ΔP may be a corrected ΔP that is calculated utilizing monitored pressure of fluid existing in an annulus defined between the wellbore and the drill string. The method may further include monitoring an existing toolface orientation of the motor while simultaneously operating the hydraulic motor, and adjusting the rotational position of the quill based on the monitored toolface orientation. The method may further include monitoring a weight applied to a bit of the hydraulic motor (WOB) while simultaneously operating the hydraulic motor, and adjusting the rotational position of the quill based on the monitored WOB. The method may further include monitoring a depth of a bit of the hydraulic motor within the wellbore while simultaneously operating the hydraulic motor, and adjusting the rotational position of the quill based on the monitored depth of the bit. The method may further include monitoring a rate of penetration of the hydraulic motor into the wellbore (ROP) while simultaneously operating the hydraulic motor, and adjusting the rotational position of the quill based on the monitored ROP. Adjusting the toolface orientation may include adjusting the rotational position of the quill based on the monitored WOB and the monitored ROP. Alternatively, adjusting the toolface orientation may include adjusting the rotational position of the quill based on the monitored WOB, the monitored ROP and the existing toolface orientation. Adjusting the toolface orientation of the hydraulic motor may further include causing a drawworks to adjust a weight applied to a bit of the hydraulic motor (WOB) based on the monitored ΔP. The rotational position of the quill may be a neutral position, and the method may further include oscillating the quill by rotating the quill through a predetermined angle past the neutral position in clockwise and counterclockwise directions.

The present disclosure also introduces a system for using a quill to steer a hydraulic motor when elongating a wellbore in a direction having a horizontal component, wherein the quill and the hydraulic motor are coupled to opposing ends of a drill string. In an exemplary embodiment, the system includes means for detecting a hydraulic pressure differential across the hydraulic motor (ΔP) while simultaneously operating the hydraulic motor, and means for adjusting a toolface orientation of the hydraulic motor, wherein the toolface orientation adjusting means includes means for adjusting a rotational position of the quill based on the detected ΔP. The system may further include means for detecting an existing toolface orientation of the motor while simultaneously operating the hydraulic motor, wherein the quill rotational position adjusting means may be further configured to adjust the rotational position of the quill based on the monitored toolface orientation. The system may further include means for detecting a weight applied to a bit of the hydraulic motor (WOB) while simultaneously operating the hydraulic motor, wherein the quill rotational position adjusting means may be further configured to adjust the rotational position of the quill based on the monitored WOB. The system may further include means for detecting a depth of a bit of the hydraulic motor within the wellbore while simultaneously operating the hydraulic motor, wherein the quill rotational position adjusting means may be further configured to adjust the rotational position of the quill based on the monitored depth of the bit. The system may further include means for detecting a rate of penetration of the hydraulic motor into the wellbore (ROP) while simultaneously operating the hydraulic motor, wherein the quill rotational position adjusting means may be further configured to adjust the rotational position of the quill based on the monitored ROP. The toolface orientation adjusting means may further include means for causing a drawworks to adjust a weight applied to a bit of the hydraulic motor (WOB) based on the detected ΔP.

The present disclosure also introduces an apparatus for using a quill to steer a hydraulic motor when elongating a wellbore in a direction having a horizontal component, wherein the quill and the hydraulic motor are coupled to opposing ends of a drill string. In an exemplary embodiment, the apparatus includes a pressure sensor configured to detect a hydraulic pressure differential across the hydraulic motor (ΔP) during operation of the hydraulic motor, and a toolface controller configured to adjust a toolface orientation of the hydraulic motor by generating a quill drive control signal directing a quill drive to adjust a rotational position of the quill based on the detected ΔP. The apparatus may further include a toolface orientation sensor configured to detect a current toolface orientation, wherein the toolface controller may be configured to generate the quill drive control signal further based on the detected current toolface orientation. The apparatus may further include a weight-on-bit (WOB) sensor configured to detect data indicative of an amount of weight applied to a bit of the hydraulic motor, and a drawworks controller configured to cooperate with the toolface controller in adjusting the toolface orientation by generating a drawworks control signal directing a drawworks to operate the drawworks, wherein the drawworks control signal may be based on the detected WOB. The apparatus may further include a rate-of-penetration (ROP) sensor configured to detect a rate at which the wellbore is being elongated, wherein the drawworks control signal may be further based on the detected ROP.

Methods and apparatus within the scope of the present disclosure include those directed towards automatically obtaining and/or maintaining a desired toolface orientation by monitoring drilling operation parameters which previously have not been utilized for automatic toolface orientation, including one or more of actual mud motor ΔP, actual toolface orientation, actual WOB, actual bit depth, actual ROP, actual quill oscillation. Exemplary combinations of these drilling operation parameters which may be utilized according to one or more aspects of the present disclosure to obtain and/or maintain a desired toolface orientation include:

ΔP and TF;
ΔP, TF, and WOB;
ΔP, TF, WOB, and DEPTH;
ΔP and WOB;
ΔP, TF, and DEPTH;
ΔP, TF, WOB, and ROP;
ΔP and ROP;
ΔP, TF, and ROP;
ΔP, TF, WOB, and OSC;
ΔP and DEPTH;
ΔP, TF, and OSC;
ΔP, TF, DEPTH, and ROP;
ΔP and OSC;
ΔP, WOB, and DEPTH;
ΔP, TF, DEPTH, and OSC;
TF and ROP;
ΔP, WOB, and ROP;
ΔP, WOB, DEPTH, and ROP;
TF and DEPTH;
ΔP, WOB, and OSC;
ΔP, WOB, DEPTH, and OSC;
TF and OSC;
ΔP, DEPTH, and ROP;
ΔP, DEPTH, ROP, and OSC;
WOB and DEPTH;
ΔP, DEPTH, and OSC;
ΔP, TF, WOB, DEPTH, and ROP;
WOB and OSC;
ΔP, ROP, and OSC;
ΔP, TF, WOB, DEPTH, and OSC;
ROP and OSC;
ΔP, TF, WOB, ROP, and OSC;
ROP and DEPTH; and
ΔP, TF, WOB, DEPTH, ROP, and OSC;

where ΔP is the actual mud motor ΔP, TF is the actual toolface orientation, WOB is the actual WOB, DEPTH is the actual bit depth, ROP is the actual ROP, and OSC is the actual quill oscillation frequency, speed, amplitude, neutral point, and/or torque.

In an exemplary embodiment, a desired toolface orientation is provided (e.g., by a user, computer, or computer program), and apparatus according to one or more aspects of the present disclosure will subsequently track and control the actual toolface orientation, as described above. However, while tracking and controlling the actual toolface orientation, drilling operation parameter data may be monitored to establish and then update in real-time the relationship between: (1) mud motor ΔP and bit torque; (2) changes in WOB and bit torque; and (3) changes in quill position and actual toolface orientation; among other possible relationships within the scope of the present disclosure. The learned information may then be utilized to control actual toolface orientation by affecting a change in one or more of the monitored drilling operation parameters.

Thus, for example, a desired toolface orientation may be input by a user, and a rotary drive system according to aspects of the present disclosure may rotate the drill string until the monitored toolface orientation and/or other drilling operation parameter data indicates motion of the downhole tool. The automated apparatus of the present disclosure then continues to control the rotary drive until the desired toolface orientation is obtained. Directional drilling then proceeds. If the actual toolface orientation wanders off from the desired toolface orientation, as possibly indicated by the monitored drill operation parameter data, the rotary drive may react by rotating the quill and/or drill string in either the clockwise or counterclockwise direction, according to the relationship between the monitored drilling parameter data and the toolface orientation. If an oscillation mode is being utilized, the apparatus may alter the amplitude of the oscillation (e.g., increasing or decreasing the clockwise part of the oscillation) to bring the actual toolface orientation back on track. Alternatively, or additionally, a drawworks system may react to the deviating toolface orientation by feeding the drilling line in or out, and/or a mud pump system may react by increasing or decreasing the mud motor ΔP. If the actual toolface orientation drifts off the desired orientation further than a preset (user adjustable) limit for a period longer than a preset (user adjustable) duration, then the apparatus may signal an audio and/or visual alarm. The operator may then be given the opportunity to allow continued automatic control, or take over manual operation.

This approach may also be utilized to control toolface orientation, with knowledge of quill orientation before and after a connection, to reduce the amount of time required to make a connection. For example, the quill orientation may be monitored on-bottom at a known toolface orientation, WOB, and/or mud motor ΔP. Slips may then be set, and the quill orientation may be recorded and then referenced to the above-described relationship(s). The connection may then take place, and the quill orientation may be recorded just prior to pulling from the slips. At this point, the quill orientation may be reset to what it was before the connection. The drilling operator or an automated controller may then initiate an "auto-orient" procedure, and the apparatus may rotate the quill to a position and then return to bottom. Consequently, the drilling operator may not need to wait for a toolface orientation measurement, and may not be required to go back to the bottom blind. Consequently, aspects of the present disclosure may offer significant time savings during connections.

Moreover, methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

As used herein, the term "substantially" means that a numerical amount is within about 20 percent, preferably within about 10 percent, and more preferably within about 5 percent of a stated value. In a preferred embodiment, these terms refer to amounts within about 1 percent, within about 0.5 percent, or even within about 0.1 percent, of a stated value.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 of an integer, within the range.

The present disclosure also incorporates herein in its entirety by express reference thereto each of the following references:

U.S. Pat. No. 6,050,348 to Richarson, et al.
U.S. Pat. No. 5,474,142 to Bowden;
U.S. Pat. No. 5,713,422 to Dhindsa;
U.S. Pat. No. 6,192,998 to Pinckard;
U.S. Pat. No. 6,026,912 to King, et al.;
U.S. Pat. No. 7,059,427 to Power, et al.;
U.S. Pat. No. 6,029,951 to Guggari;
"A Real-Time Implementation of MSE," AADE-05-NTCE-66;
"Maximizing Drill Rates with Real-Time Surveillance of Mechanical Specific Energy," SPE 92194;
"Comprehensive Drill-Rate Management Process To Maximize Rate of Penetration," SPE 102210; and
"Maximizing ROP With Real-Time Analysis of Digital Data and MSE," IPTC 10607.

The foregoing outlines features of several embodiments so that those of ordinary-skill in the art may better understand the aspects of the present disclosure. Those of ordinary-skill in the art should appreciate that they may readily use the present disclosure as a basis for designing or modifying other processes and structures for carrying out the same purposes and/or achieving the same advantages of the embodiments introduced herein. Those of ordinary-skill in the art should also realize that such equivalent constructions do not depart from the spirit and scope of the present disclosure, and that they may make various changes, substitutions and alterations herein without departing from the spirit and scope of the present disclosure.

What is claimed is:

1. A method of directionally steering a bottom hole assembly ("BHA") during a drilling operation from a drilling rig to a target location using a drilling plan having a planned drilling path, the method comprising:

receiving data indicative of a directional trend of the BHA and a projection to bit depth;

determining a location of the BHA based on the directional trend of the BHA and the projection to bit depth;

comparing the location of the BHA to the planned drilling path to identify an amount of deviation of the BHA from the planned drilling path; automatically creating a modified drilling path based on the amount of deviation and a predicted trend of a downhole parameter;

determining a first desired tool face orientation to steer the BHA along the modified drilling path;

detecting a trend of the downhole parameter while drilling along the modified drilling path;

comparing the trend of the downhole parameter to the predicted trend of the downhole parameter; and automatically creating a further modified drilling path when the trend of the downhole parameter is a reversal of the predicted trend of the downhole parameter, wherein detecting the trend of the downhole parameter comprises: receiving data relating to: a current rate of penetration; a current differential pressure; a current weight on bit; and a mud weight from a return line; and calculating a d-exponent factor using the current rate of penetration, the current differential pressure, the current weight on bit, the mud weight from the return line, and a bit diameter.

2. The method of claim 1, wherein the predicted trend of the downhole parameter further includes an increase of a d-exponent-corrected factor with an increase in depth.

3. The method of claim 2, wherein the d-exponent-corrected factor is a factor based on rate of penetration, pressure data, bit diameter, weight on bit, and mud weight.

4. The method of claim 1, wherein the reversal of the predicted trend is an indication of drilling into a potential overpressure area.

5. The method of claim 1, wherein the modified drilling path is a path that intersects the planned drilling path; and wherein the modified drilling path is automatically created in response to the amount of deviation exceeding a first threshold amount of deviation and being less than a second threshold amount of deviation.

6. The method of claim 1, wherein the modified drilling path is a path that does not intersect the planned drilling path; and wherein the modified drilling path is automatically created in response to the amount of deviation exceeding a first threshold amount of deviation and a second threshold amount of deviation.

7. The method of claim 1, further comprising:

determining a second desired tool face orientation to steer the BHA along the further modified drilling path;

automatically and electronically generating drilling rig control signals at a directional steering controller; and outputting the drilling rig control signals to a drawworks and a top drive to steer the bottom hole assembly along the further modified drilling path.

8. An apparatus configured to directionally steer a bottom hole assembly ("BHA") during a drilling operation from a drilling rig to a target location using a drilling plan having a planned drilling path, the apparatus comprising: a non-transitory computer readable medium having stored thereon a plurality of instructions, wherein the instructions are executed with at least one processor so that the following steps are executed: receiving data indicative of a directional trend of the BHA and a projection to bit depth; determining a location of the BHA based on the directional trend of the BHA and the projection to bit depth; comparing the location of the BHA to the planned drilling path to identify an amount of deviation of the BHA from the planned drilling path; automatically creating a modified drilling path based on the amount of deviation and a predicted trend of a downhole parameter; determining a first desired tool face orientation to steer the BHA along the modified drilling path; detecting a trend of the downhole parameter while drilling along the modified drilling path; comparing the trend of the downhole parameter to the predicted trend of the downhole parameter; and automatically creating a further modified drilling path when the trend of the downhole parameter is a reversal of the predicted trend of the downhole parameter, wherein detecting the trend of the down hole parameter comprises: receiving data relating to: a current rate of penetration; a current differential pressure; a current weight on bit; and a mud weight from a return line; and calculating a d-exponent factor using the current rate of penetration, the current differential pressure, the current weight on bit, the mud weight from the return line, and a bit diameter.

9. The apparatus of claim 8, wherein the predicted trend of the downhole parameter further includes an increase of a d-exponent-corrected factor with an increase in depth.

10. The apparatus of claim 9, wherein the d-exponent-corrected factor is a factor based on rate of penetration, pressure data, bit diameter, weight on bit, and mud weight.

11. The apparatus of claim 8, wherein the reversal of the predicted trend is an indication of drilling into a potential overpressure area.

12. The apparatus of claim 8, wherein the modified drilling path is a path that intersects the planned drilling path; and wherein the modified drilling path is automatically created in response to the amount of deviation exceeding a first threshold amount of deviation and being less than a second threshold amount of deviation.

13. The apparatus of claim 8, wherein the modified drilling path is a path that does not intersect the planned drilling path; and wherein the modified drilling path is automatically created in response to the amount of deviation exceeding a first threshold amount of deviation and a second threshold amount of deviation.

14. The apparatus of claim 8, wherein, when the instructions are executed with at least one processor, the following steps are also executed:

determining a second desired tool face orientation to steer the BHA along the further modified drilling path;

automatically and electronically generating drilling rig control signals at a directional steering controller; and outputting the drilling rig control signals to a drawworks and a top drive to steer the bottom hole assembly along the further modified drilling path.

15. A method of directionally steering a bottom hole assembly ("BHA") during a drilling operation from a drilling rig to a target location using a drilling plan having a planned drilling path, the method comprising:

receiving data indicative of a directional trend of the BHA and a projection to bit depth;

determining a location of the BHA based on the directional trend of the BHA and the projection to bit depth;

comparing the location of the BHA to the planned drilling path to identify an amount of deviation of the BHA from the planned drilling path; automatically creating a modified drilling path based on the amount of deviation and a predicted trend of a downhole parameter;

determining a first desired tool face orientation to steer the BHA along the modified drilling path;

detecting a trend of the downhole parameter while drilling along the modified drilling path;

comparing the trend of the downhole parameter to the predicted trend of the downhole parameter; and automatically creating a further modified drilling path when the trend of the downhole parameter is a reversal of the predicted trend of the downhole parameter, wherein the predicted trend of the downhole parameter is an increase of a d-exponent factor with an increase in depth, and wherein the d-exponent factor is a factor based on rate of penetration, pressure data, bit diameter, weight on bit, and mud weight.

16. An apparatus configured to directionally steer a bottom hole assembly ("BHA") during a drilling operation from a drilling rig to a target location using a drilling plan having a planned drilling path, the apparatus comprising: a non-transitory computer readable medium having stored thereon a plurality of instructions, wherein the instructions are executed with at least one processor so that the following steps are executed: receiving data indicative of a directional trend of the BHA and a projection to bit depth; determining a location of the BHA based on the directional trend of the BHA and the projection to bit depth; comparing the location of the BHA to the planned drilling path to identify an amount of deviation of the BHA from the planned drilling path; automatically creating a modified drilling path based on the amount of deviation and a predicted trend of a downhole parameter; determining a first desired toolface orientation to steer the BHA along the modified drilling path; detecting a trend of the down hole parameter while drilling along the modified drilling path; comparing the trend of the down hole parameter to the predicted trend of the downhole parameter; and automatically creating a further modified drilling path when the trend of the down hole parameter is a reversal of the predicted trend of the down hole parameter, wherein the predicted trend of the downhole parameter is an increase of a d-exponent factor with an increase in depth, and wherein the d-exponent factor is a factor based on rate of penetration, pressure data, bit diameter, weight on bit, and mud weight.

* * * * *